US011506000B2

(12) United States Patent
Robichaux et al.

(10) Patent No.: US 11,506,000 B2
(45) **Date of Patent: *Nov. 22, 2022**

(54) DOWNHOLE SWIVEL APPARATUS AND METHOD

(71) Applicant: Mako Rentals, Inc., Schriever, LA (US)

(72) Inventors: Kip M. Robichaux, Houma, LA (US); Kenneth G. Caillouet, Thibodaux, LA (US); Terry P. Robichaux, Houma, LA (US)

(73) Assignee: Mako Rentals, Inc., Shriever, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/240,073

(22) Filed: Apr. 26, 2021

(65) Prior Publication Data

US 2022/0034171 A1 Feb. 3, 2022

Related U.S. Application Data

(63) Continuation of application No. 16/983,488, filed on Aug. 3, 2020, now Pat. No. 10,988,989, which is a (Continued)

(51) Int. Cl.
*E21B 7/12* (2006.01)
*E21B 17/01* (2006.01)
(Continued)

(52) U.S. Cl.
CPC ..... *E21B 17/05* (2013.01); *E21B 7/12* (2013.01); *E21B 17/01* (2013.01); *E21B 21/00* (2013.01);
(Continued)

(58) Field of Classification Search
CPC . E21B 7/12; E21B 17/01; E21B 17/05; E21B 21/00; E21B 21/001; E21B 33/038;
(Continued)

(56) References Cited

U.S. PATENT DOCUMENTS 3,587,734 A * 6/1971 Shaffer ..... E21B 33/064 166/368
3,621,912 A * 11/1971 Wooddy, Jr ..... E21B 33/085 166/340
(Continued)

FOREIGN PATENT DOCUMENTS

WO WO-9945234 A1 * 9/1999 ..... G01V 3/32

*Primary Examiner* — Matthew R Buck
(74) *Attorney, Agent, or Firm* — Roy Kiesel Ford Doody & North, APLC; Brett A. North

(57) ABSTRACT

What is provided is a method and apparatus which can be detachably connected to an annular blowout preventer thereby separating the drilling fluid or mud into upper and lower sections and allowing the fluid to be displaced in two stages, such as while the drill string is being rotated and/or reciprocated. In one embodiment the sleeve can be rotatably and sealably connected to a mandrel. The swivel can be incorporated into a drill or well string and enabling string sections both above and below the sleeve to be rotated in relation to the sleeve. In one embodiment the drill or well string does not move in a longitudinal direction relative to the swivel. In one embodiment, the drill or well string does move longitudinally relative to the sleeve of the swivel.

11 Claims, 60 Drawing Sheets

Related U.S. Application Data continuation of application No. 16/416,439, filed on May 20, 2019, now Pat. No. 10,731,424, which is a continuation of application No. 15/829,953, filed on Dec. 3, 2017, now Pat. No. 10,294,732, which is a continuation of application No. 15/162,665, filed on May 24, 2016, now Pat. No. 9,834,996, which is a continuation of application No. 14/595,713, filed on Jan. 13, 2015, now Pat. No. 9,347,283, which is a continuation of application No. 14/276,459, filed on May 13, 2014, now Pat. No. 8,931,560, which is a continuation of application No. 13/686,139, filed on Nov. 27, 2012, now Pat. No. 8,720,577, which is a continuation of application No. 11/943,012, filed on Nov. 20, 2007, now Pat. No. 8,316,945, which is a continuation of application No. 11/284,425, filed on Nov. 18, 2005, now Pat. No. 7,296,628.

(60) Provisional application No. 60/700,082, filed on Jul. 18, 2005, provisional application No. 60/671,876, filed on Apr. 15, 2005, provisional application No. 60/648,549, filed on Jan. 31, 2005, provisional application No. 60/631,681, filed on Nov. 30, 2004.

(51) Int. Cl.

| | |
|---|---|
| ***E21B 17/05*** | (2006.01) |
| ***E21B 21/00*** | (2006.01) |
| ***E21B 33/038*** | (2006.01) |
| ***E21B 33/06*** | (2006.01) |
| ***E21B 33/064*** | (2006.01) |
| ***E21B 33/08*** | (2006.01) |
| ***E21B 41/00*** | (2006.01) |

(52) U.S. Cl.
CPC ..... *E21B 21/001* (2013.01); *E21B 33/038* (2013.01); *E21B 33/06* (2013.01); *E21B 33/064* (2013.01); *E21B 33/085* (2013.01); *E21B 41/0007* (2013.01)

(58) Field of Classification Search
CPC ..... E21B 33/06; E21B 33/064; E21B 33/085; E21B 41/0007
See application file for complete search history.

(56) References Cited

U.S. PATENT DOCUMENTS 3,638,721 A * 2/1972 Harrison ..... E21B 33/085 166/351
3,805,894 A * 4/1974 Giroux ..... E21B 34/02 166/369
4,128,127 A * 12/1978 Taylor ..... F16L 27/023 166/105
4,418,947 A * 12/1983 Talafuse ..... F16L 27/0828 285/276
4,466,487 A * 8/1984 Taylor, Jr. ..... E21B 4/003 166/339
4,529,035 A * 7/1985 Bayh, III ..... E21B 34/08 166/106
4,856,414 A * 8/1989 Churkin ..... B66D 1/28 92/83
4,903,764 A * 2/1990 Gleditsch ..... E21B 29/12 166/78.1
4,911,244 A * 3/1990 Hynes ..... E21B 33/043 166/368
4,913,239 A * 4/1990 Bayh, III ..... E21B 17/003 166/105
5,224,557 A * 7/1993 Yenulis ..... E21B 33/085 166/84.3
5,293,933 A * 3/1994 Brisco ..... E21B 33/05 166/70
5,301,595 A * 4/1994 Kessie ..... F16J 15/22 277/651
5,996,712 A * 12/1999 Boyd ..... E21B 7/068 166/242.7
6,039,118 A * 3/2000 Carter ..... E21B 17/07 166/355
6,039,325 A * 3/2000 Steinetz ..... F16J 15/0812 277/528
6,070,670 A * 6/2000 Carter ..... E21B 17/07 166/381
6,202,764 B1 * 3/2001 Ables ..... E21B 17/025 166/242.5
6,230,557 B1 * 5/2001 Ciglenec ..... E21B 49/10 73/152.01
6,244,345 B1 * 6/2001 Helms ..... E21B 7/067 166/301
6,244,359 B1 * 6/2001 Bridges ..... E21B 21/001 166/358
6,454,009 B2 * 9/2002 Carmichael ..... E21B 21/103 134/167 C
6,457,529 B2 * 10/2002 Calder ..... E21B 21/001 166/368
6,904,970 B2 * 6/2005 Simson ..... E21B 33/16 166/291
7,007,753 B2 * 3/2006 Robichaux ..... E21B 17/05 166/177.4
7,296,628 B2 * 11/2007 Robichaux ..... E21B 7/12 166/339
7,413,023 B2 * 8/2008 Howlett ..... E21B 17/01 166/195
8,316,945 B2 * 11/2012 Robichaux ..... E21B 33/085 166/339
8,720,577 B2 * 5/2014 Robichaux ..... E21B 21/00 166/339
8,931,560 B2 * 1/2015 Robichaux ..... E21B 21/001 166/339
9,347,283 B2 * 5/2016 Robichaux ..... E21B 17/05
9,834,996 B2 * 12/2017 Robichaux ..... E21B 33/085
10,294,732 B2 * 5/2019 Robichaux ..... E21B 33/038
10,731,424 B2 * 8/2020 Robichaux ..... E21B 17/05
10,988,989 B2 * 4/2021 Robichaux ..... E21B 17/05
2006/0180312 A1 * 8/2006 Bracksieck ..... E21B 17/05 166/312
2008/0105439 A1 * 5/2008 Robichaux ..... E21B 33/064 166/381

* cited by examiner

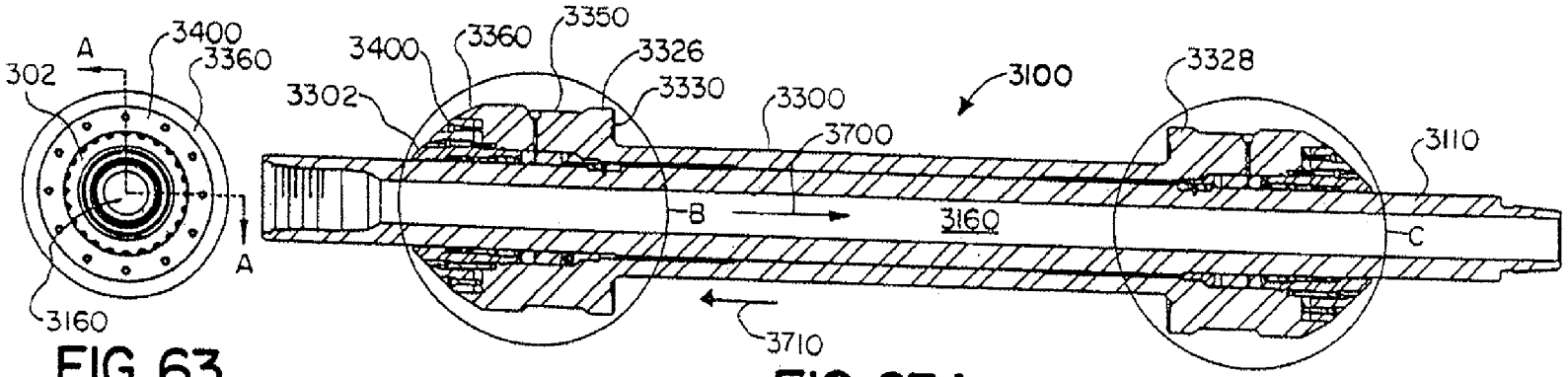
FIG. 63A.
FIG. 63.
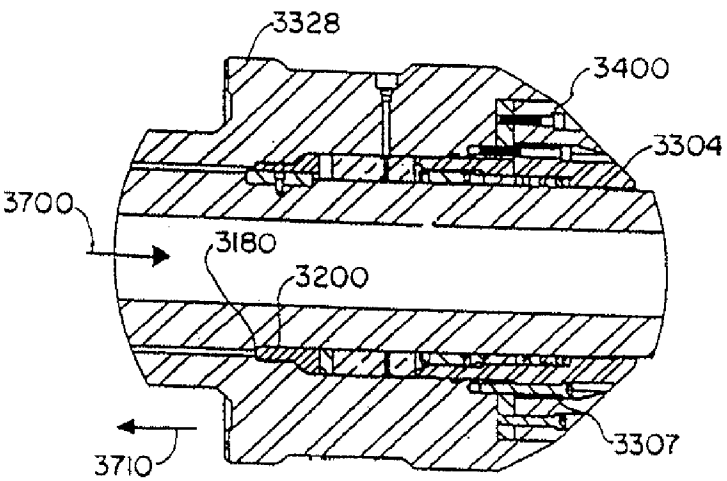
FIG. 63C.
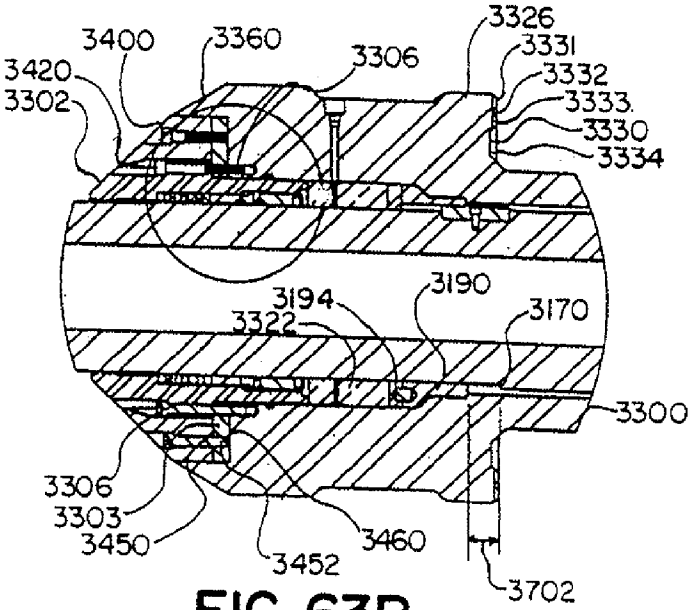
FIG. 63B.

DOWNHOLE SWIVEL APPARATUS AND METHOD

CROSS-REFERENCE TO RELATED APPLICATIONS

This is a continuation of U.S. patent application Ser. No. 16/983,488, filed Aug. 3, 2020 (now U.S. Pat. No. 10,988,989), which is a continuation of U.S. patent application Ser. No. 16/416,439, filed May 20, 2019 (now U.S. Pat. No. 10,294,732), which is a continuation of U.S. patent application Ser. No. 15/829,953, filed Dec. 3, 2017 (now U.S. Pat. No. 10,294,732), which is a continuation of U.S. patent application Ser. No. 15/162,665, filed May 24, 2016 (now U.S. Pat. No. 9,834,996), which is a continuation of U.S. patent application Ser. No. 14/595,713, filed Jan. 13, 2015 (now U.S. Pat. No. 9,347,283), which is a continuation of U.S. patent application Ser. No. 14/276,459, filed May 13, 2014 (now U.S. Pat. No. 8,931,560), which is a continuation of U.S. patent application Ser. No. 13/686,139, filed Nov. 27, 2012 (now U.S. Pat. No. 8,720,577), which is a continuation of U.S. patent application Ser. No. 11/943,012, filed Nov. 20, 2007 (now U.S. Pat. No. 8,316,945), which was a continuation of U.S. patent application Ser. No. 11/284,425, filed Nov. 18, 2005 (now U.S. Pat. No. 7,296,628), which is a non-provisional and claims the benefit of each of the following provisional patent applications: (a) U.S. Provisional Patent Application Ser. No. 60/631,681, filed Nov. 30, 2004; (b) U.S. Provisional Patent Application Ser. No. 60/648,549, filed Jan. 31, 2005; (c) U.S. Provisional Patent Application Ser. No. 60/671,876, filed Apr. 15, 2005; and (d) U.S. Provisional Patent Application Ser. No. 60/700,082, filed Jul. 18, 2005.

Each of the above referenced patents/patent applications are incorporated herein by reference in their entirety, and priority to/of each is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

In deepwater drilling rigs, marine risers extending from a wellhead fixed on the ocean floor have been used to circulate drilling fluid back to a structure or rig. The riser must be large enough in internal diameter to accommodate the largest bit and pipe that will be used in drilling a borehole. During the drilling process drilling fluid or mud fills the riser and wellbore.

An example of a drilling rig and various drilling components is shown in FIG. 1 of U.S. Pat. No. 6,263,982 (which patent is incorporated herein by reference). A conventional slip or telescopic joint SJ, comprising an outer barrel OB and an inner barrel IB with a pressure seal therebetween can be used to compensate for the relative vertical movement or heave between the floating rig and the fixed subsea riser R. A Diverter D can been connected between the top inner barrel IB of the slip joint SJ and the floating structure or rig S to control gas accumulations in the riser R or low pressure formation gas from venting to the rig floor F. A ball joint BJ between the diverter D and the riser R can compensate for other relative movement (horizontal and rotational) or pitch and roll of the floating structure S and the riser R (which is fixed).

The diverter D can use a diverter line DL to communicate drilling fluid or mud from the riser R to a choke manifold CM, shale shaker SS or other drilling fluid receiving device. Above the diverter D can be the flowline RF which can be configured to communicate with a mud pit MP. A conventional flexible choke line CL can be configured to communicate with a choke manifold CM. The drilling fluid can flow from the choke manifold CM to a mud-gas buster or separator MB and a flare line (not shown). The drilling fluid can then be discharged to a shale shaker SS, and mud pits MP. In addition to a choke line CL and kill line KL, a booster line BL can be used.

After drilling operations, when preparing the wellbore and riser for production, it is desirable to remove the drilling fluid or mud. Removal of drilling fluid is typically done through displacement by a completion fluid. Because of its relatively high cost this drilling fluid is typically recovered for use in another drilling operation. Displacing the drilling fluid in multiple sections is desirable because the amount of drilling fluid to be removed during completion is typically greater than the storage space available at the drilling rig for either completion fluid and/or drilling fluid.

In deep water settings, after drilling is stopped the total volume of drilling fluid in the well bore and the riser can be in excess of 5,000 barrels. However, many rigs do not have the capacity for storing 5,000 plus barrels of completion fluid and/or drilling fluid when displacing in one step the total volume of drilling fluid in the well bore and riser. Accordingly, displacement is typically done in two or more stages.

Where the displacement process is performed in two or more stages, there is a risk that, during the time period between stages, the displacing fluid will intermix or interface with the drilling fluid thereby causing the drilling fluid to be unusable or require extensive and expensive reclamation efforts before being usable.

It is believed that rotating the drill string during the displacement process helps to better remove the drilling fluid along with down hole contaminants such as mud, debris, and/or other items.

It is believed that reciprocating the drill string during the displacement process also helps to loosen and/or remove unwanted downhole items by creating a plunging effect. Reciprocation can also allow scrapers and/or brushes to better clean desired portions of the walls of the well bore and casing, such as where perforations will be made for later production.

During displacement there is a need to allow the drilling fluid to be displaced in two or more sections.

During displacement there is a need to prevent intermixing of the drilling fluid with displacement fluid.

During displacement there is a need to allow the drill string to rotate.

During displacement there is a need to allow the drill string to reciprocate longitudinally.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The method and apparatus of the present invention solves the problems confronted in the art in a simple and straightforward manner.

One embodiment relates to a method and apparatus for deepwater rigs. In particular, one embodiment relates to a method and apparatus for removing or displacing working fluids in a well bore and riser.

One embodiment provides a method and apparatus having a swivel which can operably and/or detachably connect to an annular blowout preventer thereby separating the drilling fluid or mud into upper and lower sections and allowing the drilling fluid to be displaced in two stages.

In one embodiment a swivel can be used having a sleeve that is rotatably and sealably connected to a mandrel. The swivel can be incorporated into a drill or well string.

In one embodiment the sleeve can be fluidly sealed from the mandrel.

In one embodiment the sleeve can be fluidly sealed with respect to the outside environment.

In one embodiment the sealing system between the sleeve and the mandrel is designed to resist fluid infiltration from the exterior of the sleeve to the interior space between the sleeve and the mandrel.

In one embodiment a the sealing system between the sleeve and the mandrel has a higher pressure rating for pressures tending to push fluid from the exterior of the sleeve to the interior space between the sleeve and the mandrel than pressures tending to push fluid from the interior space between the sleeve and the mandrel to the exterior of the sleeve.

In one embodiment a swivel having a sleeve and mandrel is used having at least one catch or upset to restrict longitudinal movement of the sleeve relative to the annular blow out preventer. In one embodiment a plurality of catches or upsets are used. In one embodiment the plurality of catches are longitudinally spaced apart.

In one embodiment means are provided (such as grooves, rings, and other fluid pathways) to prevent the sleeve from forming a complete seal with the horizontal surfaces of the annular blowout preventer while the sleeve does seal with the vertical surfaces of the annular blowout preventer.

One embodiment allows separation of the drilling fluid into upper and lower sections.

One embodiment restricts intermixing between the drilling fluid and the displacement fluid during the displacement process.

One embodiment allows the riser and well bore to be separated into two volumetric sections (e.g., 2,500 barrels each) where the rigs can carry a sufficient amount of displacement fluid to remove each section without stopping during the displacement process. In one embodiment, fluid removal of the two volumetric sections in stages can be accomplished, but there is a break of an indefinite period of time between stages (although this break may be of short duration).

In one embodiment the drill or well string does not move in a longitudinal direction relative to the swivel during displacement of fluid during the removal process.

In one embodiment the drill or well string is reciprocated longitudinally during displacement of fluid during the removal process.

In one embodiment the drill or well string is rotated during displacement of fluid during the removal process.

In one embodiment the drill or well string is intermittently rotated during displacement of fluid during the removal process.

In one embodiment the drill or well string is continuously rotated during displacement of fluid during the removal process.

In one embodiment the drill or well string is alternately rotated during displacement of fluid during the removal process.

In one embodiment the direction of rotation of the drill or well string is changed during displacement of fluid during the removal process.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 63 through 63C are views of the swivel of FIG. 54 where the sleeve is moved up with respect to the mandrel.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
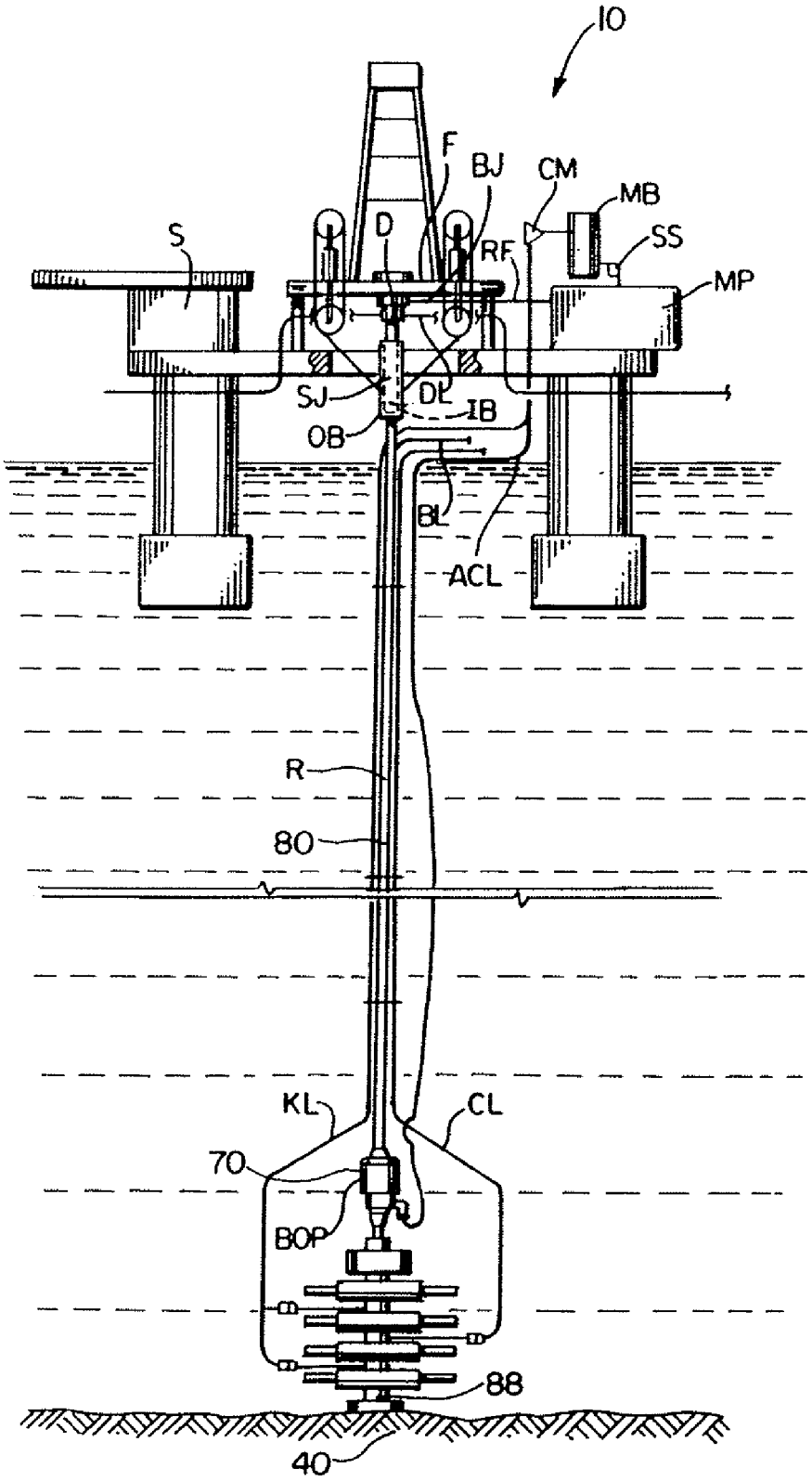
FIG. 1 is a schematic view showing a deep water drilling rig with riser and annular blowout preventer.
Figure 2:
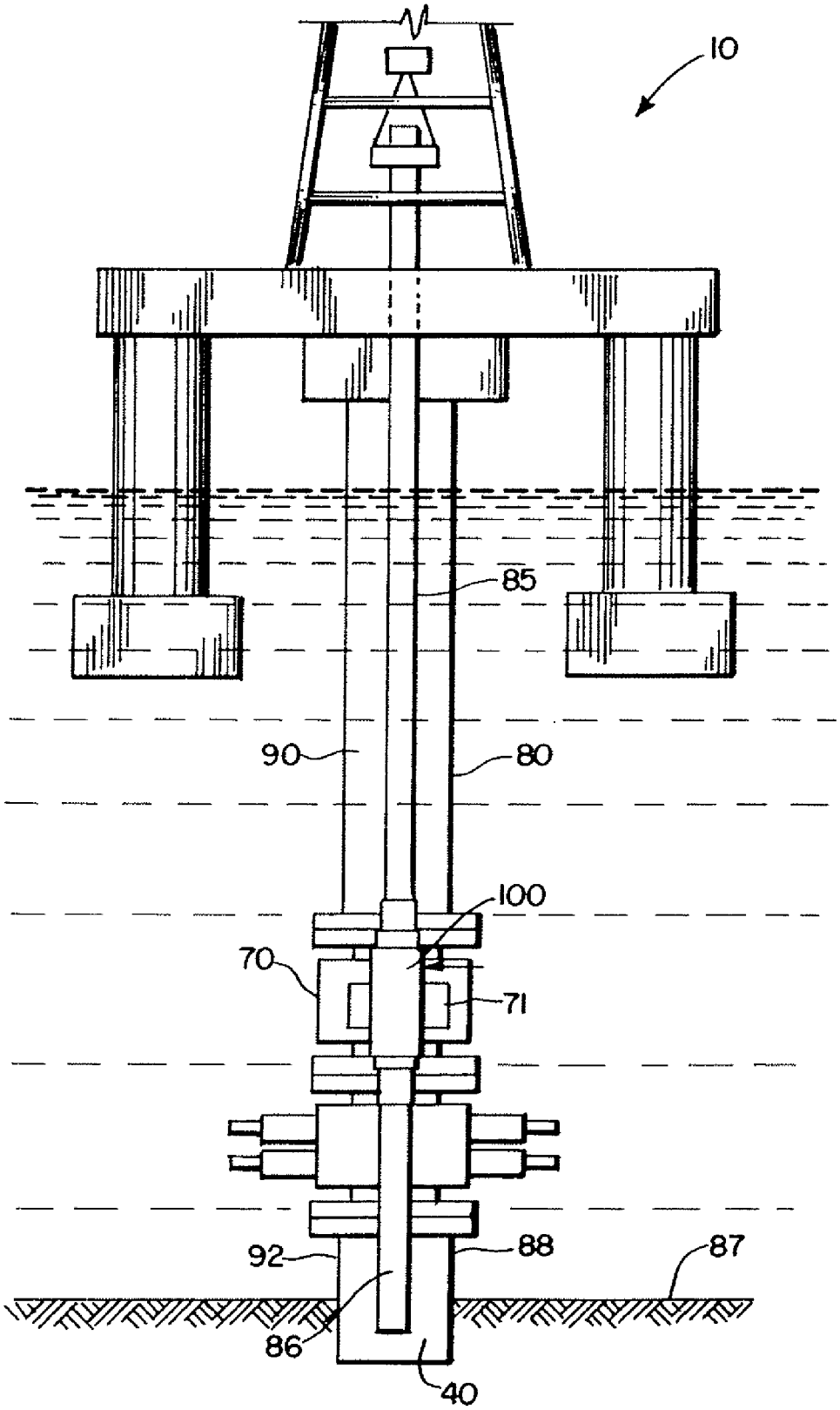
FIG. 2 is another schematic view of a deep water drilling rig showing a swivel detachably connected to an annular blowout preventer.

FIG. 1 is a schematic view showing rig 10 connected to riser 80 and having annular blowout preventer 70. FIG. 2 is a schematic view showing rig 10 with swivel 100 separating upper drill string 85 and lower drill string 86. Swivel 100 is shown detachably connected to annular blowout preventer 70 through annular packing unit seal 71. With such construction drill string 85,86 can be rotated while annular blowout preventer 70 is sealed around swivel 100 thereby separating a fluid into upper and lower longitudinal sections.

Figure 3:
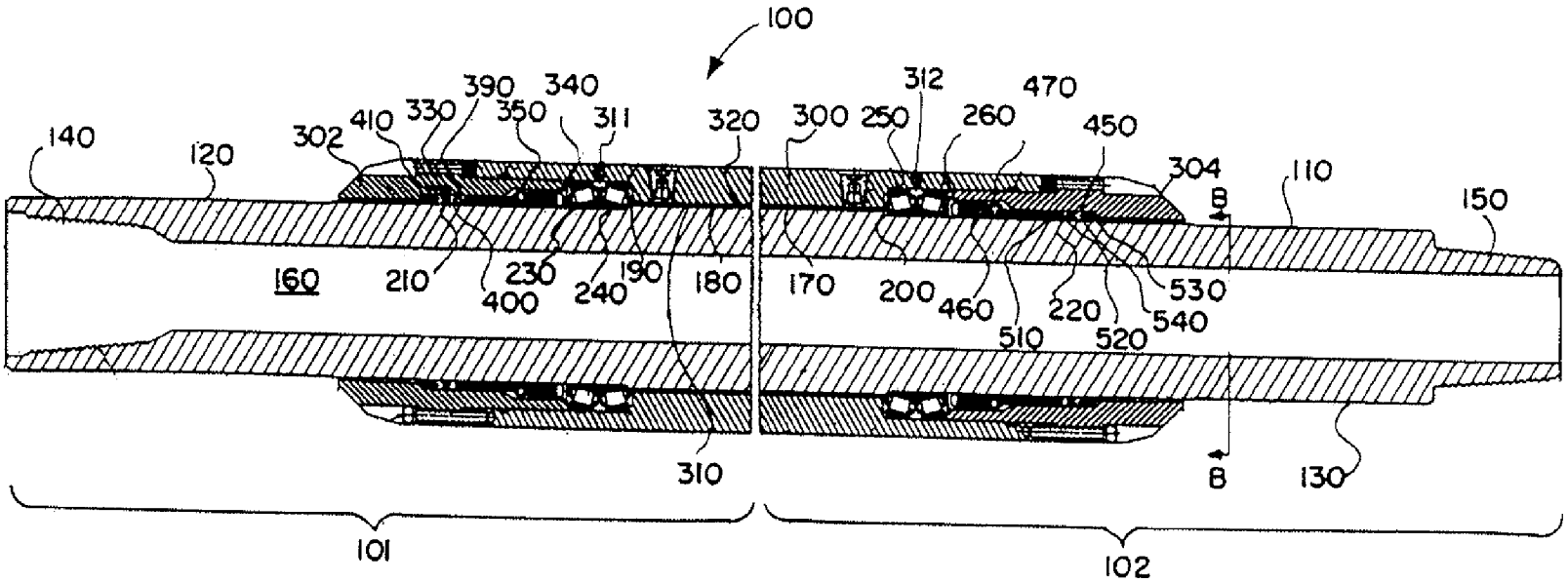
FIG. 3 is a sectional view of a swivel.
Figure 4:
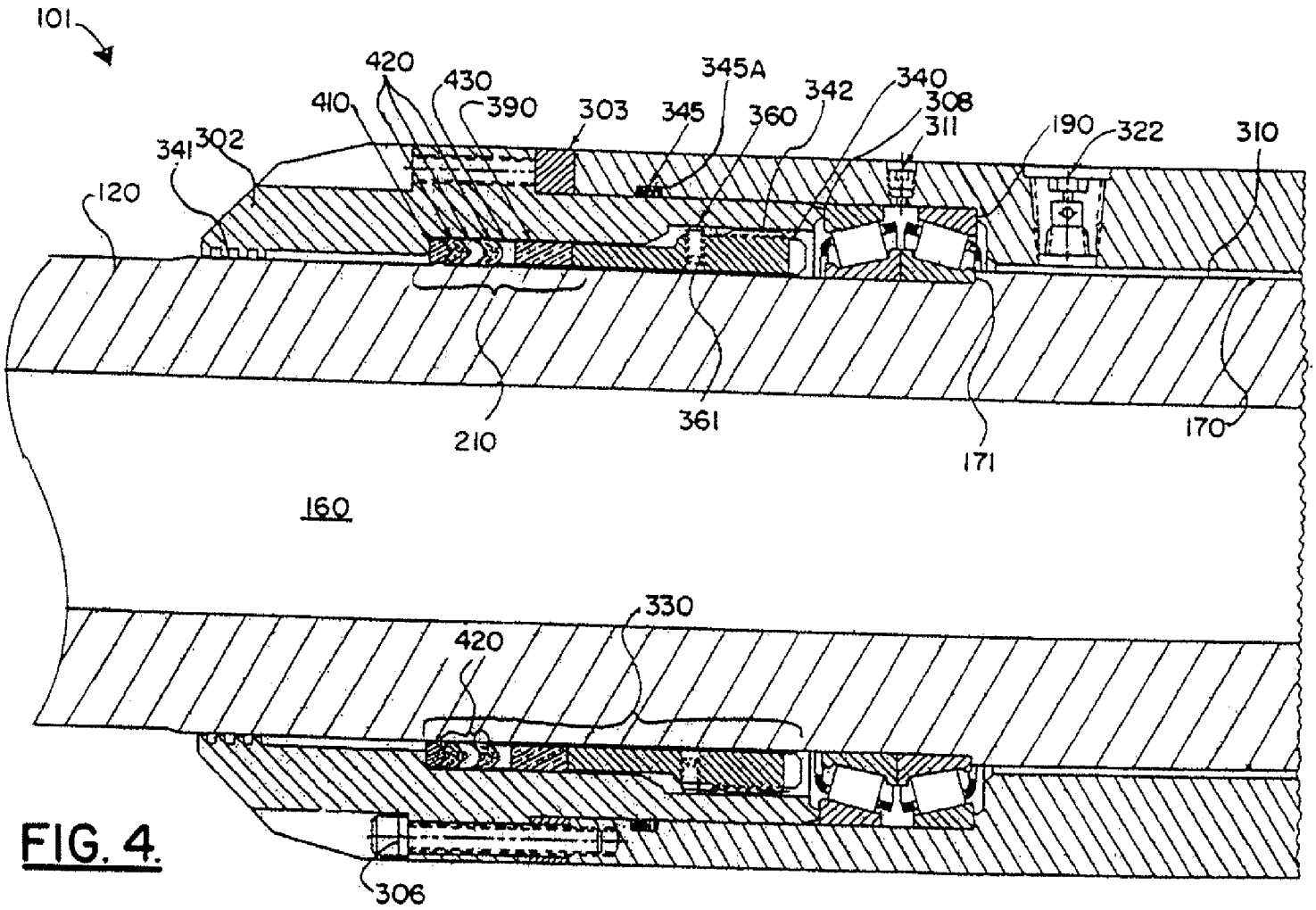
FIG. 4 is a sectional view of the upper portion of the swivel in FIG. 3.
Figure 5:
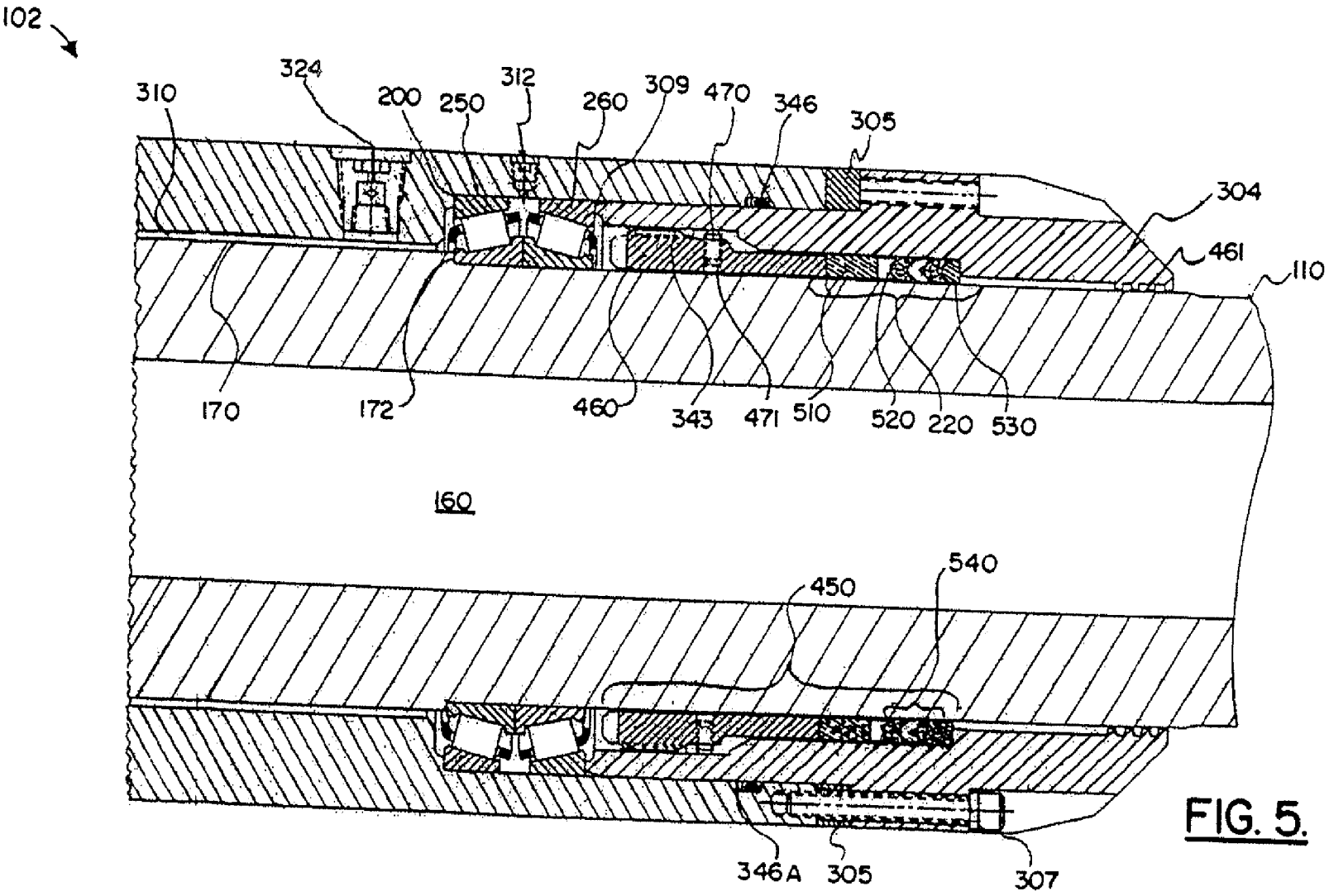
FIG. 5 is a sectional view of the lower portion of the swivel in FIG. 3.
Figure 6:
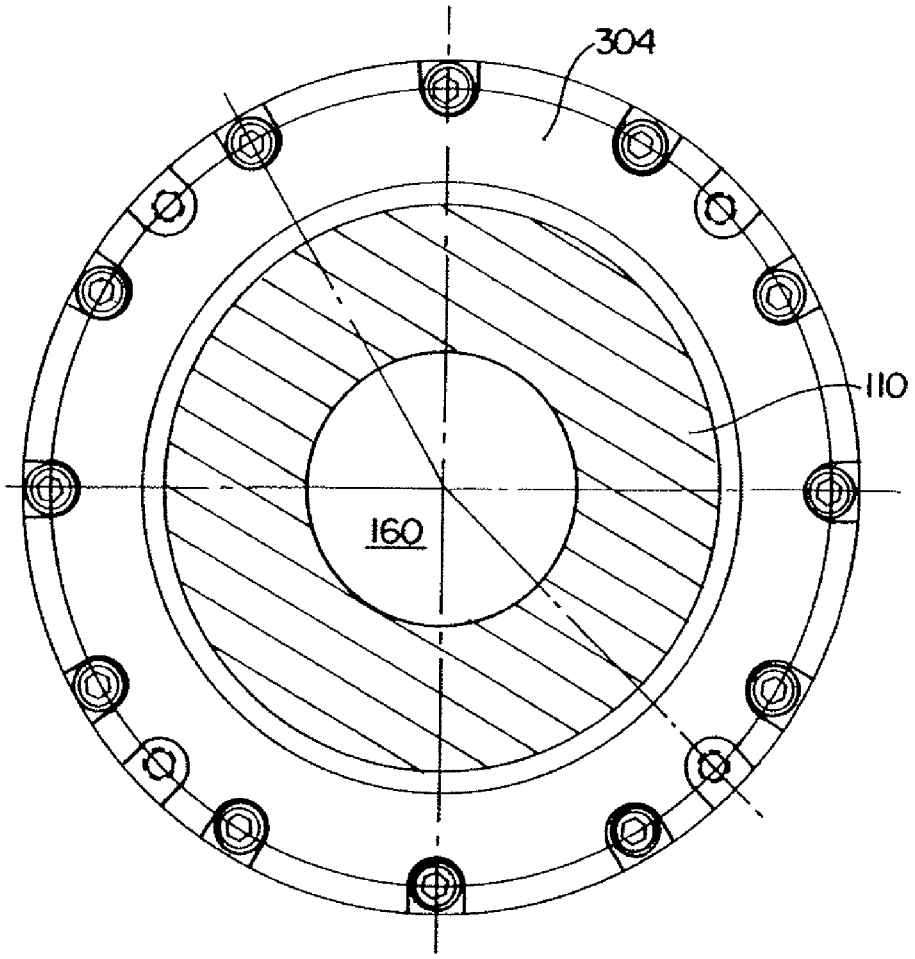
FIG. 6 is a sectional side view of the swivel in FIG. 3 taken along the lines B-B.

FIGS. 3 through 6 show one embodiment of swivel 100. FIG. 3 is a schematic view of swivel 100. FIG. 4 is a sectional view of the upper portion of swivel 100 identified by bracket 101 in FIG. 3. FIG. 5 is a sectional view of the lower portion of swivel 100 identified by bracket 102 in FIG. 3. FIG. 6 is a sectional side view of swivel 100 taken along the lines B-B of FIG. 3.

Swivel 100 can be comprised of mandrel 110 and sleeve 300. Sleeve 300 can be rotatably and sealably connected to mandrel 110. Accordingly, when mandrel 110 is rotated, sleeve 300 can remain stationary to an observer insofar as rotation is concerned.

Mandrel 110 can comprise upper end 120 and lower end 130. Central longitudinal passage 160 can extend from upper end 120 through lower end 130. Lower end 130 can include a pin connection 150 or any other conventional connection. Upper end 120 can include box connection 140 or any other conventional connection. Mandrel 110 can in effect become a part of drill string 85,86 as shown in FIG. 2.

Sleeve 300 can fit over mandrel 110 and be rotatably and sealably connected to mandrel 110. Sleeve 300 can be rotatably connected to mandrel 110 by a plurality of bearings 230,240,250,260. The upper portion of sleeve 300 can be rotatably connected by upper bearings 230,240. The lower portion of sleeve 300 can be rotatably connected by lower bearings 250,260. Upper lubrication port 311 can be used to provide lubrication to upper bearings 230,240. Lower lubrication port 312 can be used to provide lubrication to lower bearings 250,260.

Mandrel 110 can include shoulder 170 to support bearings 230,240,250,260. Sleeve 300 can include protruding section 320 to support bearings 230,240,250,260. Upper bearings 230,240 are held in place by upper end cap 302. Lower bearings 250,260 are held in place by lower end cap 304. Upper end cap 302 and lower end cap 304 can be connected to sleeve 300 respectively by plurality of fasteners 306,307, such as bolts.

Upper bearings 230,240 can be positioned between tip 308 of upper end cap 302 and upper surface of shoulder 190 of sleeve 300 along with upper surface of shoulder 171 of mandrel 110. Lower bearings 250,260 can be positioned between tip 309 of lower end cap 304 and lower surface of shoulder 200 of sleeve 300 along with lower surface of shoulder 172 of mandrel 110.

Upper end cap 302 and lower end cap 304 can be connected to sleeve 300 respectively by plurality of fasteners 306,307, such as bolts. As shown in FIG. 4, a spacer ring 303 can be used to position lower end cap 304 in relation to mandrel 300. The spacer ring 303 can include a plurality of holes to allow fasteners 306 to pass through. As shown in FIG. 5, a spacer ring 305 can be used to position upper end cap 302 in relation to mandrel 300. The spacer ring 305 can include a plurality of holes to allow fasteners 307 to pass through (holes not shown). Alternatively, upper and lower end caps 302,304 can be threaded into sleeve 300.

Upper end cap 302 can include mechanical seal 341 to prevent dirt and debris from coming between upper end cap 302 and mandrel 110. Lower end cap 304 can include mechanical seal 461 to prevent dirt and debris from coming between lower end cap 304 and mandrel 110.

Sleeve 300 can be sealably connected to mandrel 110 by upper and lower packing units 330,450. Upper packing unit 330 can comprise male packing ring 410, plurality of seals 420, female packing ring 430, spacer ring 390, and packing retainer nut 340. Packing retainer nut 340 can be threadably connected to upper end cap 302 at threaded connection 342. Tightening packing retainer nut 340 squeezes plurality of seals 420 between upper end cap 302 and retainer nut 340 thereby increasing sealing between sleeve 300 (through upper end cap 302) and swivel mandrel 110. Set screw 360 can be used to lock packing retainer nut 340 in place and prevent retainer nut 340 from loosening during operation. Set screw 360 can be threaded into bore 361 and lock into upper end cap 302. O-ring 345 can be used to seal upper end cap 302 to sleeve 300. A back up ring 345A can be used with o-ring 345 to prevent extrusion of o-ring 345.

Lower packing unit 450 can comprise male packing ring 530, plurality of seals 540, female packing ring 520, spacer ring 510, and packing retainer nut 460. Packing retainer nut 460 can be threadably connected to lower end cap 304 at threaded connection 343. Tightening packing retainer nut 460 squeezes plurality of seals 540 between lower end cap 304 and nut 460 thereby increasing sealing between sleeve 300 (through lower end cap 304) and swivel mandrel 110. Packing retainer nut 460 can be locked in place by set screw 470. Set screw 470 can be used to lock packing retainer nut 460 in place and prevent retainer nut 460 from loosening during operation. Set screw 470 can be threaded into bore 471 and lock into lower end cap 304. O-ring 346 can be used to seal lower end cap 304 to sleeve 300. A back up ring 346A can be used with o-ring 346 to prevent extrusion of o-ring 346.

Check valves 322,324 can be used to provide pressure relief from interior space 310.

FIGS. 7 through 23 show a sectional view of an alternative swivel 100. Alternative swivel 100 can comprise mandrel 110 and sleeve 300. In this alternative embodiment a plurality of ninety degree locks 600 and set screws 610 can be used to prevent plurality of bolts 306 from loosening during use. Similarly, a plurality of locks 620 and set screws 630 can be used to prevent plurality of bolts 307 from loosening during use.

Figure 7:
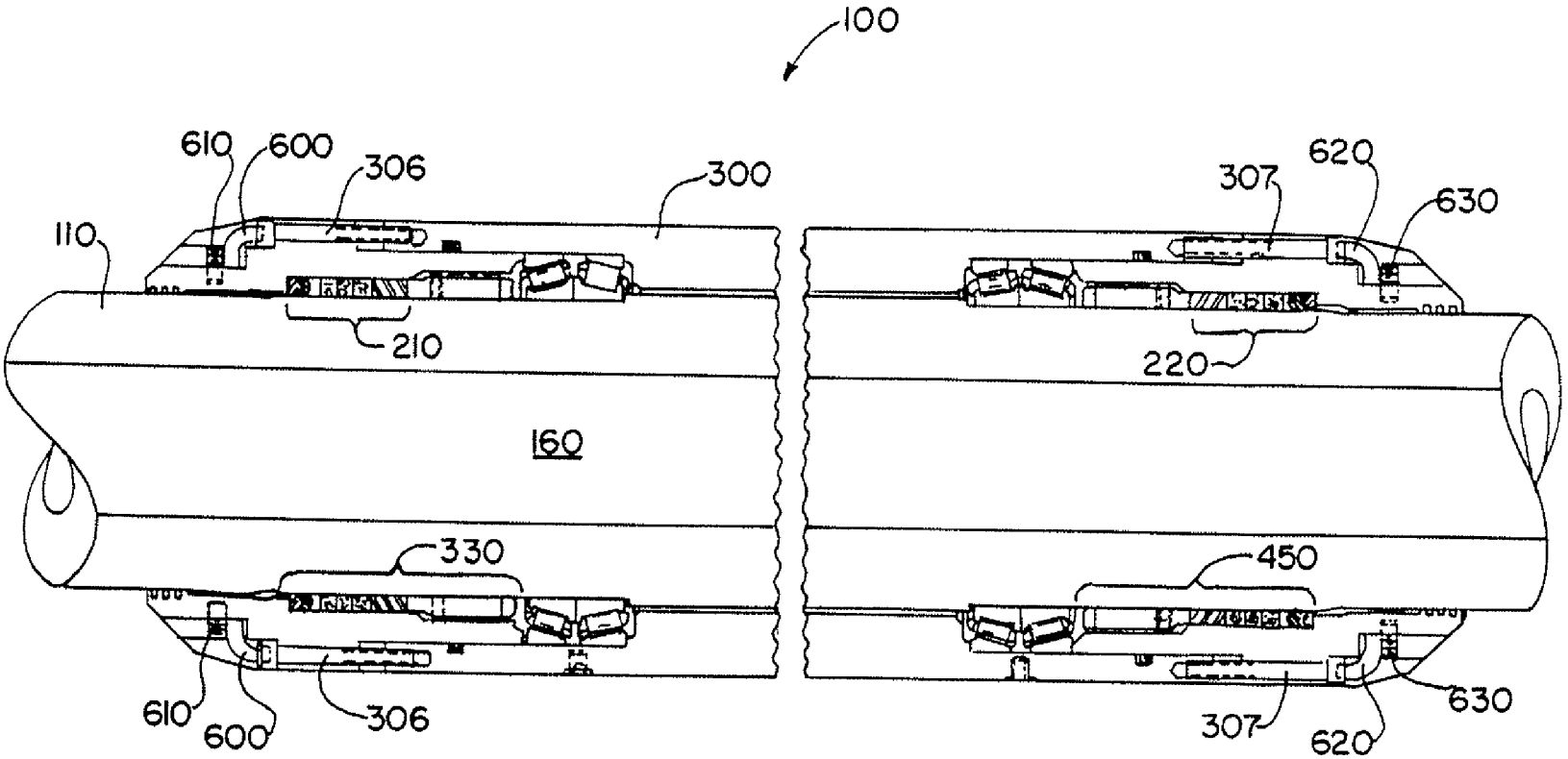
FIG. 7 is a sectional view of an alternative swivel.
Figure 8:
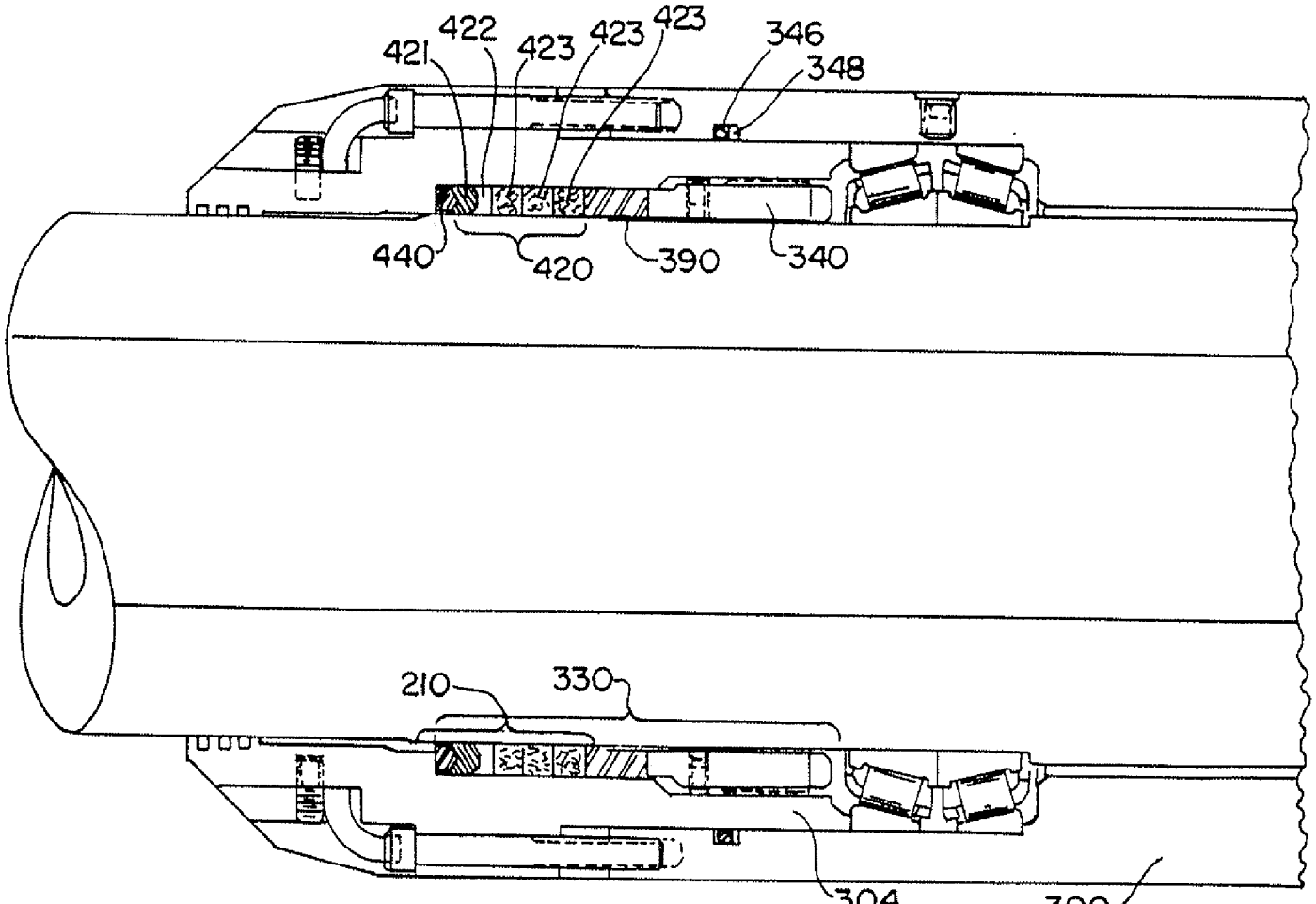
FIG. 8 is a sectional view of the lower portion of the swivel in FIG. 7.
Figure 9:
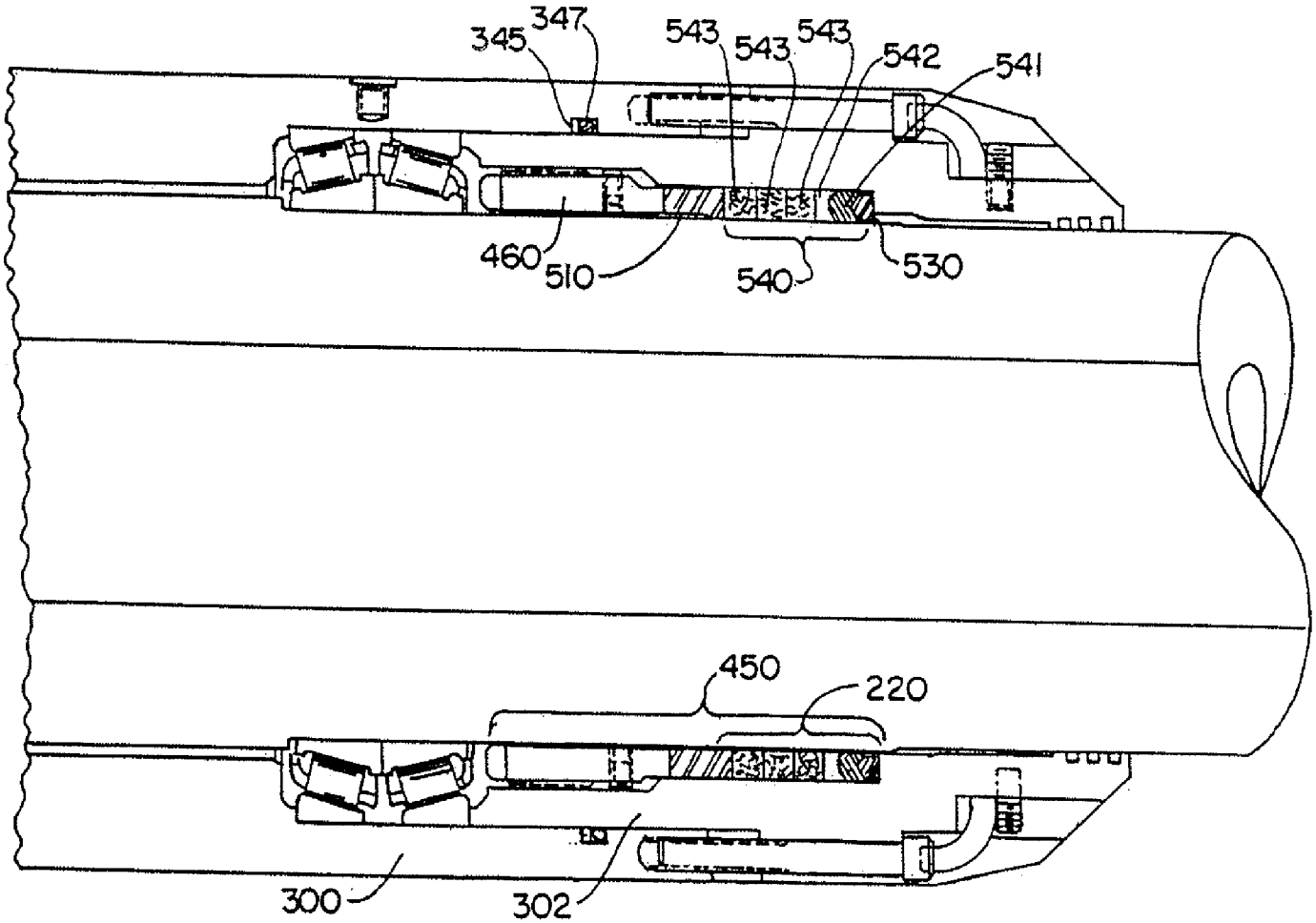
FIG. 9 is a sectional view of the upper portion of the swivel in FIG. 7.

FIGS. 7 through 9 also show a different construction of packing units 330, 450. Packing unit 330 can comprise male packing ring 410, plurality of seals 420, spacer ring 390, and packing retainer nut 340. Packing unit 450 can comprise male packing ring 530, plurality of seals 540, spacer ring 510, and packing retainer nut 460. Plurality of seals 420 can comprise first seal 421, female packing ring 422, and a plurality of rope seals 423. Similarly, plurality of seals 540 can comprise first seal 541, female packing ring 542, and a plurality of rope seals 543. First seals 421,541 can be a Chevron type seal such as CDI model number 0370650-VS-850 HNBR having a ⅜ inch section height. Plurality of rope seals 423,543 can be Garlock 7/16 inch (or ⅜ inch) section 8913 Rope Seals by 22 13/16 inch long. Rope seals 421,541 have surprisingly been found to extend the live of first seals 421,541. This is thought to be by secretion of lubricants, such as graphite, during use.

Figure 10:
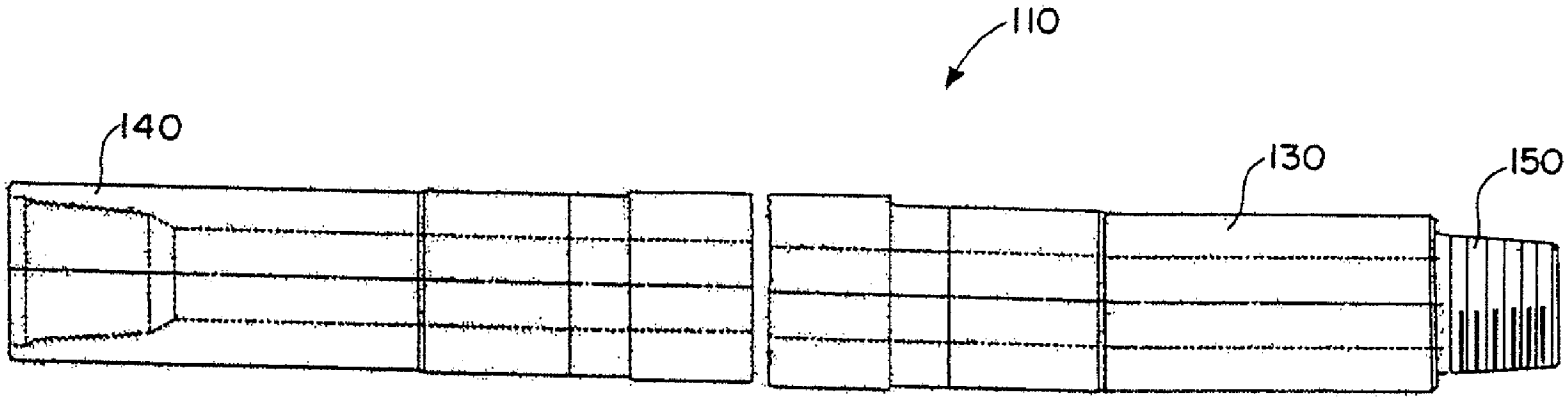
FIG. 10 shows a mandrel for the swivel in FIG. 7.
Figure 11:
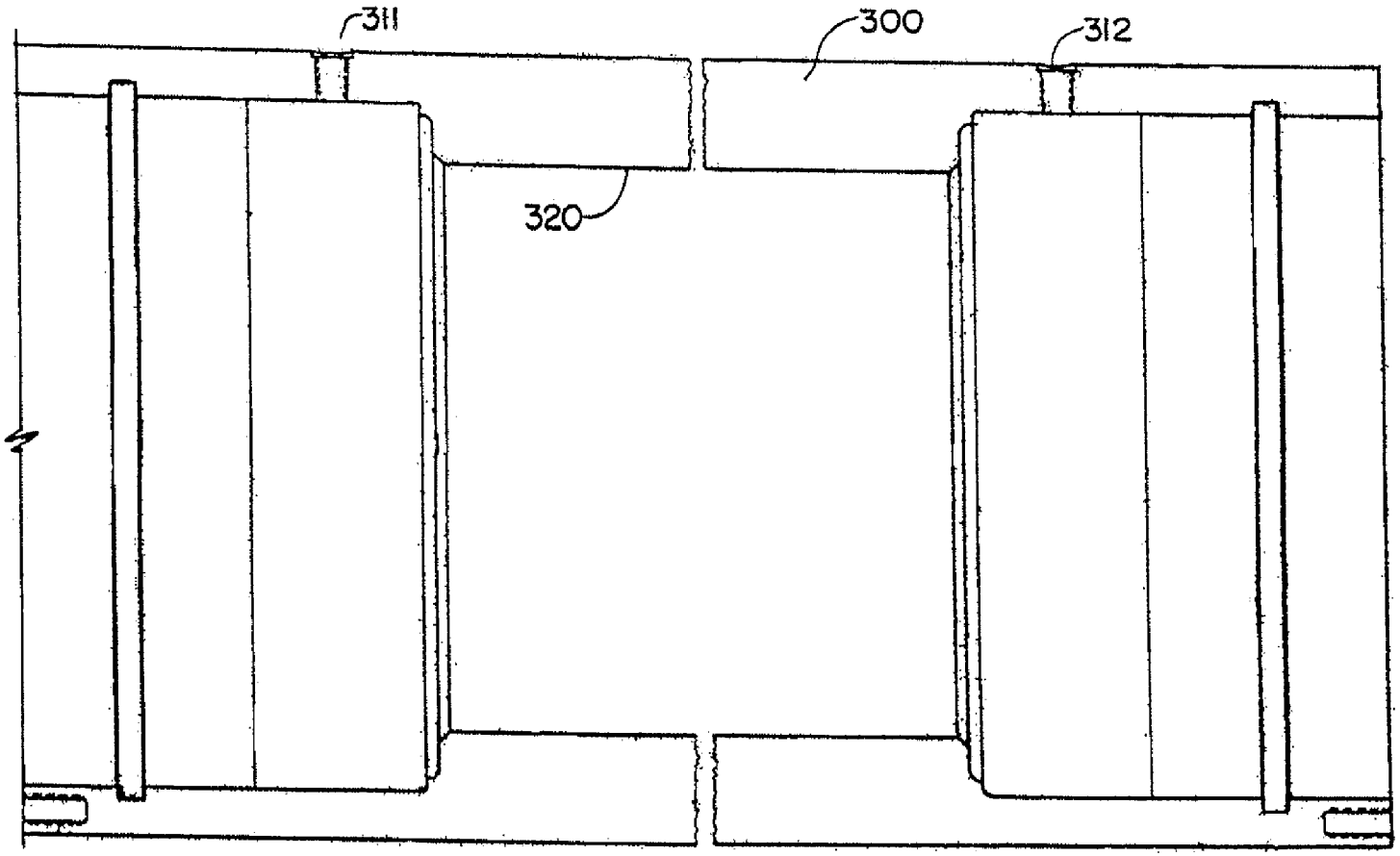
FIG. 11 is a sectional view of a sleeve for the swivel in FIG. 7.
Figure 12:
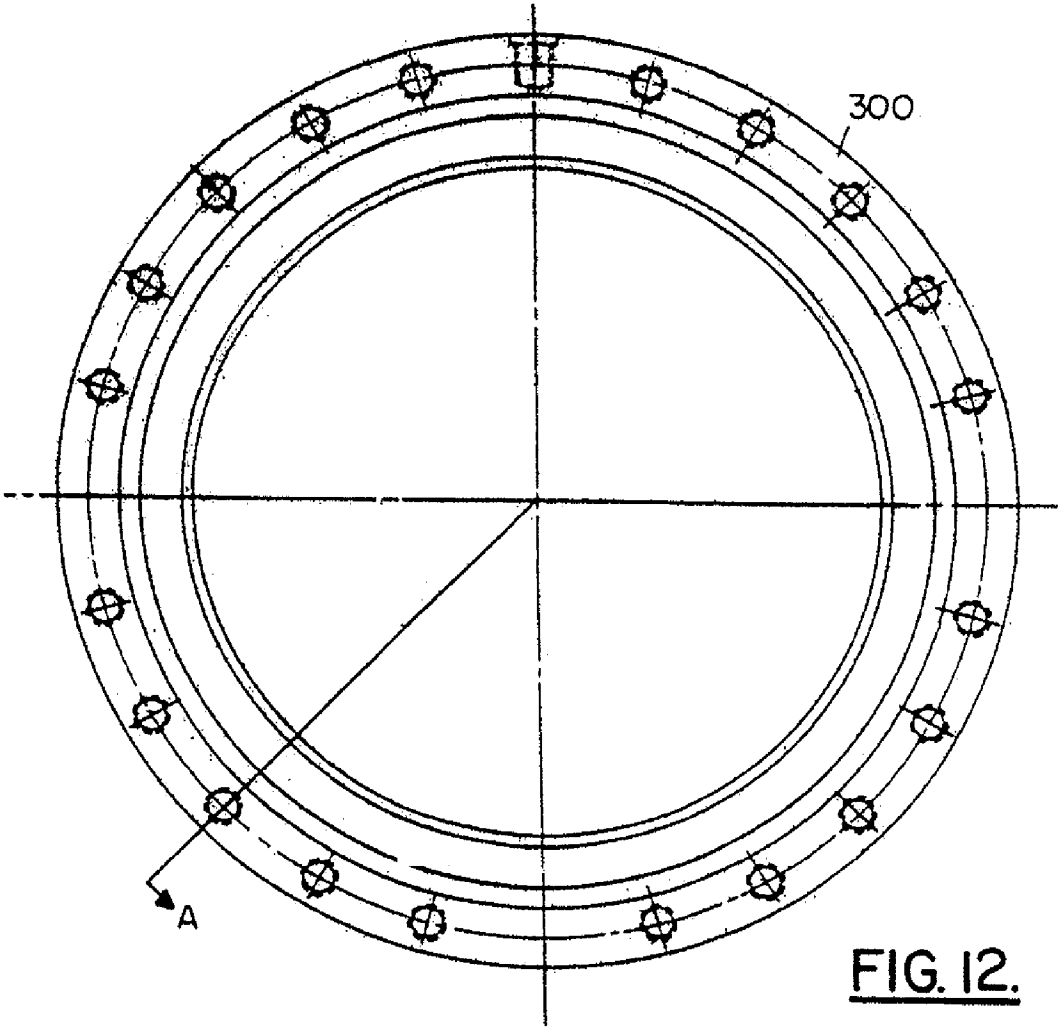
FIG. 12 is a side view of the sleeve of FIG. 11.

FIGS. 11 through 23 show the construction of the individual components of alternative swivel 100 shown assembled in FIGS. 7 through 9. FIG. 10 shows a mandrel 110. FIG. 11 is a sectional view of sleeve 300. FIG. 12 is a side view of sleeve 300.

Sleeve 300 can include upper and lower lubrication ports 311,312. Ports 311,312 can be used to lubricate the bearings located under the ports when alternative swivel 100 is out of service. When in service it is preferred that lubrication ports 311,312 be closed through threadable pipe plugs (or some pressure relieving type connection). This will prevent fluid migration through ports 311,312 when swivel 100 is exposed to high pressures (e.g., 5,000 pounds per square inch) such as when in deep water service. It is preferred that the heads of pipe plugs placed in lubrication ports 311,312 will be flush with the surface of sleeve 300. Flush mounting will minimize the risk of having sleeve 300 catch or scratch something when in use.

Upper o-ring 345 can be used to seal upper end cap 302 to sleeve 300. Back-up ring 347 can be used to increase the pressure rating of o-ring 345 (e.g., from 1,500 to 5,000 pound per square inch). Lower o-ring 346 can be used to seal lower end cap 304 to sleeve 300. Back-up ring 348 can be used to increase the pressure rating of o-ring 346 (e.g., from 1,500 to 5,000 pound per square inch). Back up rings 347,348 increase pressure ratings by resisting extrusion of o-rings 345,346. Preferred constructions for o-rings 345,346 can be Parbak "0" ring 2-371 (75 Durometer V1164 Viton) and Parkbak 371 (90 Durometer V0709 Viton). A preferred construction for back up rings 347,348 can be Parker "Parbak" 371 Teflon or Viton.

Figure 13:
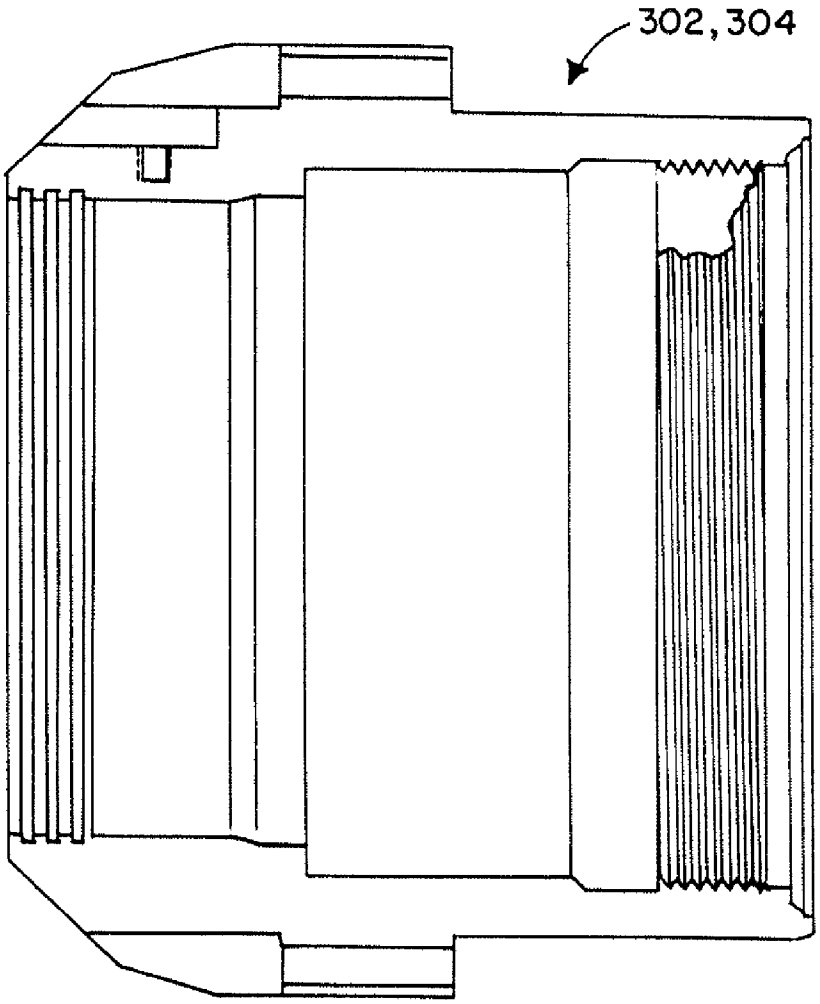
FIG. 13 is a sectional view of an alternative end cap for the swivel in FIG. 7.
Figure 14A:
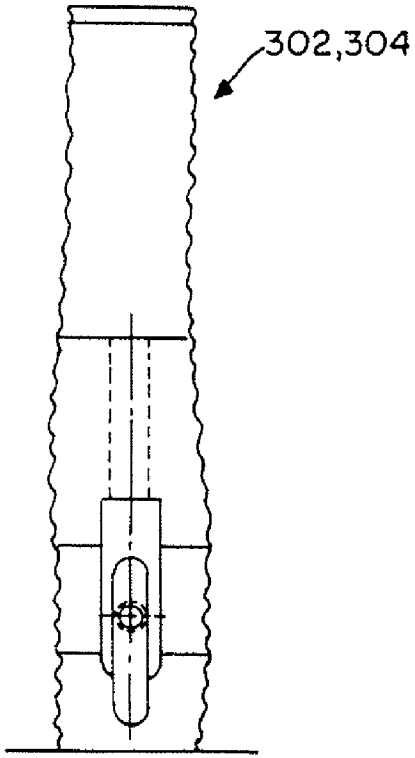
FIG. 14A is a sectional view of FIG. 14.
Figure 14:
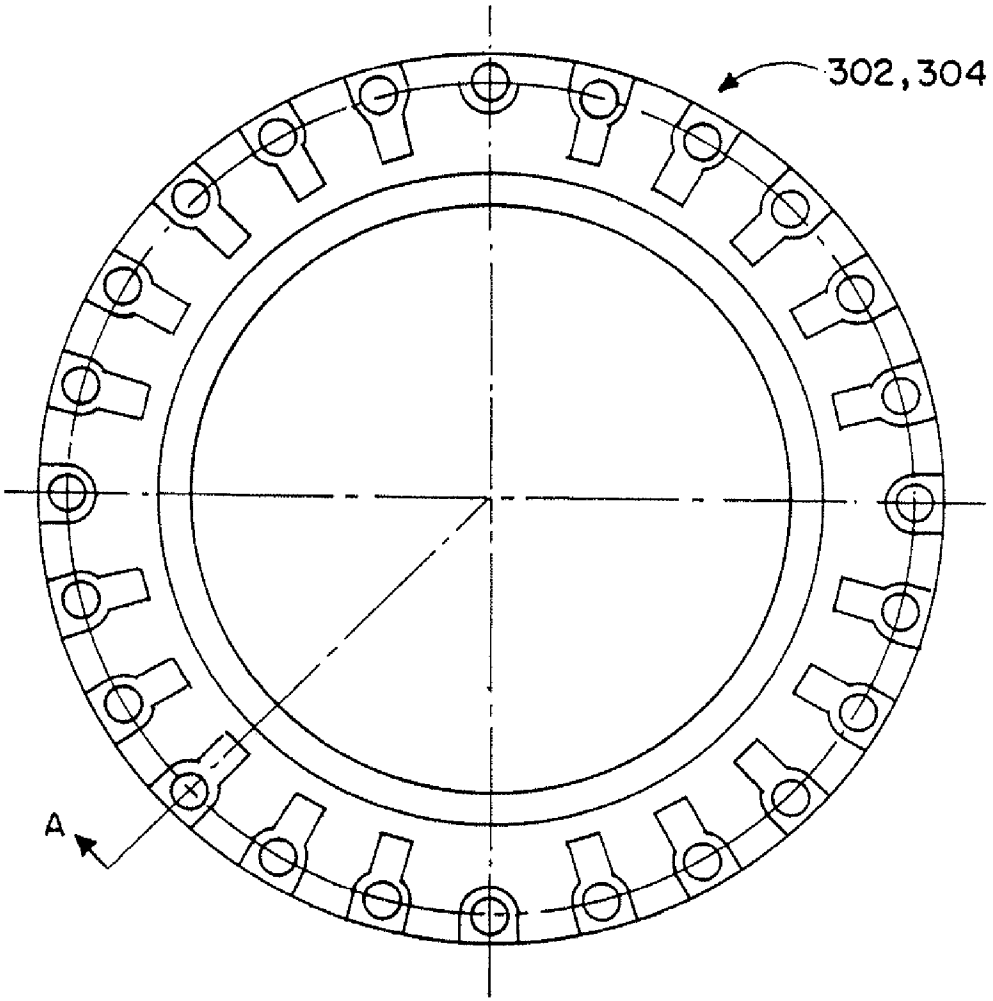
FIG. 14 is a side view of the end cap of FIG. 13.
Figure 16:
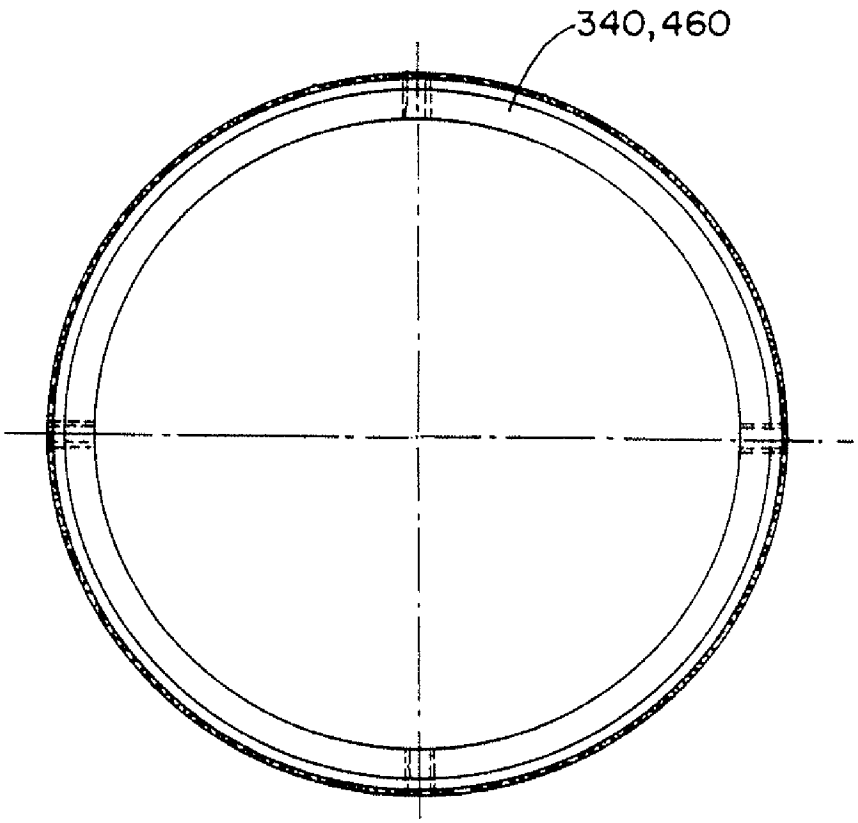
FIG. 16 is a right side view of the packing retainer nut of FIG. 15.
Figure 15:
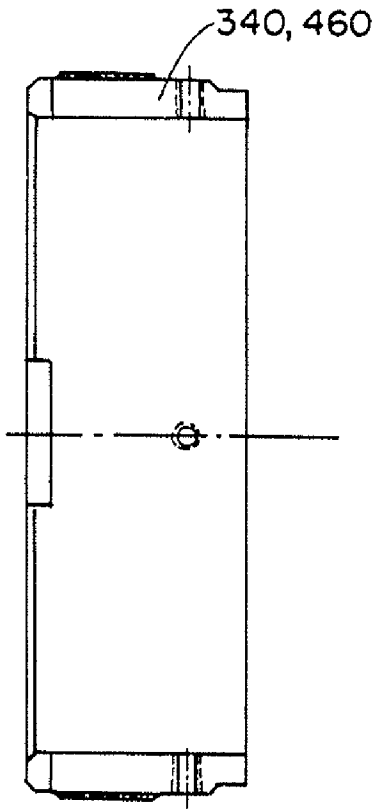
FIG. 15 is a sectional view of a packing retainer nut for the swivel in FIG. 7.
Figure 17:
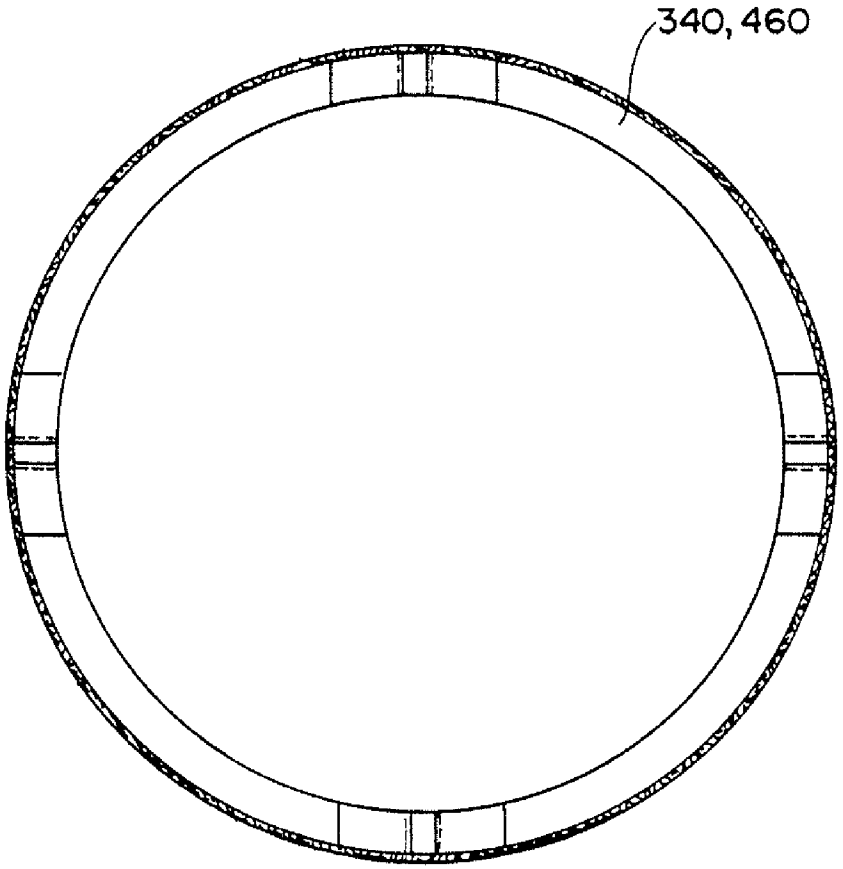
FIG. 17 is a left side view of the packing retainer nut of FIG. 15.

FIG. 13 is a sectional view of alternative end caps 302,304. Both alternative end caps 302,304 are of similar construction. FIG. 14 is a side view of the end caps 302,304 of FIG. 13. FIG. 14A is a sectional view of end caps 302, 304 taken along the line A of FIG. 14. FIG. 15 is a right side view of packing retainer nuts 340, 460. FIG. 17 is a left side view of packing retainer nuts 340,460. Packing retainer nuts 340,460 can be of similar construction.

Figure 18:
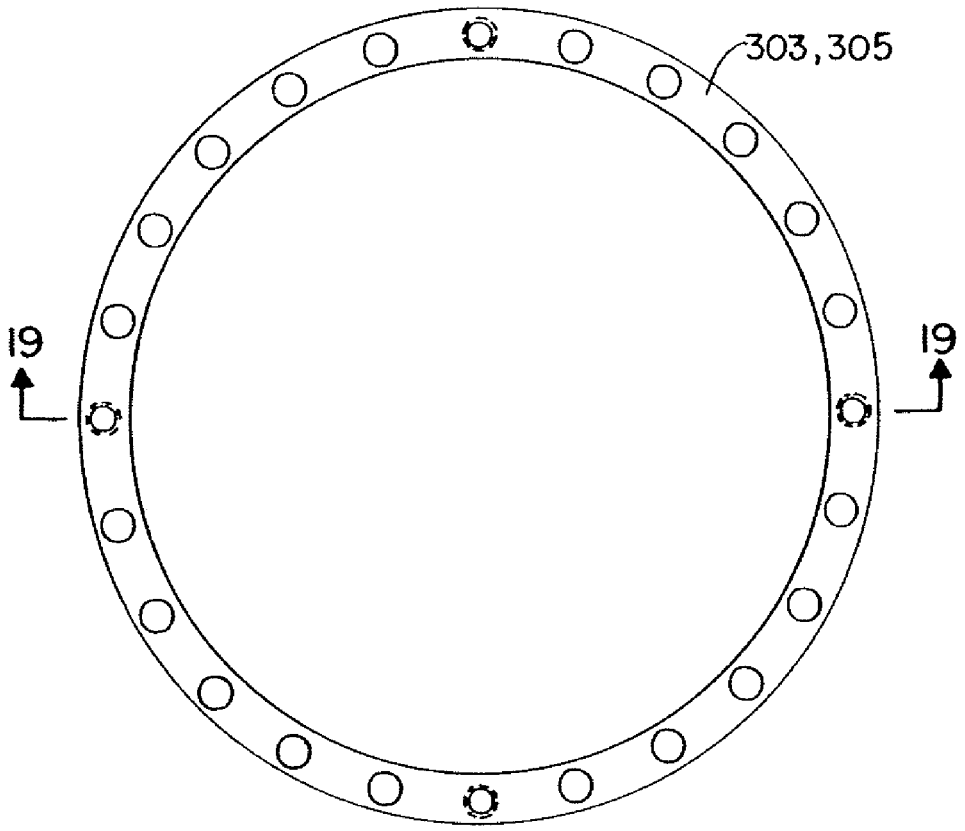
FIG. 18 is a top view of a spacer ring.
Figure 19:
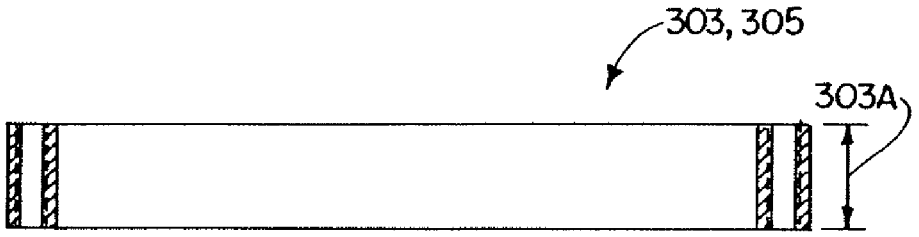
FIG. 19 is a sectional view of the spacer ring of FIG. 18 taken along the line 19-19.

FIG. 18 is a top view of a spacer ring. This figure shows the construction of spacer rings 303,305. As shown spacer rings 303,305 can include a plurality of holes for fasteners 306,307. FIG. 19 is a sectional view of the spacer ring 303,305 of FIG. 18 taken along the line 19-19. Height 303A determines the space maintained between endcaps 302,304 and sleeve 300. Spacer rings 303,305 can have the same or different heights 303A.

Figure 20:
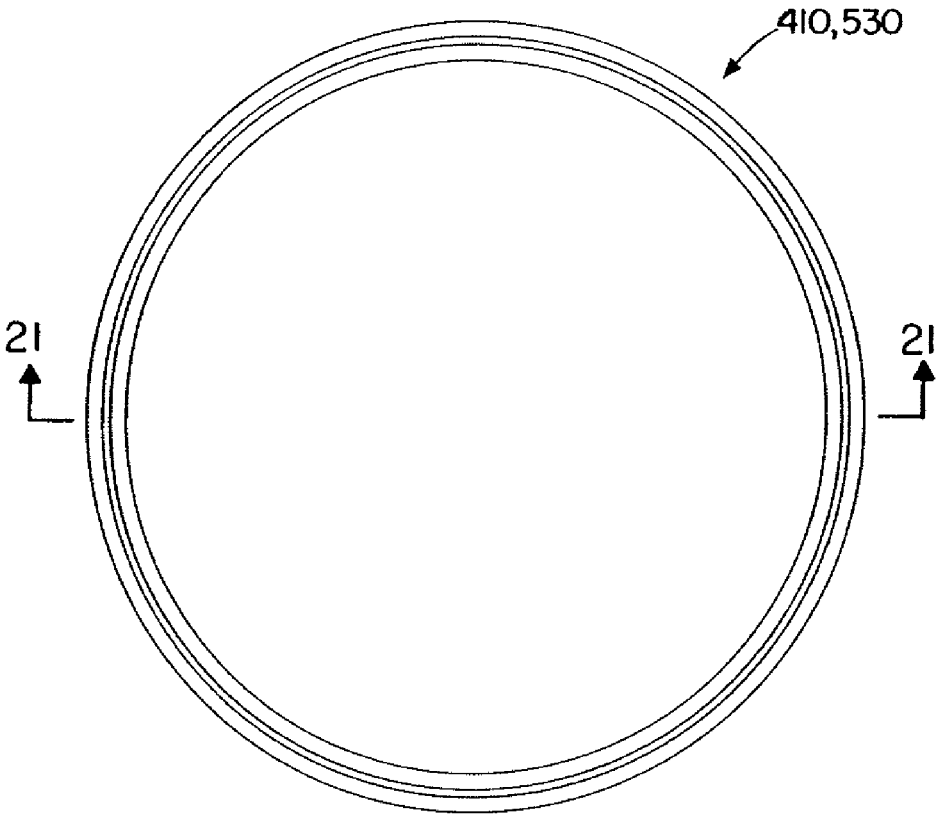
FIG. 20 is a top view of a male packing ring.
Figure 21:
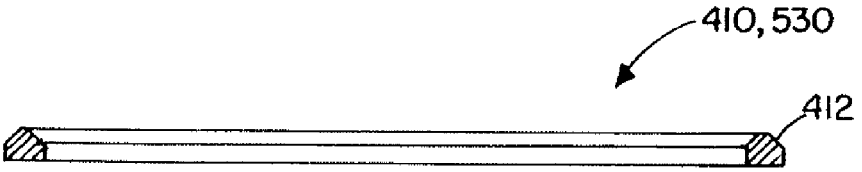
FIG. 21 is a sectional view of the male packing ring of FIG. 20 taken along the line 21-21.

FIG. 20 is a top view of a male packing ring 410,530. FIG. 21 is a sectional view of the male packing ring 410,530 of FIG. 20 taken along the line 21-21. Male packing ring 410,530 can be machined from SAE 660 BRONZE or SAE 954 Aluminum Bronze. Tip 412 preferably is machined at 45 degrees from a verticle with a flat head.

Figure 22:
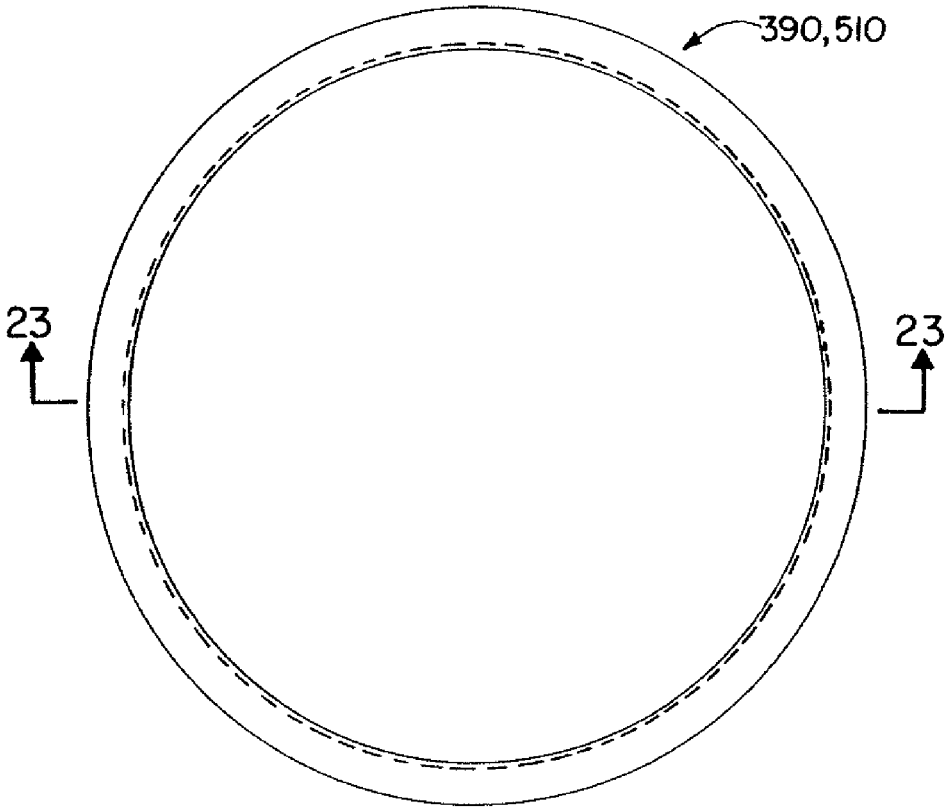
FIG. 22 is a top view of a spacer ring.
Figure 23:
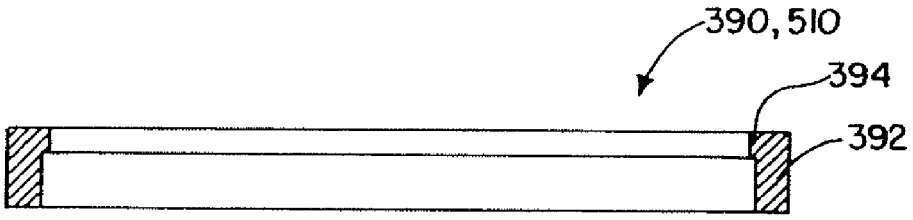
FIG. 23 is a sectional view of the spacer ring of FIG. 22 taken along the line 22-22.
Figures 24A, 24B, 24C:
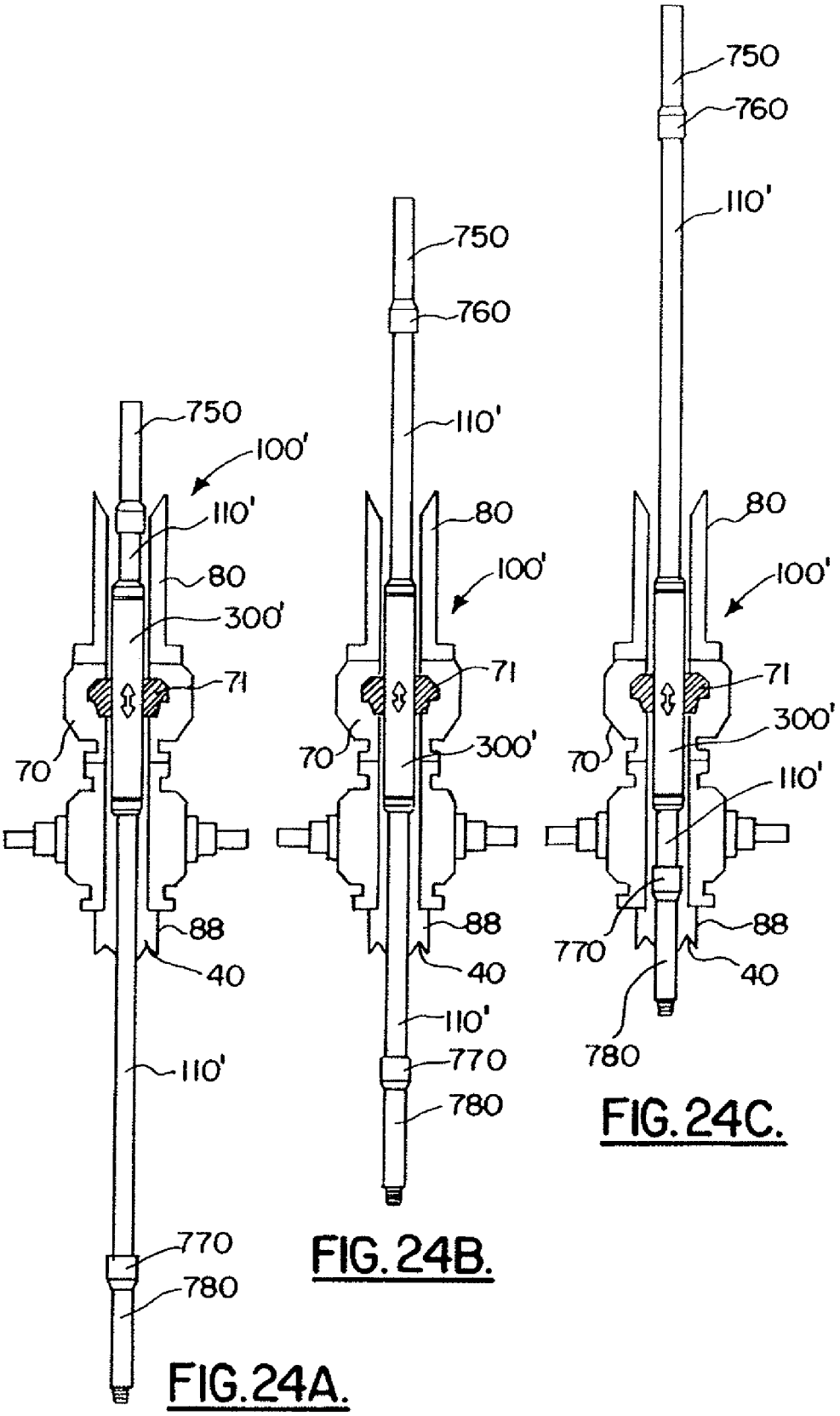
FIGS. 24A through 24C are schematic diagrams of an alternative swivel which has a stroke along the mandrel.

FIG. 22 is a top view of a spacer ring 390,510. FIG. 23 is a sectional view of the spacer ring 390,510 taken along the line 22-22. Spacer ring 390,510 can comprise tip section 394 which has a smaller diameter than base section 392. Tip section 392 can be used to hold plurality of seals 420,540 (see FIG. 8). Tip 394 is preferred in sealing systems where female packing ring 400,520 is not used (e.g., the rope seal embodiment).

Mandrel 110; sleeve 300; end caps 302,304; rings 303, 305; packing retainer nuts 340,460 are preferably rough machined from 4340 NQT steel (130Y) forging having 285/321 BHN/125,000 minimum yield strength and 17 percent elongation. Regarding impact strength it is preferred that the average impact value will not be less than 31 FT-LBS with no tested value being less than 24 FT-LBS when tested at −4 degrees Fahrenheit (tested as per ASTM E23). It is preferred that the tensile strength be tested using ASTM A388 2% offset method or ASTM A370 2% offset method.

It is preferred that a saver sub be placed on pin connection 150 of mandrel 110. The saver sub can protect the threads for pin connection 150. For example, if the threads on the saver sub are damaged only the saver sub need be replaced and not the entire mandrel 110.

To reduce friction between mandrel 110 and sleeve 300 and packing units 330, 450 and increase the life expectancy of packing units 330, 450, packing support areas 210,220 can be coated and/or sprayed welded with a materials of various compositions, such as hard chrome, nickel/chrome or nickel/aluminum (95 percent nickel and 5 percent aluminum). A material which can be used for coating by spray welding is the chrome alloy TAFA 95MX Ultrahard Wire (Armacor M) manufactured by TAFA Technologies, Inc., 146 Pembroke Road, Concord N.H. TAFA 95 MX is an alloy of the following composition: Chromium 30 percent; Boron 6 percent; Manganese 3 percent; Silicon 3 percent; and lion balance. The TAFA 95 MX can be combined with a chrome steel. Another material which can be used for coating by spray welding is TAFA BONDARC WIRE-75B manufactured by TAFA Technologies, Inc. TAFA BONDARC WIRE-75B is an alloy containing the following elements: Nickel 94 percent; Aluminum 4.6 percent; Titanium 0.6 percent; Iron 0.4 percent; Manganese 0.3 percent; Cobalt 0.2 percent; Molybdenum 0.1 percent; Copper 0.1 percent; and Chromium 0.1 percent. Another material which can be used for coating by spray welding is the nickel chrome alloy TAFALOY NICKEL-CHROME-MOLY WIRE-71T manufactured by TAFA Technologies, Inc. TAFALOY NICKEL-CHROME-MOLY WIRE-71T is an alloy containing the following elements: Nickel 61.2 percent; Chromium 22 percent; Iron 3 percent; Molybdenum 9 percent; Tantalum 3 percent; and Cobalt 1 percent. Various combinations of the above alloys can also be used for the coating/spray welding. Packing support areas 210, 220 can also be coated by a plating method, such as electroplating or chrome plating. The surface of support areas 210, 220 can be ground/polished/finished to a desired finish to reduce friction and wear between support areas 210, 220 and packing units 330, 450.

Mandrel 110 can take substantially all of the structural load from drill string 85,86. The overall length of mandrel 110 is preferably 97½ inches. Mandrel 110 can be machined from a single continuous piece of 4340 heat treated steel bar stock (alternatively, can be from a rolled forging). NC50 is preferably the API Tool Joint Designation for the box connection 70 and pin connection 80. Such tool joint designation is equivalent to and interchangeable with 4½ inch IF (Internally Flush), 5 inch XH (Extra Hole) and 5½ inch DSL (Double Stream Line) connections.

Sleeve 300 is preferably 61¾ inches. End caps 302,304 are preferably about 8 inches. Spacer rings 303,305 can have a height 303A of 1¼ inches, however, this height is to be determined at construction.

Various systems can be used to prevent plurality of fasteners 306,307 from becoming loose or unfastened during use of swivel 100. One method is to use a specified torquing procedure. A second method is to use a thread adhesive on fasteners 306,307. Another is to use a plurality of snap rings or set screws above the heads of fasteners 306,307. FIGS. 7 through 9 show another method using a plurality of locks 600,620 and set screws 610,630 where locks 600,620 respectively connect to fasteners 306,307 and set screws 610,630 prevent locks 600,620 from backing out. Locks 600,620 can include hexagonal cross sections, such as an allen wrench tool, Additionally, a pair of covers can be threadably connected to end caps 302,304 and prevent fasteners 306,307 from backing out during use of swivel 100.

Figure 25A:
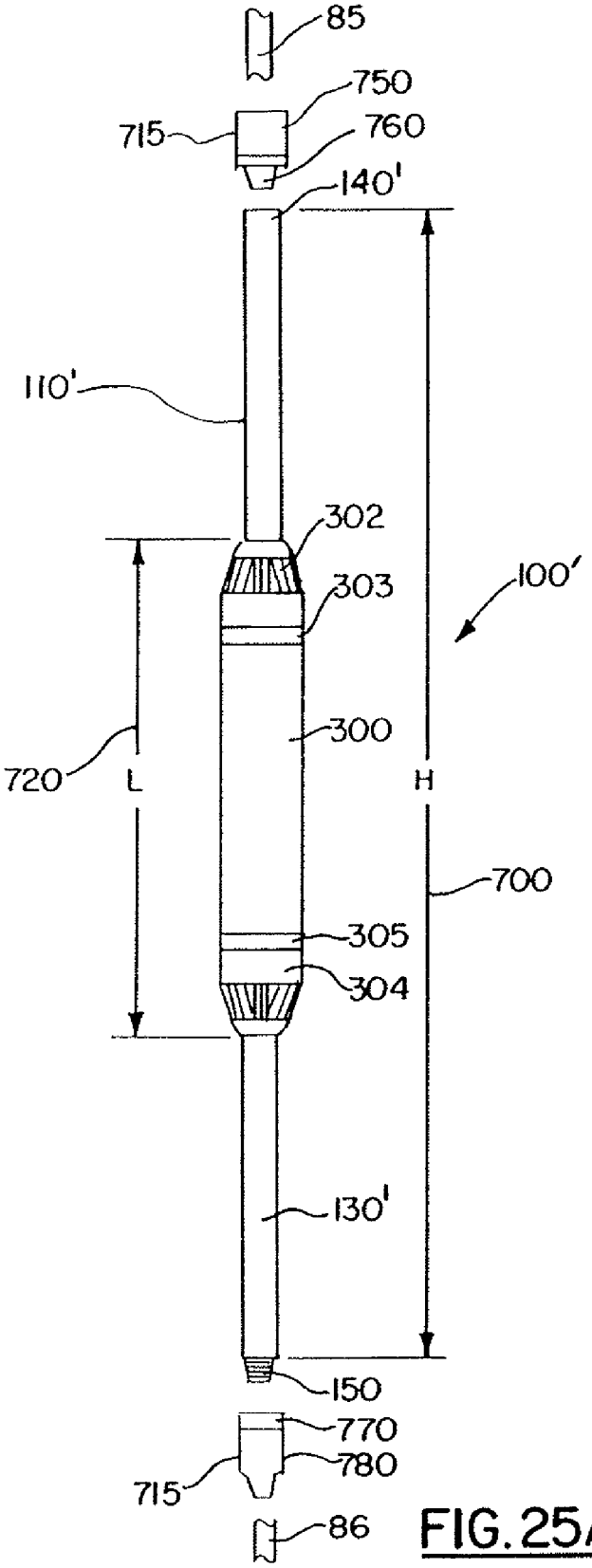
FIGS. 25A through 25C show a swivel wherein the sleeve can slide along the mandrel.
Figure 25B:
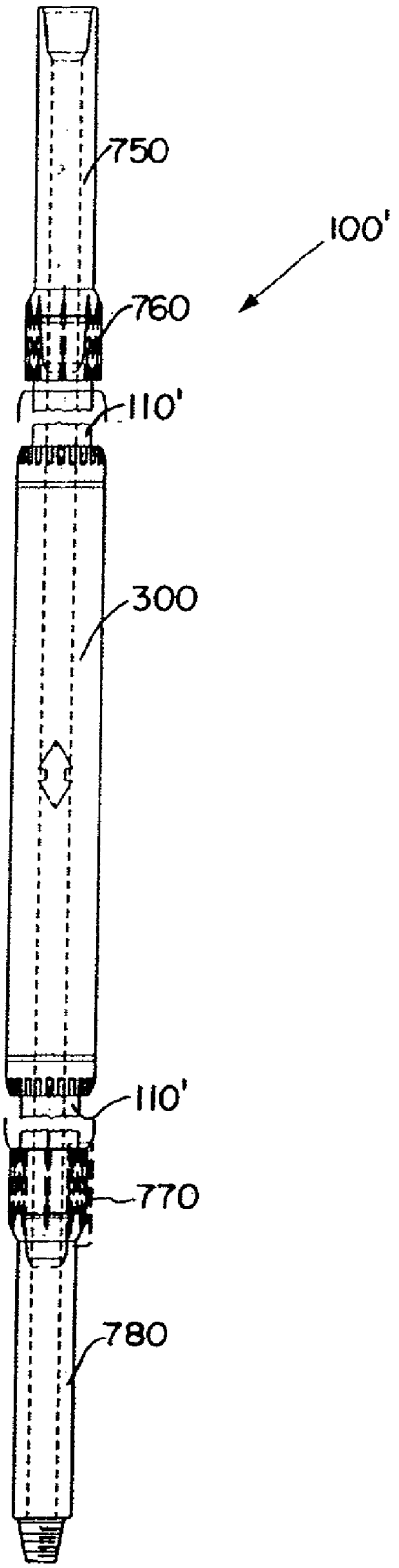
Figure 25C:
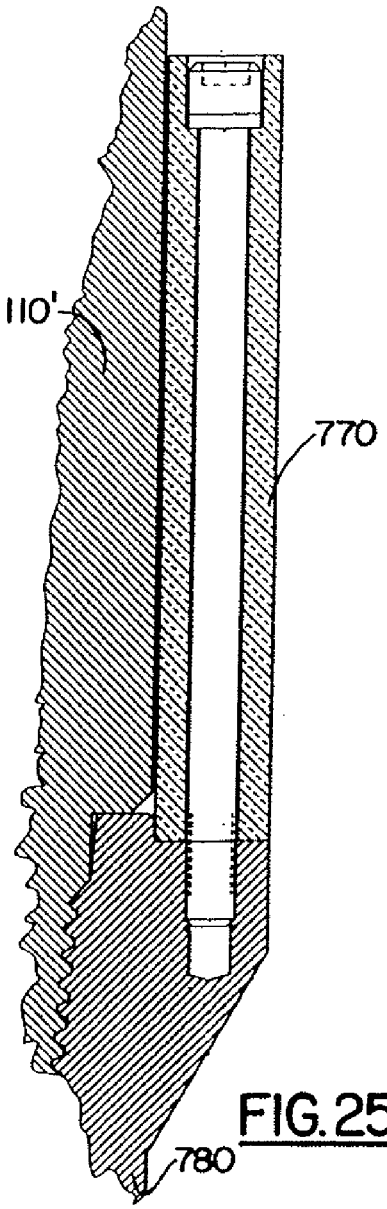
Figure 26:
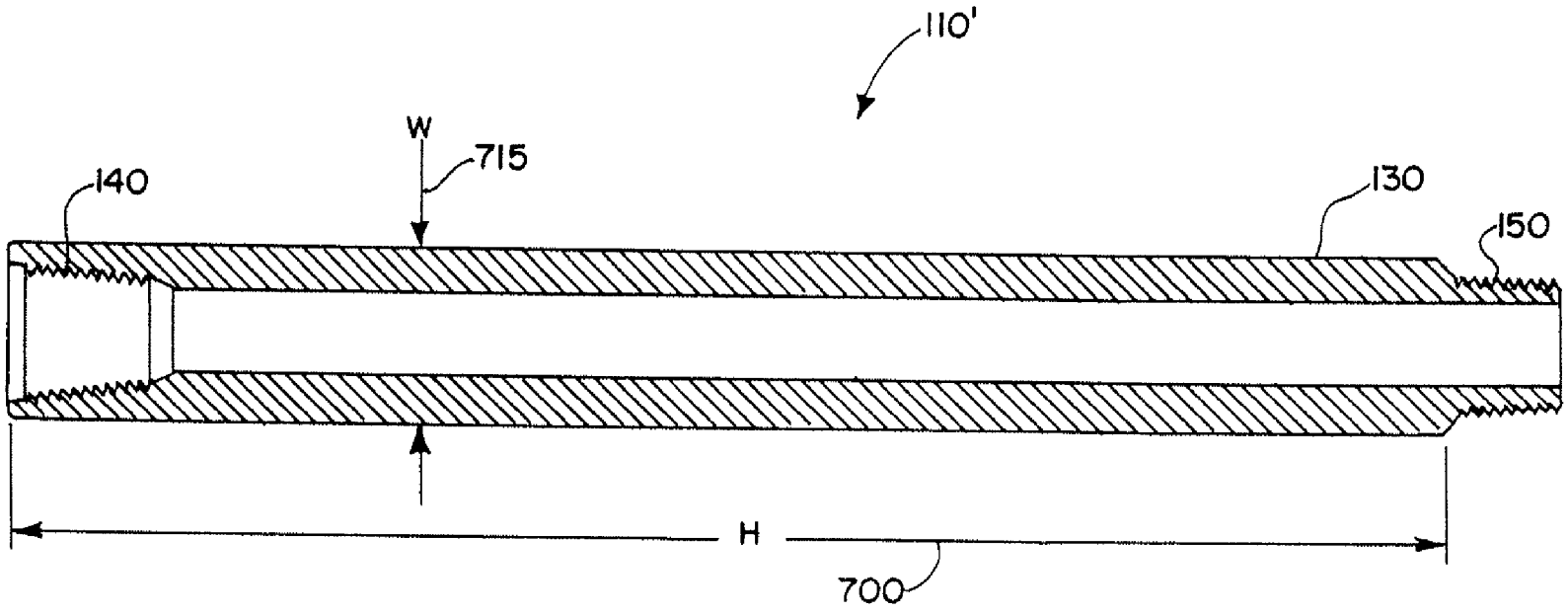
FIG. 26 shows a mandrel which can be incorporated in the alternative swivel of FIG. 24.
Figure 27A:
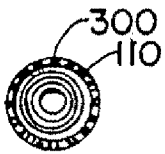
FIG. 27A is an end view of the swivel of FIG. 27.
Figure 27:
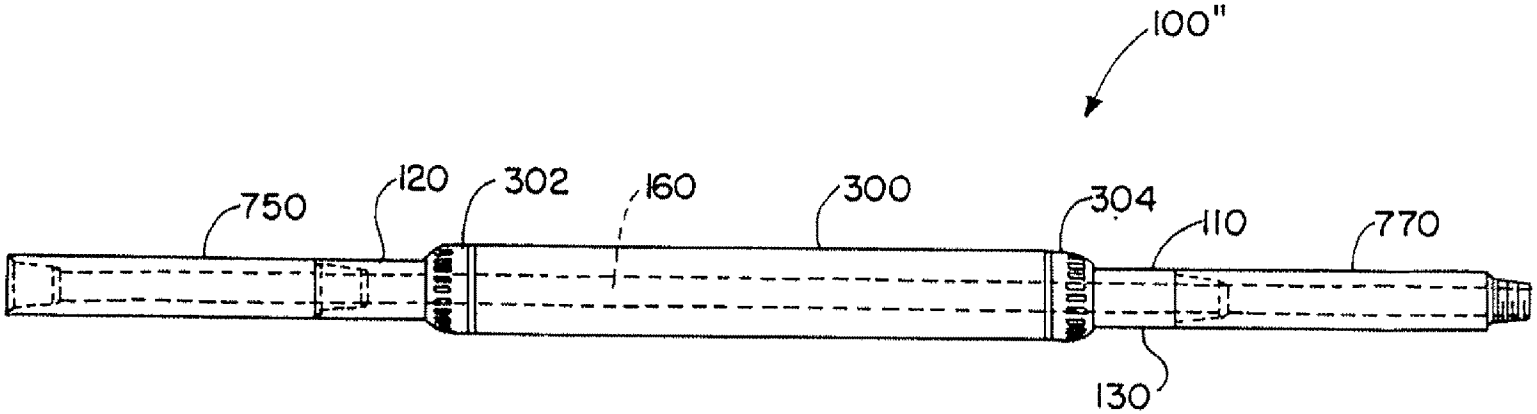
FIG. 27 shows another alternative swivel.

FIGS. 24 through 27 show another alternative swivel. In this embodiment the length of swivel 100' can be configured to allow sleeve 300' to reciprocate (e.g., slide up and down) on mandrel 110'. FIGS. 24A through 24C are schematic diagrams of a alternative swivel 100' which has a stroke along mandrel 110'. FIGS. 25A through 25C show swivel 100' wherein sleeve 300' can slide along mandrel 110'. FIG. 26 shows mandrel 110' which can be incorporated in swivel 100'. Swivel can be made up of mandrel 110' to fit in line of a drill work string 85,86 and sleeve 300' with a seal and bearing system (not shown but which can be similar to the seal and bearing system for swivel 100) to allow for the work string 85,86 to be rotated and reciprocated while swivel 100' and annular seal unit 71 separate the fluid column in riser 80 from the fluid column in wellbore 40. This can be achieved by locating swivel 100' in the annular blow out preventer 70 where annular seal unit 71 can close around sleeve 300' forming a seal between sleeve 300' and annular seal unit 71, and the sealing system between sleeve 300' and mandrel 110' of swivel 100' forming a seal between sleeve 300' and mandrel 110', thus separating the two fluid columns (above and below annular seal unit 71) allowing the fluid columns to be displaced individually. Swivel 100' can include a hard chromed sealing area on the o.d. of mandrel 110' throughout the travel length (or stroke length) to assist in maintaining a seal between mandrel 110' and sleeve 300' seal area during rotation and/or reciprocation activities or procedures. Sleeve 300' can include a bearing system (not shown). The bearing system can include annular bearings, tapered bearings, or ball bearings. Alternatively, the bearing system can include teflon bearing sleeves or bronze bearing sleeves, allowing for low friction levels during rotating and/or reciprocating procedures.

In one embodiment joints of pipe 750,770 can be placed respectively on upper and lower sections 140', 130' of mandrel 110'. Joints of pipe 750 can include larger diameter sections than diameter 715 of mandrel 110' (see FIG. 25A). Having larger diameters can prevent sleeve 300 from sliding off of mandrel 110'. Joints 750,780 can be considered saver subs for the ends of mandrel 110' which take wear and handling away from mandrel 110'. Joints 750,780 are preferably of shorter length than a regular 20 or 40 foot joint of pipe, however, can be of the same lengths. In one embodiment joints of pipe include saver portions 760,770 which engage sleeve 300 at the end of mandrel 10' (see FIG. 25B). Saver portions 760,770 can be shaped to cooperate with end caps 302,304. Saver portions can be of a different material such as polymers, teflon, rubber, or other material which is softer than steel or iron.

As shown in FIG. 25A, the stroke of swivel 100' can be the difference between height H 700 of mandrel 110' and length L 710 of sleeve 300. In one embodiment height H 700 can be about thirty feet and length L 710 can be about six feet. Preferably height H 700 is between two and twenty times that of length L 710. Alternatively, between two and fifteen times, two and ten times, two and eight times, two and six times, two and five times, two and four times, two and three times, and two and two and one half times. Also alternatively, between 1.5 and fifteen times, 1.5 and ten times, 1.5 and eight times, 1.5 and six times, 1.5 and five times, 1.5 and four times, 1.5 and three times, 1.5 and two times, 1.5 and two and one half times, and 1.5 and two times.

Figure 28:
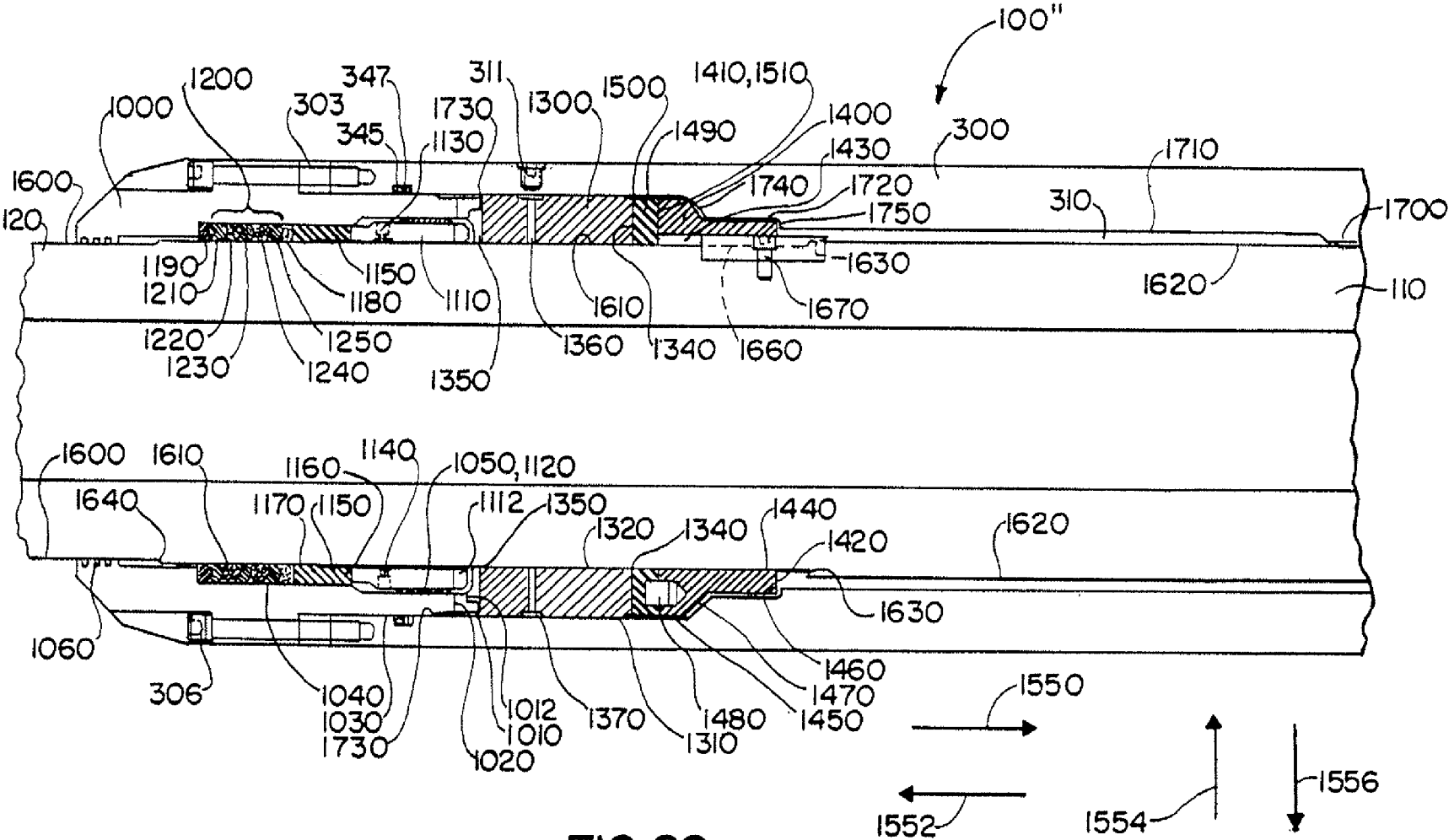
FIG. 28 is a sectional view of the upper part of the swivel of FIG. 27.

FIGS. 27 through 43 show an alternative swivel 100", which can comprise mandrel 110 and sleeve 300. As shown in FIG. 28, sleeve 300 (see FIG. 30) can be rotatably and sealably connected to mandrel 110 (see FIG. 29). Similar to other embodiments, mandrel 110 can comprise upper end 120 and lower end 130. Central longitudinal passage 160 can extend from upper end 120 through lower end 130. Lower end 130 can include a pin connection 150 or any other conventional connection. Upper end 120 can include box connection 140 or any other conventional connection. In this embodiment, sleeve 300 can be rotatably connected to mandrel 110 by a plurality of bushings 1300, preferably located on opposed longitudinal ends of mandrel 110.

FIG. 28 shows a sectional view of the upper end of swivel 100". The lower end of swivel 100" is preferably constructed similar to that as shown in FIG. 28 (but in mirror image). Sleeve 300 can be rotatably connected to mandrel 110 by one or more bushings 1300, preferably located on opposed longitudinal ends of mandrel 110. Sleeve 300 can be sealably connected to mandrel 110 through one or more packing units 1100, preferably located on opposed longitudinal ends of mandrel 110.

The upper portion of sleeve 300 can be sealably connected to mandrel 110 by packing unit 1100. Packing unit 1100 can comprise male packing ring 1190, plurality of seals 1200, female packing ring 1180, spacer ring 1150, and packing retainer nut 1110. Packing retainer nut 1110 can be threadably connected to end cap 1000 through threads 1050,1120. Tightening packing retainer nut 1110 squeezes spacer ring 1150 and plurality of seals 1200 between end cap 1000 and nut 1110 thereby increasing sealing between sleeve 300 (through end cap 1000) and swivel mandrel 110. Tip 1112 of retainer nut 1110 can be used as a setting for proper tightening of nut 1110 in end cap 1000. That is, as shown in FIG. 28 nut 1110 can be tightened until tip 1112 is level with second level 1012 of end cap 1000. Set screw 1130 can be used to lock packing retainer nut 1110 in place and prevent retainer nut 1110 from loosening during operation. Set screw 1130 can be threaded into bore 1140 and lock into end cap 1000. O-ring 345 can be used to seal upper end cap 302 to sleeve 300. Back up ring 347 can be used to increase the pressure rating of the seal between end cap 1000 and sleeve 300. Spacer ring 1150, having base 1160 and tip 1170, can be of similar construction to spacer ring 390 shown in FIGS. 22 and 23. Tip 1170 is preferably located adjacent to female packing ring 1180.

Plurality of seals 1200 can comprise first seal 1210, second seal 1220, third seal 1230, fourth seal 1240, and fifth seal 1250. First and third seals 1210,1230 can be Chevron type seals "VS" packing ring (0370650-VS-850HNBR) being highly saturated nitrile. Second and fourth seals 1220, 1240 can be Garlock ⅜ inch section 8913 rope seals having 22 13/16 inch LG. Fifth seal 1250 is preferably a Chevron type seal "VS" packing ring being bronze filled teflon. Fifth seal 1250 is preferably of a harder material than other seals (e.g., bronze or metal filled) so that it can seal at higher pressures relative to other softer or more flexible seals.

Figure 29:
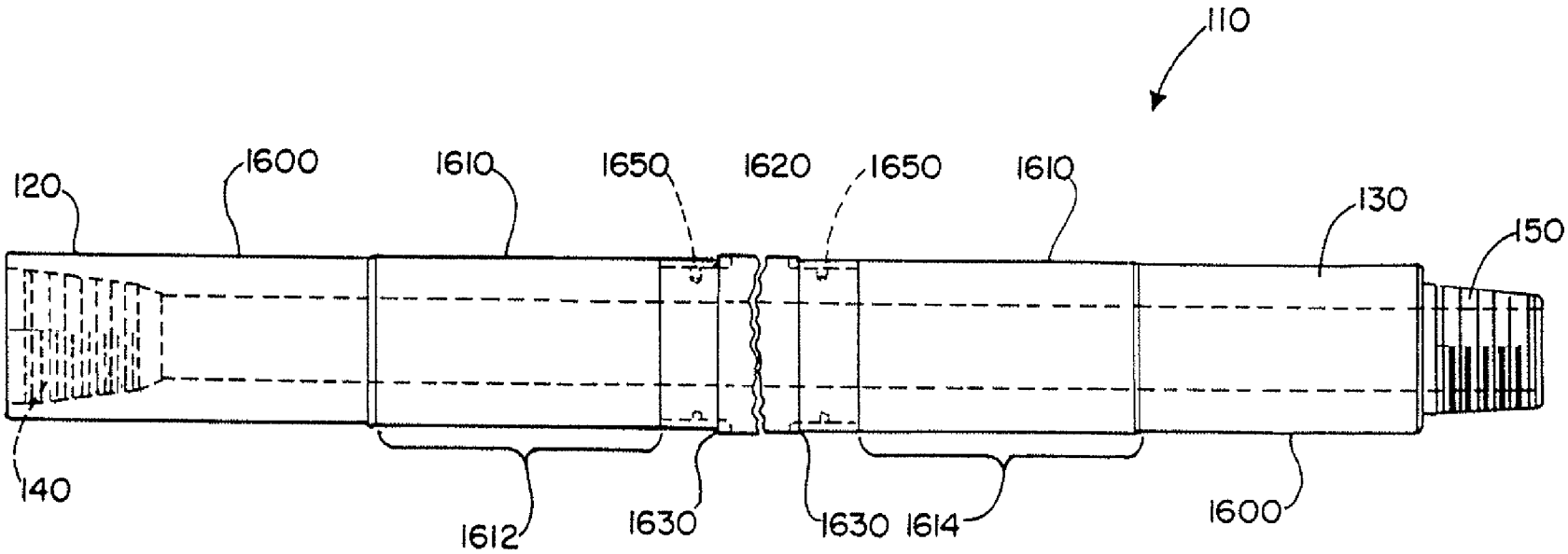
FIG. 29 shows a mandrel for the swivel of FIG. 27.

FIG. 29 shows one possible construction of mandrel 110 for alternative swivel 100". Mandrel 110 can have upper end 120 and lower end 130. Mandrel 110 can have first surface 1600, second surface 1610, and third surface 1620 of increasing diameters. The change in diameters between second surface 1610 and third surface 1620 creates shoulders 1630 which restrict the maximum amount of relative longitudinal movement (e.g., arrows 1550,1552 in FIG. 28) between mandrel 110 and sleeve 300. Preferably, this relative movement will be about 1 and ¼ inches. Additionally, movement can vary between about ⅛ and 5 inches, between about ¼ and 4 inches, between about ½ and 3 inches, between about 1 and 2 inches.

Similar to other described embodiments, to reduce friction between mandrel 110 and sleeve 300 and packing units 1100 along with increasing life expectancy of packing units 1100, packing support areas 1612,1614 can be treated, coated, and/or sprayed welded with a materials of various compositions, such as hard chrome, nickel/chrome or nickel/aluminum (95 percent nickel and 5 percent aluminum) It is preferred that coating/spray welding does not enter a key recess 1650.

First surface 1600 of mandrel 110 is shown being of a smaller relative diameter than second surface 1610. Looking at FIG. 28, such construction can be used to facilitate insertion of packing unit 1100 on mandrel 110. If first 1600 and second 1610 surfaces were the same diameter then packing unit 1100 would be required to frictionally slide across the entire length of first surface 1600 and at least part of second surface 1610 to its final resting longitudinal location. Where first surface 1600 includes irregularities (such as scratches, nicks, etc.) these irregularities could damage packing unit 1100. Preferably, packing unit 1100 tightly fits only second surface 1610, and as can be seen from FIG. 28, second surface 1610 is protected from damage during operation by sleeve 300 and end cap 1000. Also seen from FIGS. 28 and 29, a substantial portion of first surface 1600 is not protected during use. Accordingly, the surface packing units 1100 will slide relative to during use (e.g., 1612 and 1614) are protected (by sleeve 300 during use) from damage such as scratching, nicks, dents, etc.

Figure 30:
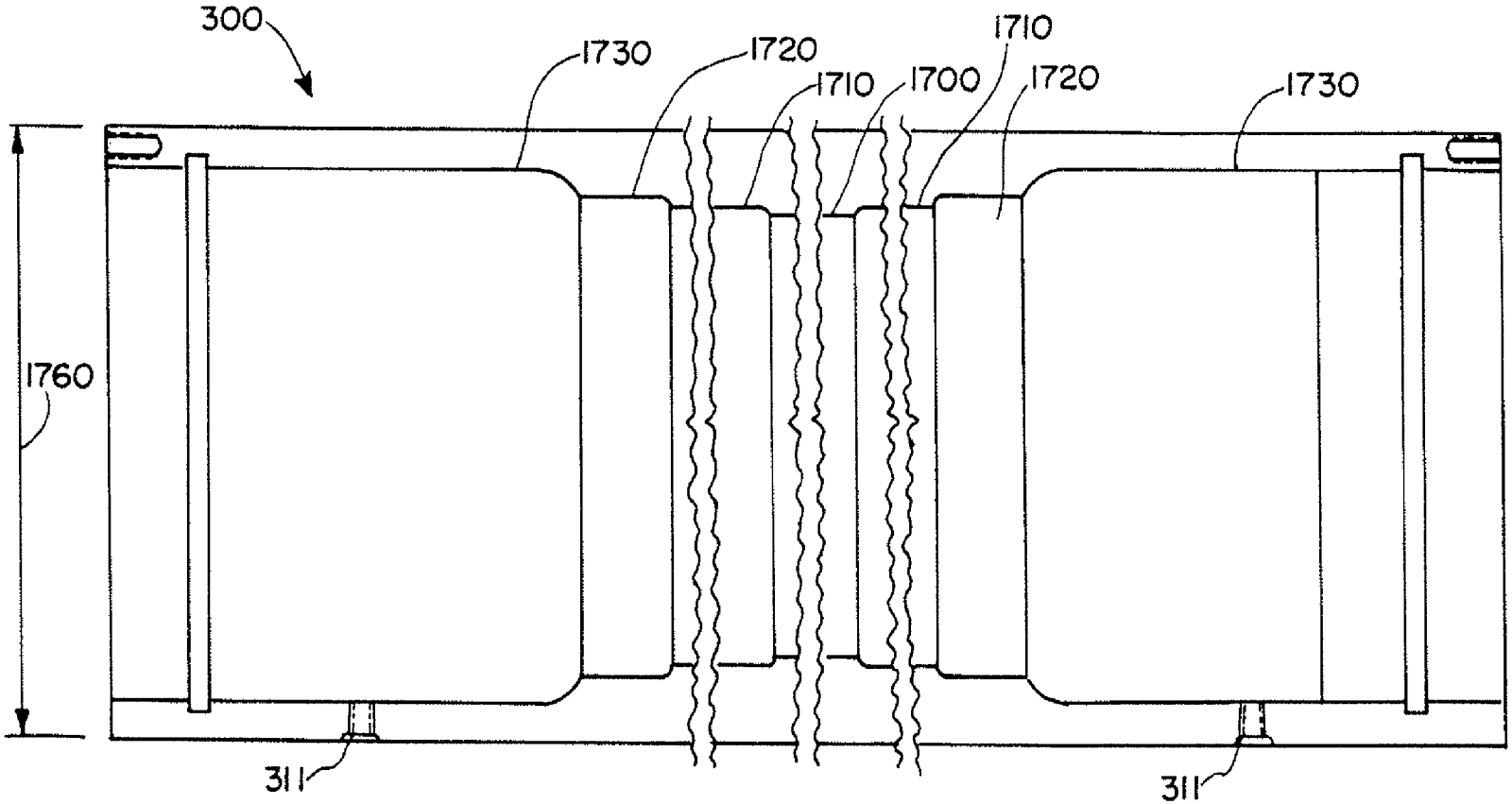
FIG. 30 shows a sleeve for the swivel of FIG. 27.
Figure 32:
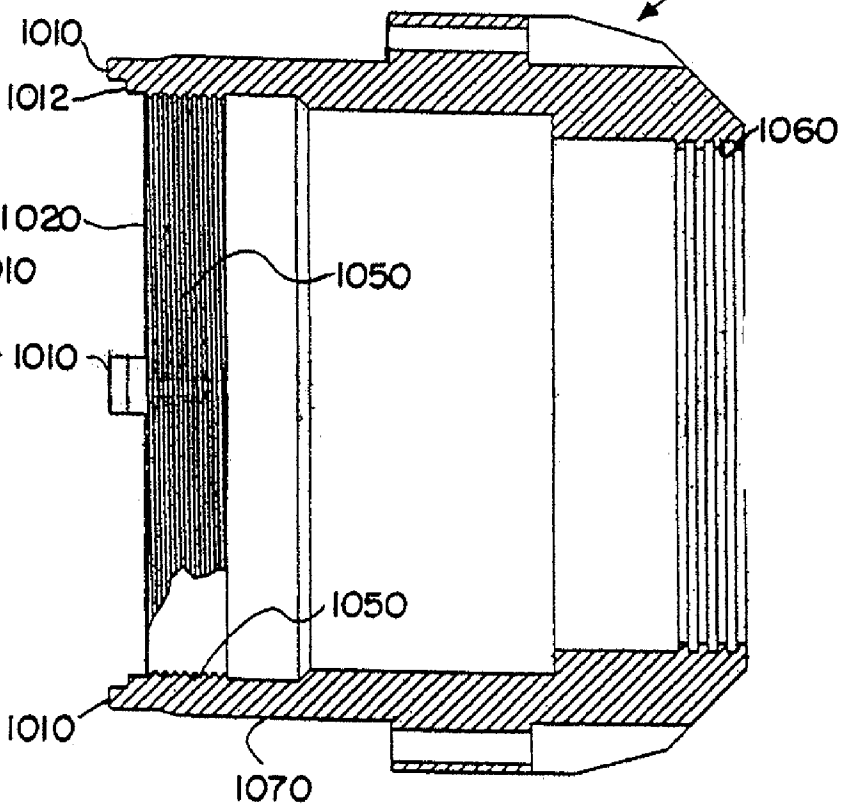
FIG. 32 is a sectional view of the end cap of FIG. 31.
Figure 31:
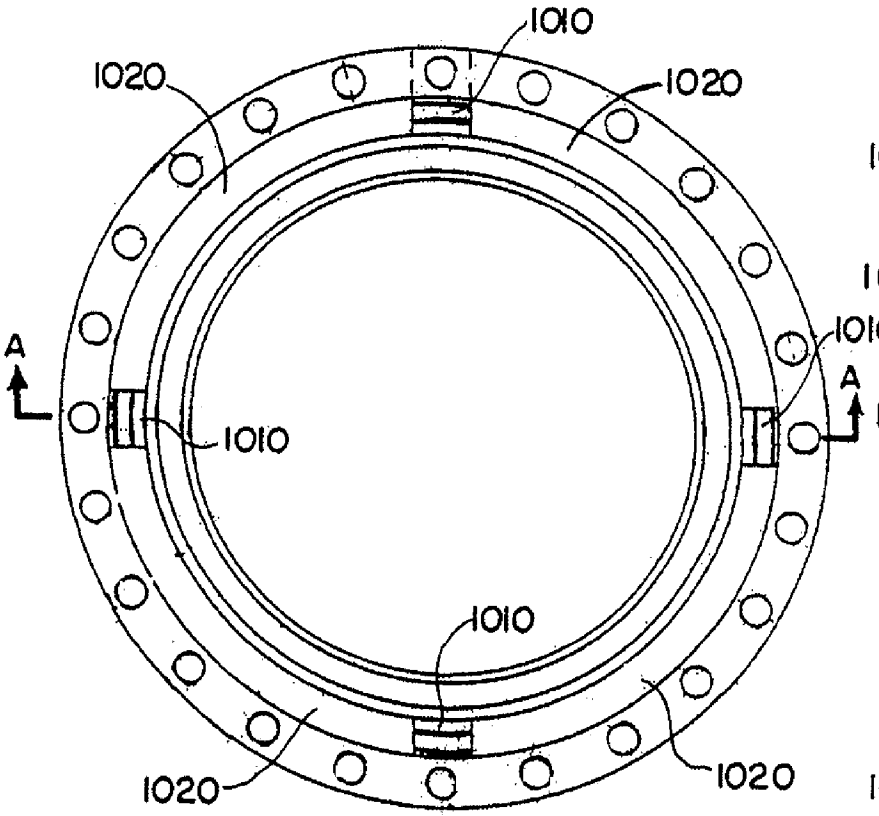
FIG. 31 shows an end view of the end cap for the swivel of FIG. 27.
Figure 33:
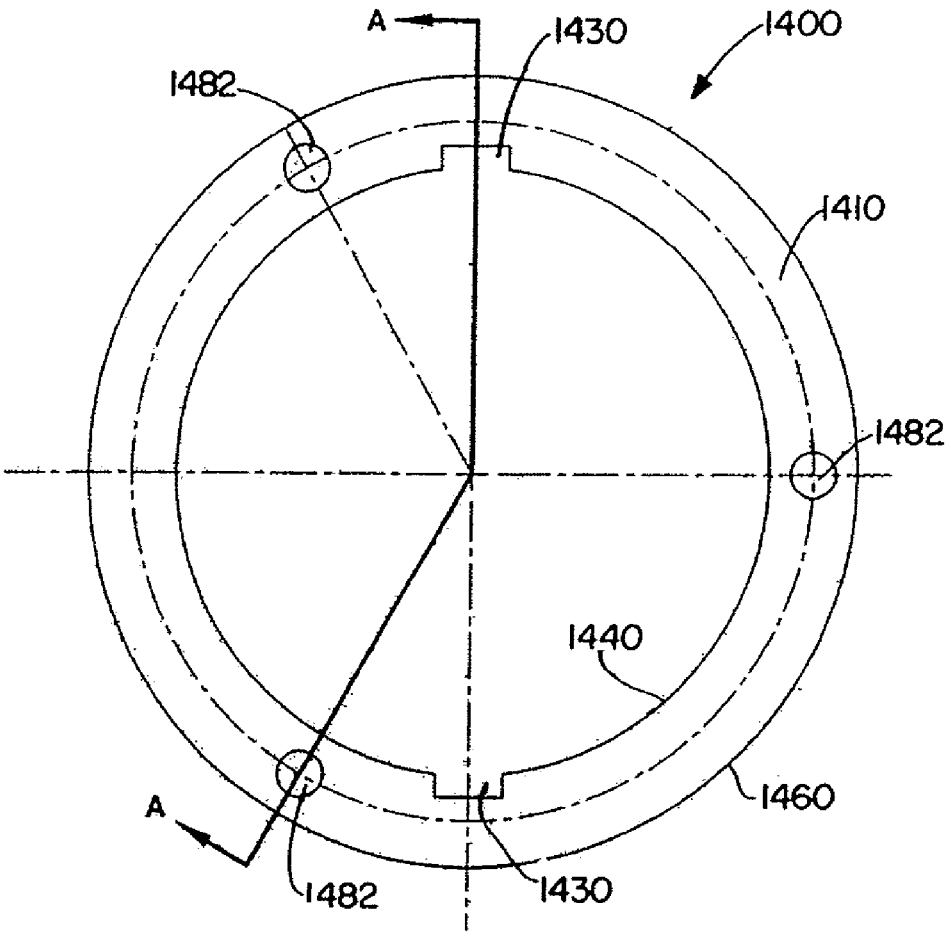
FIG. 33 shows an end view of a thrust hub for the swivel of FIG. 27.
Figure 35:
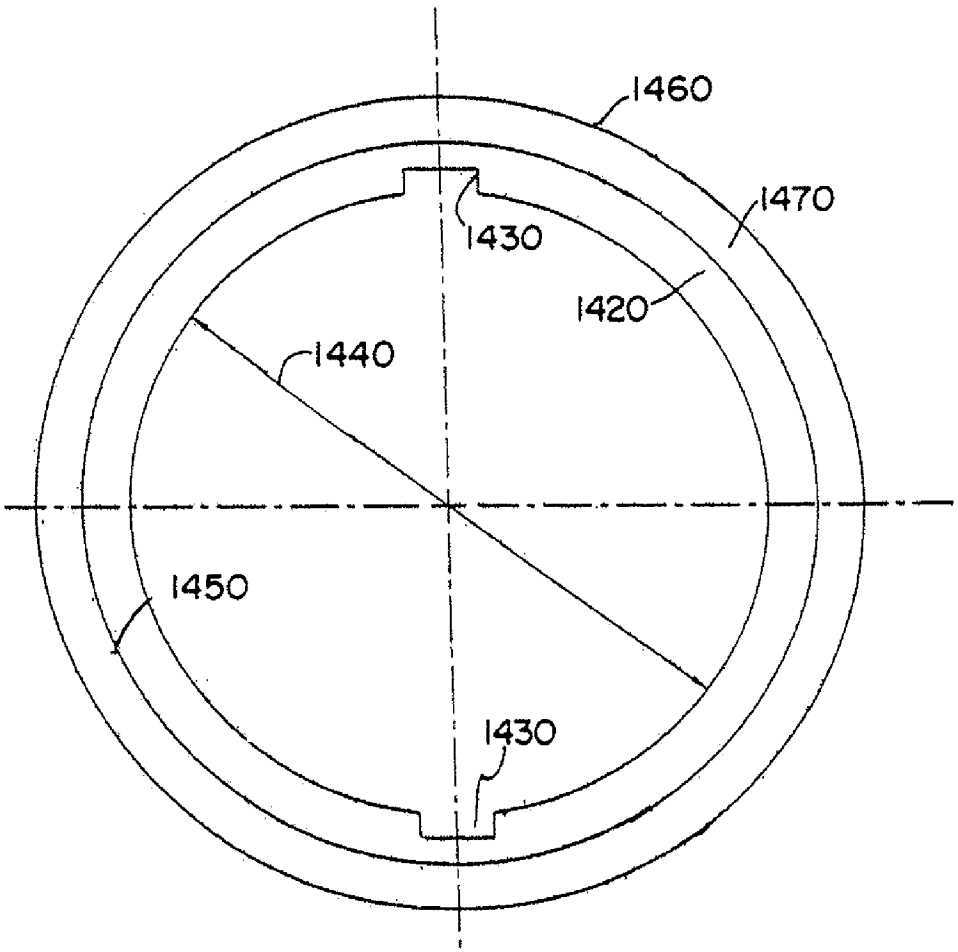
FIG. 35 is an opposing end view of the thrust hub of FIG. 33.
Figure 34:
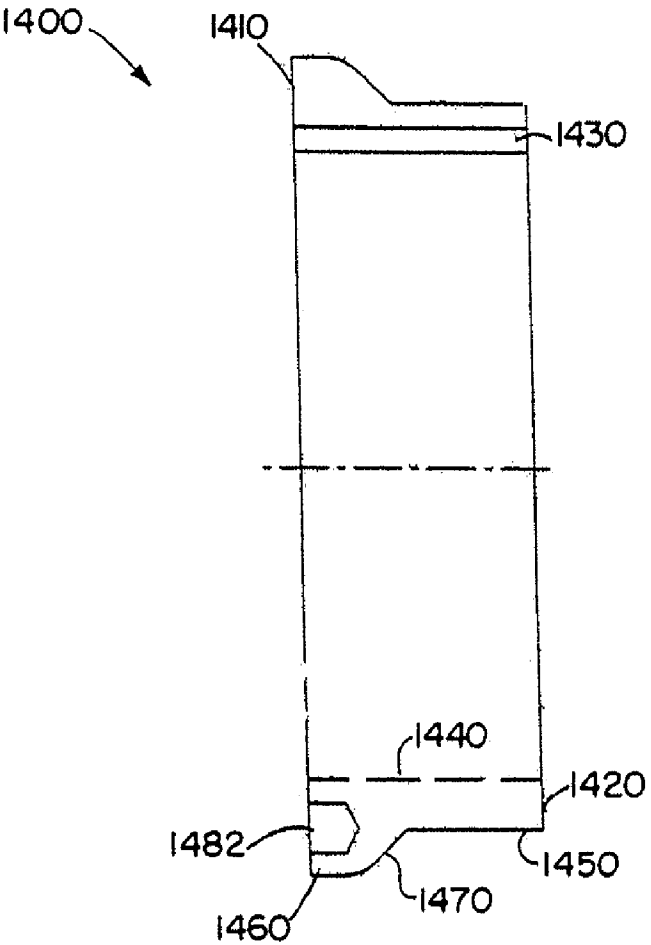
FIG. 34 is a sectional view of the thrust hub of FIG. 33.
Figure 36:
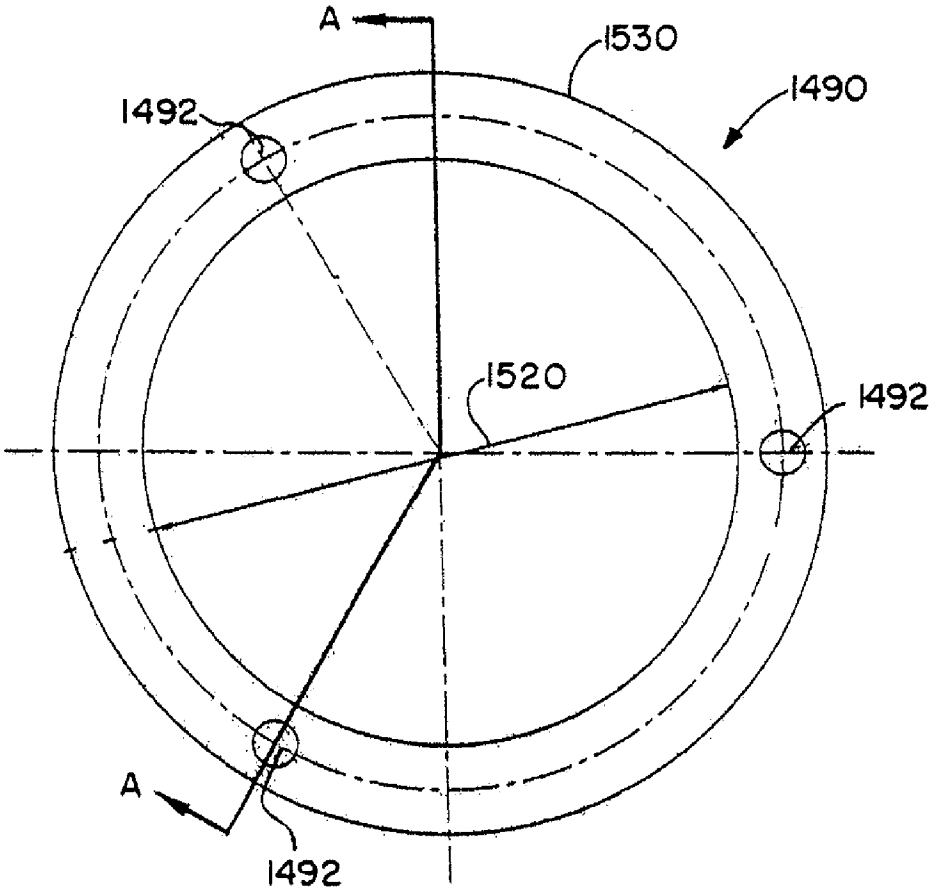
FIG. 36 shows an end view of a thrust ring.
Figure 37:
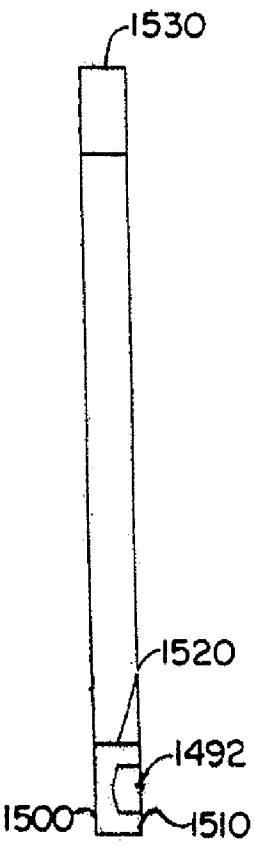
FIG. 37 is a sectional view of the thrust ring of FIG. 36.

FIG. 30 shows one possible construction of sleeve 300. Sleeve 300 can include first inner diameter 1700, second inner diameter 1710, third inner diameter 1720, and fourth inner diameter 1730—each respectively of increasing diameter. Alternatively first inner diameter 1700 can be the same as second inner diameter 1710 (although having a smaller first inner diameter 1700 can provide increased strength for sleeve 300). Where a smaller first inner diameter 1700 is used, the longitudinal length of second inner diameter is preferably long enough to facilitate installation of the components shown in FIG. 28 on alternating ends of sleeve 300. That is, second inner diameter 1710 is large enough to slide a sufficient longitudinal amount over the top of key 1660.

Sleeve 300 can have a uniform outer diameter 1760. At least a portion of the surface of sleeve 300 can be designed to increase its frictional coefficient, such as by knurling, etching, rings, ribbing, etc. This can increase the gripping power of annular seal 71 (of blow-out preventer 70) against sleeve 300 where there exists high differential pressures above and below blow-out preventer 70 which tend to force sleeve 300 in a longitudinal direction.

Figure 39:
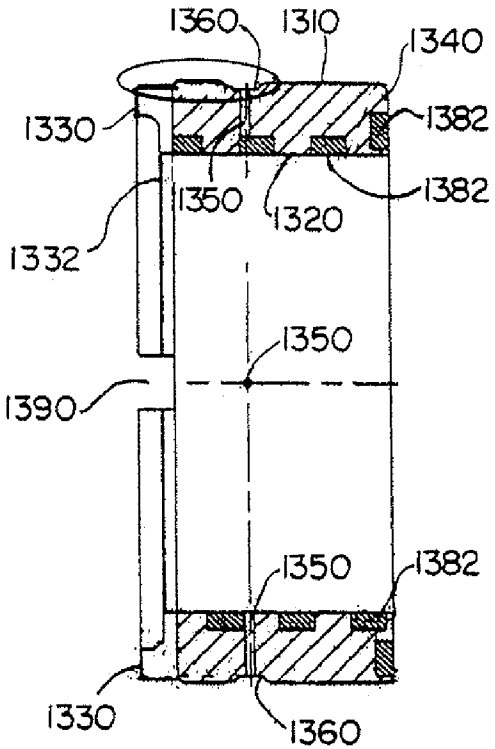
FIG. 39 is a sectional view of the busing of FIG. 38.
Figure 39A:
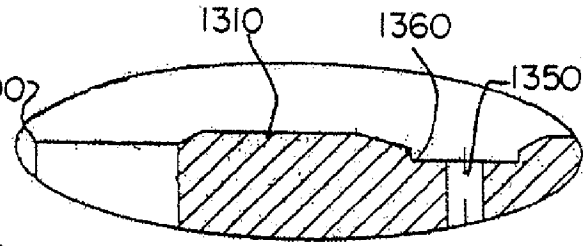
FIG. 39A is an enlarged view of the indicated area of FIG. 39.
Figure 38:
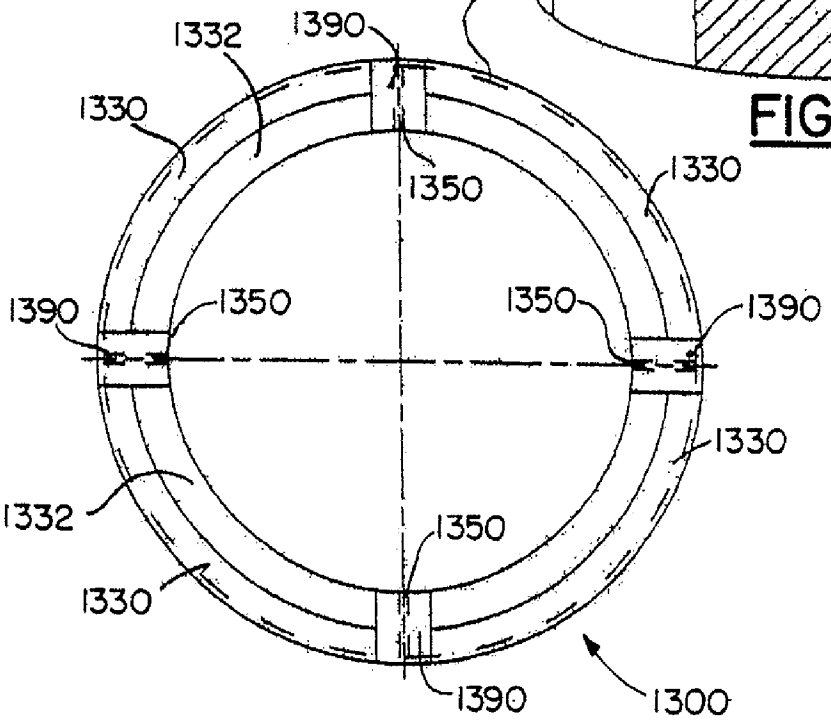
FIG. 38 shows an end view of a bushing.
Figure 41:
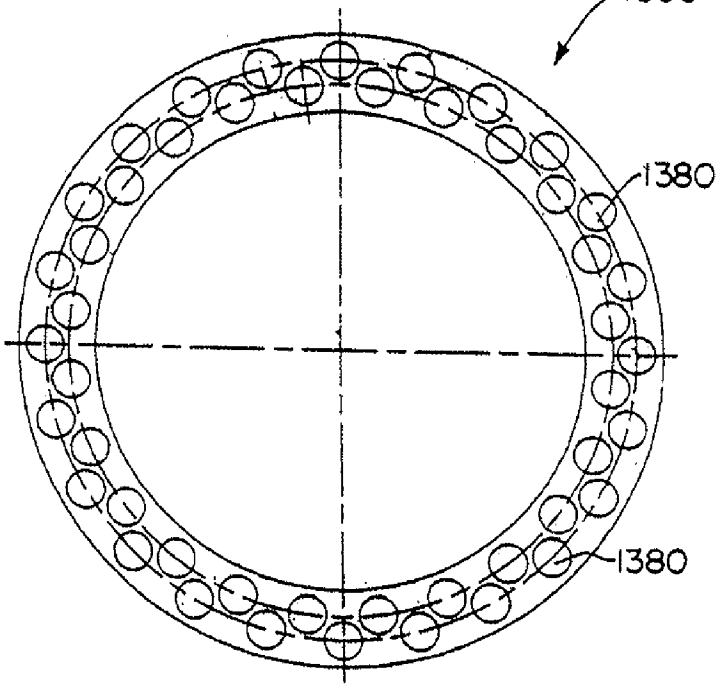
FIG. 41 is an end view of the rough cut of FIG. 40.
Figure 40:
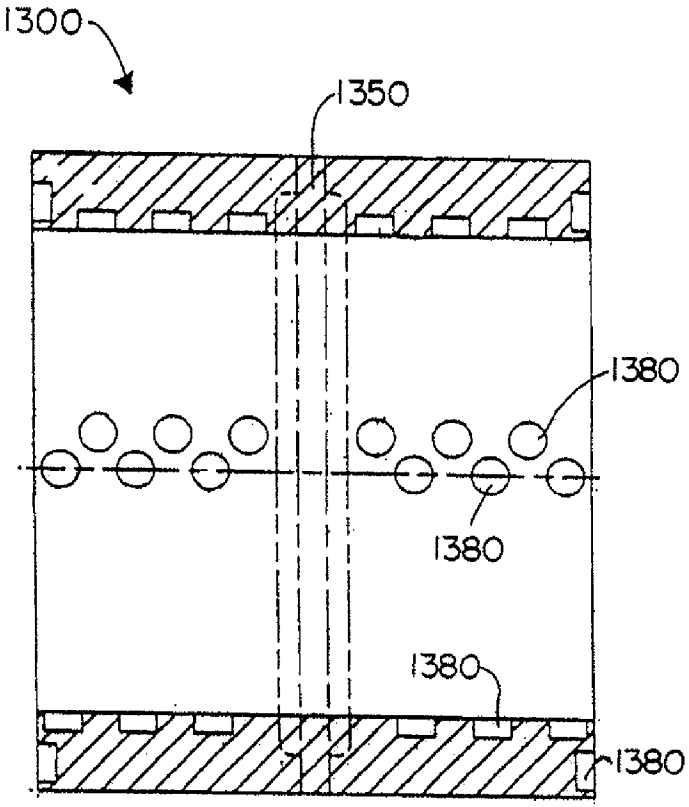
FIG. 40 is a rough cut of the bushing of FIG. 38 showing various recessed areas.
Figure 43:
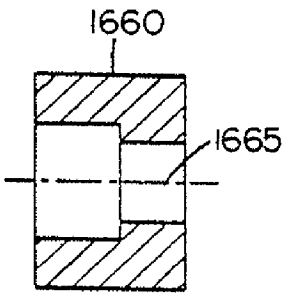
FIG. 43 is a sectional view of the key of FIG. 42.
Figure 42:
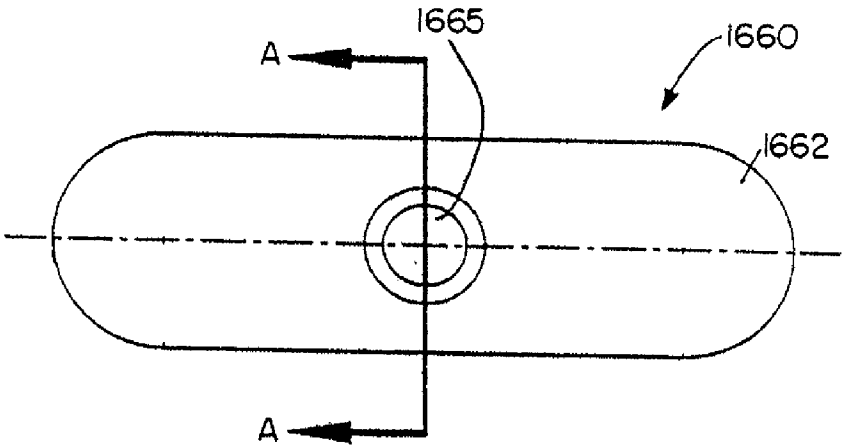
FIG. 42 shows a key which can be used in the swivel of FIG. 27.

One possible construction of bushing 1300 is shown in FIGS. 38 through 41. Bushing 1300 can be of metal or composite construction—either coated with a friction reducing material and/or comprising a plurality of lubrication enhancing inserts 1382. Alternatively, bushing 1300 can rely on lubrication provided by different metals moving relative to one another. Bushings with lubrication enhancing inserts can be conventionally obtained from Lubron Bearings Systems located in Huntington Beach, Calif. Bushing 1300 is preferably comprised of ASTM B271-C95500 cast nickel aluminum bronze. Lubrication enhancing inserts preferably comprise PTFE teflon epoxy composite dry blend lubricant (Lubron model number LUBRON AQ30 yield pressure 15,000 psi) and/or teflon and/or nylon. Different inserts (e.g., 1382A, 1382B, 1382C, etc.) can be of similar and/or different construction. For example one surface of bushing 1300 can have inserts (e.g., 1382A) of one construction/composition while a second surface of bushing 1300 can have inserts (e.g., 1382B) of a different construction/composition. Additionally, inserts (e.g., 1382A,1382B, etc.) on one surface can be of varying construction/composition. Circular inserts are shown, however, other shaped inserts can be used. Bushing 1300 allows for the overall outer diameter of sleeve 300 to be minimized relative to using roller or ball bearings between sleeve 300 and mandrel 110. Bushing 1300 also increases the maximum allowable thrust loading between mandrel 110 and sleeve 300 (relative to roller/ball bearings) while relative rotation between mandrel 110 and sleeve 300 occurs. Bushing 1300 can comprise outer surface 1310, inner surface 1320, upper surface 1330, and lower surface 1340. In FIG. 39 bushing 1300 is shown with a plurality of inserts 1382 on lower surface 1340 and inner surface 1320. Inserts 1382 can be limited to the surfaces of bushing 1300 which see movement during relative rotation and/or longitudinal movement between mandrel 110 and sleeve 300. FIGS. 40 and 41 are rough outs of bushing 1300, showing various recessed areas 1380 for inserts 1382. The finished bushing 1300 typically will have more recessed areas 1380 than shown in FIGS. 40 and 41. Bushing 1300 is shown having outer surface 1310 being adjacent to fourth inner diameter 1730 of sleeve 300. Such construction facilitates centering sleeve 300 relative to mandrel 110, increases life expectancy of packing units 1000, and restricts relative movement in the directions of arrows 1554,1556 (shown in FIG. 28). However, outer surface 1310 of bushing 1300 can be spaced apart from fourth inner diameter 1730 of sleeve 300.

Bushing 1300 can be supported between end cap 1000 and hub 1400 (see FIG. 28). More specifically, bushing 1300 can be supported between base 1020 (of end cap 1000) and upper surface 1500 (of ring 1490). Relative rotation between end cap 1000 and bushing 1300 can be prevented by having a plurality of tips 1010 (of end cap 1000) operatively connected to a plurality of recesses 1390 (of bushing 1300). Base 1020 (of end cap 1000) supports upper surface 1330 (of bushing 1300). Lower surface 1340 of bushing 1300 is supported by upper surface 1500 (of ring 1490).

Ring 1490 (FIGS. 37 and 38) can be operatively connected to hub 1400 (FIGS. 33 through 35) by a one or more dowels 1480 (see FIG. 28). Preferably, ring 1490 and hub 1400 would be a single piece of material, however, machining concerns may make two pieces more practical. Hub 1400 can be operably connected to mandrel 110 by one or more keys 1660 (see FIGS. 28,29,41, and 42). Keys 1660 can sit in recesses 1650 of mandrel 110. Fasteners 1670 can be used to affix a key 1660 to mandrel 110. Preferably, two keys 1660 are used to connect each hub 1400 to mandrel 110 (providing a total of four keys 1660). Each key 1660 can slide in a groove 1430 of hub 1400 allowing relative longitudinal movement between hub 1400 and mandrel 110. When mandrel 110 (of swivel 100") rotates hub 1400 (and ring 1490) rotates. When sleeve 300 rotates, end cap 1000 and bushing 1300 rotate. Based on this relative movement, lower surface 1340 (of bushing 1300) will move relative to upper surface 1500 (of ring 1490). Additionally, inner surface 1320 (of bushing 1300) will move relative to second surface 1610 (of mandrel). This is one reason for inserts 1382 being placed on bushing's 1300 inner surface 1320 and lower surface 1340. Also assisting in lubricating surfaces which move relative to one another, one or more radial openings 1350 can be radially spaced apart around each bushing 1300. Through openings 1350 a lubricant can be injected which can travel to inner surface 1320 along with lower surface 1340. The lubricant can be grease, oil, teflon, graphite, or other lubricant. The lubricant can be injected through a lubrication port (e.g., upper lubrication port 311). Perimeter pathway 1360 can assist in circumferentially distributing the injected lubricant around bushing 1300, and enable the lubricant to pass through the various openings 1350. Preferably no sharp surfaces/corners exist on outer surface 1310 of bushing 1300 which can damage o-ring 345 when (during assembly and disassembly of swivel 100") bushing 1300 passes by o-ring 345. Similarly preferable, no sharp surfaces/corners exist on first outer diameter 1070 of end cap 1000. Alternatively, outer surface 1310 can be constructed such that it does not touch o-ring 345 when being inserted into sleeve 300.

In some situations a longitudinal thrust load can be placed on mandrel 110 and/or sleeve 300 causing mandrel 110 to move (relative to sleeve 300) in the direction of arrow 1552 and/or sleeve 300 to move (relative to mandrel 110) in the direction arrow 1550. In such a case, assuming that mandrel 110 remains longitudinally static, sleeve 300, end cap 1000, ring 1490, and bearing 1300 will move in the direction of arrow 1550 until lower surface 1420 (of hub 1400) is stopped by shoulder 1630 of mandrel 110 (see FIG. 28). During this motion hub 1400 will slide over one or more keys 1660 (through one or more grooves 1430). In such a manner a certain amount of longitudinal movement between sleeve 300 and mandrel 110 can be absorbed before a thrust load is generated by thrust hub 1400 contacting shoulder 1630. One example where absorption of longitudinal movement may be required where sleeve 300 is being held by annular seal unit 71 (see FIGS. 2 and 24), but where differential pressures existing between fluid above annular seal unit 71 and below annular seal unit 71 cause deflection of annular seal unit 71. In such a case, longitudinal deflection of annular seal unit 71 can be absorbed by relative motion between sleeve 300 and mandrel 110 before a thrust load is placed on thrust hub 1400 and bearing 1300 (see FIG. 28).

Figures 44, 45:
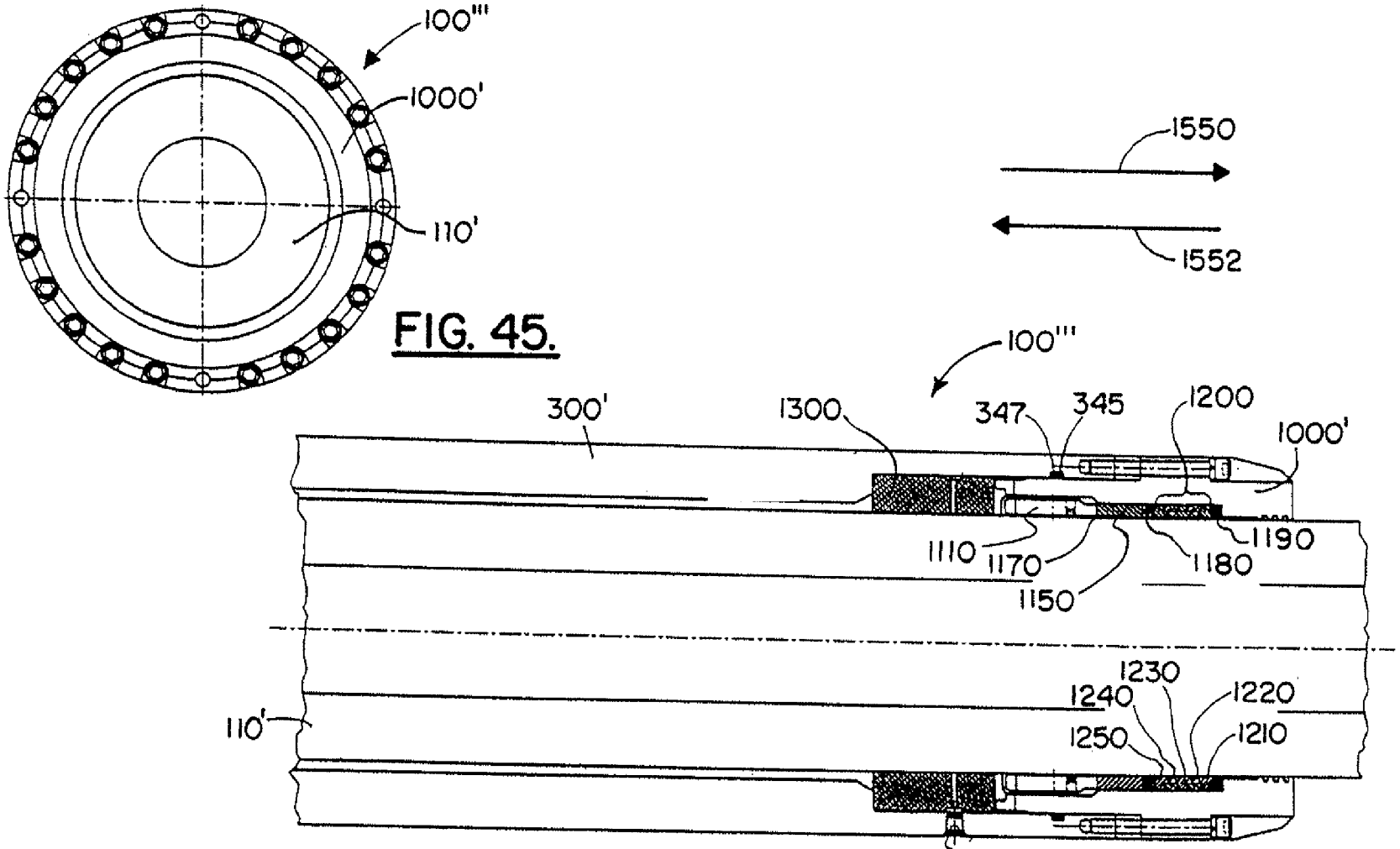
FIG. 44 shows the lower portion of another alternative swivel.
FIG. 45 shows an end view of the swivel of FIG. 44.

FIGS. 44 and 45 show another alternative embodiment. FIG. 44 shows the lower portion of alternative swivel 100''' (upper portion can be substantially similar, but a mirror image). FIG. 45 shows an end view of swivel 100'''. Swivel 100''' incorporates mandrel 110' (FIG. 26) and sleeve 300'. Rotation between mandrel 110' and sleeve 300' is facilitated by bearing 1300. Additionally, relative longitudinal movement between mandrel 110' and sleeve 300' (in the directions of arrows 1550,1552) is also facilitated by bearing 1300. End cap 1000' can be interconnected with bearing 1300 so that bearing 1300 will rotated with (and not relative to) sleeve 300'. Sleeve 300' can be sealed with respect to mandrel 110' through a plurality of seals 1200. Plurality of seals 1200 can be substantially the same as those in other embodiments. Additionally, the opposing end of swivel 100''' can be substantially similar to the end shown in FIG. 44. Swivel 100''' can be a reciprocating swivel and have movements as shown in FIGS. 24 through 27.

In deep water settings, after drilling is stopped the total volume of drilling fluid 22 in the well bore 40 and the riser 80 can be in excess of 5,000 barrels. This drilling fluid 22 must be removed to ready the well for completion. Because of its relatively high cost this drilling fluid 22 is typically recovered for use in another drilling operation. Removal of drilling fluid 22 is typically done through displacement by a completion fluid 96 or displacement fluid 94. However, many rigs 10 do not have the capacity to store and supply 5,000 plus barrels of completion fluid 10 (and/or drilling fluid 22) and thereby displace "in one step" the total volume of drilling fluid 22 in the well bore 40 and riser 80. Accordingly, displacement is done in two or more stages. However, where displacement process is performed in two or more stages, there is a high risk that, during the time period between the stages, the displacing fluid 94 and/or completion fluid 96 will intermix or interface with the drilling fluid 22 thereby causing the drilling fluid 22 to be unusable or require extensive and expensive reclamation efforts before being used again. Additionally, it has been found that, during displacement of the drilling fluid 22, rotation of the drill string 85,86 causes a rotation of the drilling fluid 22 in the riser 80 and well bore 40 and obtains a better overall recovery of the drilling fluid 22 and/or completion of the well. Additionally, during displacement there may be a need to move in a vertical direction (e.g., reciprocate) and/or rotate the drill string 85,86 while performing displacement operations. In one embodiment the riser 80 and well bore 40 can be separated into two volumetric sections 90,92 (e.g., 2,500 barrels each) where the rig 10 can carry a sufficient amount of displacement fluid 94 and/or completion fluid 96 to remove each section without stopping during the displacement process. In one embodiment, fluid removal of the two volumetric sections 90,92 in stages can be accomplished, but there is a break of an indefinite period of time between stages (although this break may be of short duration).

In one embodiment a method and apparatus 100,100', 100'',100''' is provided which can be detachably connected to an annular blowout preventer 70 thereby separating the drilling fluid 22 or mud into upper and lower sections 90,92 and allowing the fluid 22 to be removed in two stages while the drill string 85,86 is being rotated. In one embodiment the drill string 85,86 is not rotated, or rotated only intermittently. The swivel can be incorporated into a drill or well string 85,86 and enabling string sections both above and below the sleeve to be rotated in relation to the sleeve 300. Separating the drilling fluid 22 into upper and lower sections 90,92 prevents mixing displacement fluid 94, completion fluid 96 with the separated sections 90,92 during stages.

In one embodiment the drill or well string 85,86 does not move in a longitudinal direction relative to sleeve 300. In one embodiment drill or well string 85,86 does not move in a longitudinal direction relative to mandrel 110. In one embodiment drill or well string 85,86 does move in a longitudinal direction relative to sleeve 300. In one embodiment the drill or well string 85,86 moves in a longitudinal direction relative to the blow-out preventer 70. In one embodiment sleeve 300 does not rotate relative to blow-out preventer 70, but does rotate relative to mandrel 110.

In one embodiment blow-out preventer 70 is operatively connected to sleeve 300 while mandrel 110 and drill or well string 85,86 is reciprocated in a longitudinal direction relative to sleeve 300 and blow-out preventer 70. In one embodiment blow-out preventer 70 is operatively connected to sleeve 300 while mandrel 110 and drill or well string 85,86 is reciprocated in a longitudinal direction relative to sleeve 300 and blow-out preventer 70 and while mandrel 110 and drill or well string 85,86 are rotated relative to blow-out preventer 70. In any of these embodiments reciprocation in a longitudinal direction can be continuous, intermittent, and/or of varying speeds and/or amplitudes. In any of these embodiments rotation can be reciprocating, continuous, intermittent, and/or of varying amplitudes and/or speeds.

In one embodiment any of the swivels can also be used for reverse displacement in which the fluid is pumped in through the choke/kill lines down the annular of wellbore 40 and back up drill workstring 85,86. This process would help to remove debris that falls to the bottom of wellbore 40 that are difficult to remove using forward displacement (where the fluid is pumped down the workstring 85,86 displacing up through the annular to the choke/kill lines.

Figure 46:
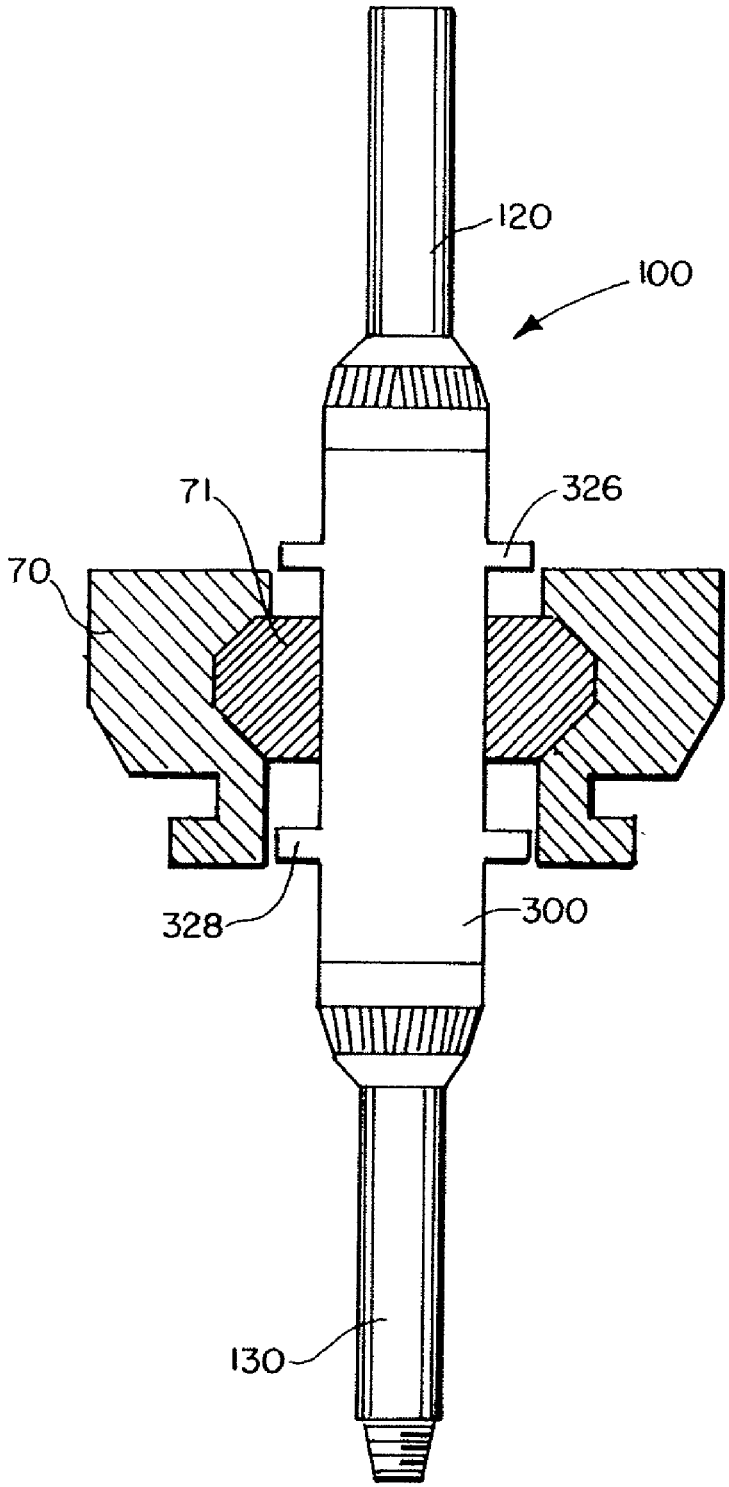
FIG. 46 is a schematic diagram of another alternative swivel have upper and lower catches.
Figure 47:
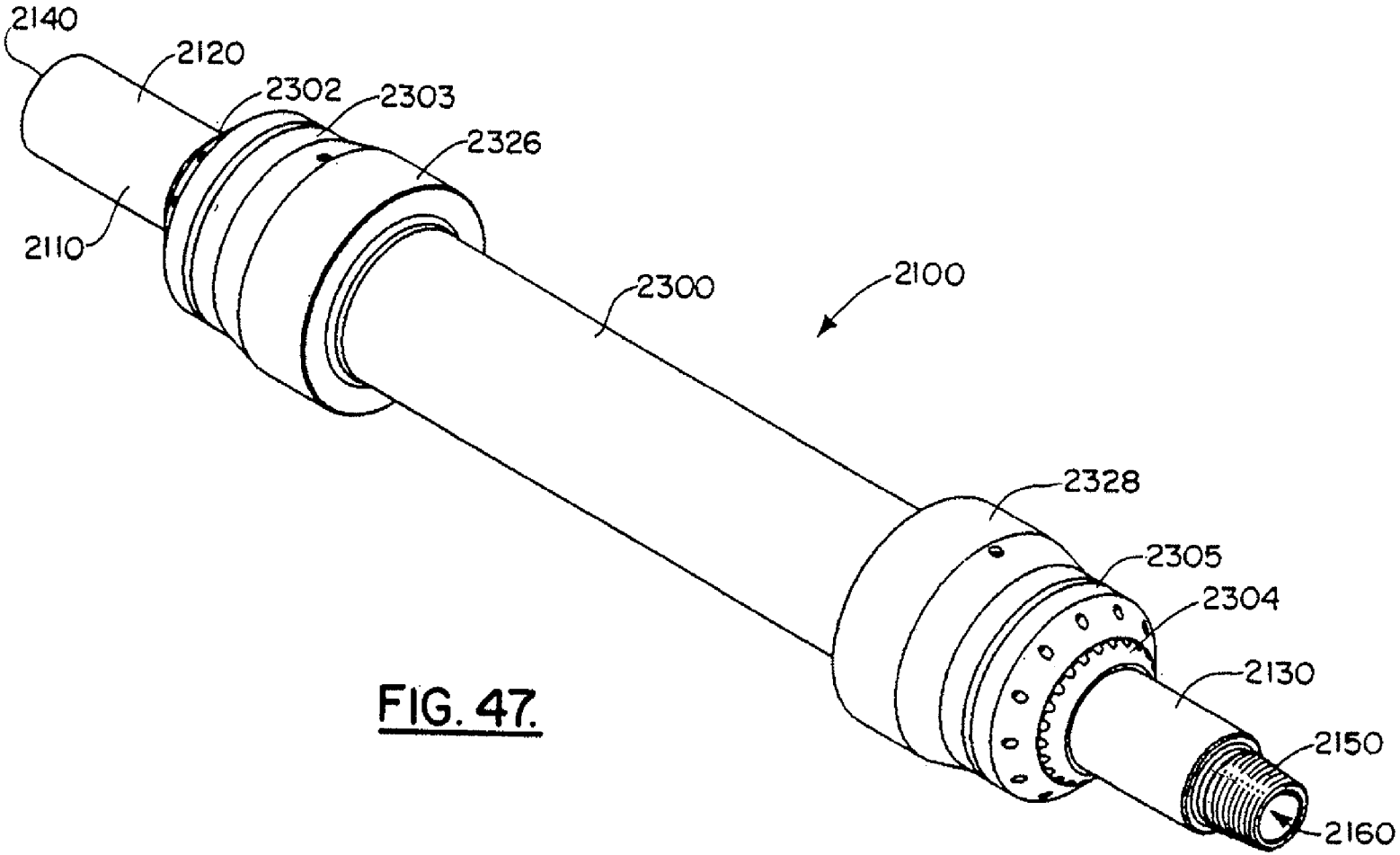
FIG. 47 is a perspective view of an another alternative swivel having modified upper and lower catches.

In an alternative embodiment (schematically illustrated by FIG. 46) adds upper and lower catches 326,328 (or upsets) on sleeve 300. Upper and lower catches 326,326 restrict relative longitudinal movement of sleeve 300 with respect to blow out preventer 70 where high differential pressures exist above and or below blow-out preventer 70 tending to force sleeve 300 in a longitudinal direction. Upper and lower catches 326,328 can be integral with or attachable to sleeve 300. In one embodiment catches 326,328 can be threadably connected to sleeve 300. In one embodiment one or both catches 326,328 can be welded or otherwise connected to sleeve 300. In one embodiment one or both catches 326,328 can be heat or shrink fitted onto sleeve 300. In one embodiment upper and lower catches 326,328 are of similar construction and of a disk like shape. In one embodiment upper and lower catches 326,328 have perimeters which are curved or rounded to resist cutting/tearing of annular seal unit 71 if by chance annular seal unit 71 closes on either upper or lower catch 326,328. In one embodiment upper and lower catches 326,328 have are constructed to avoid any sharp corners to minimize any stress enhances (e.g., such as that caused by sharp corners) and also resist cutting/tearing of other items. In one embodiment the largest distance from either catch 326,328 is less than the size of the opening in the housing for blow-out preventer 70 so that sleeve 300 can pass completely through preventer 70. In one embodiment the upper surface of upper catch 326 and the lower surface of lower catch 328 have frustoconical shapes which can act as centering devices for sleeve 300 if for some reason sleeve 300 is not centered longitudinally when passing through blow-out preventer 70. In one embodiment upper catch 326 is actually larger than the size of the opening in the housing for blow-out preventer 70 which will allow sleeve to make metal to metal contact with the housing for blow-out preventer 70.

In one embodiment the largest distance from either catch 326,328 is less than the size of the opening in the housing for blow-out preventer 70, but large enough to contact the supporting structure for annular seal unit 71 thereby allowing metal to metal contact either between upper catch 326 and the upper portion of supporting structure for seal unit 71 or allowing metal to metal contact between lower catch 328 and the lower portion of supporting structure for seal unit 71. This allows either catch to limit the extent of longitudinal movement of sleeve 300 without relying on frictional resistance between sleeve 300 and annular seal unit 71. Preferably, contact is made with the supporting structure of annular seal unit 71 to avoid tearing/damaging seal unit 71 itself.

In one embodiment non-symmetrical upper and lower catches 326,328 can be used. For example a plurality of radially extending prongs can be used. As another example a single prong can be used. Additionally, channels, ridges, prongs or other upsets can be used. The catches or upsets to not have to be symmetrical. Whatever the configuration upper and lower catches 326,328 should be analyzed to confirm that they have sufficient strength to counteract longitudinal forces expected to be encountered during use.

Figure 48:
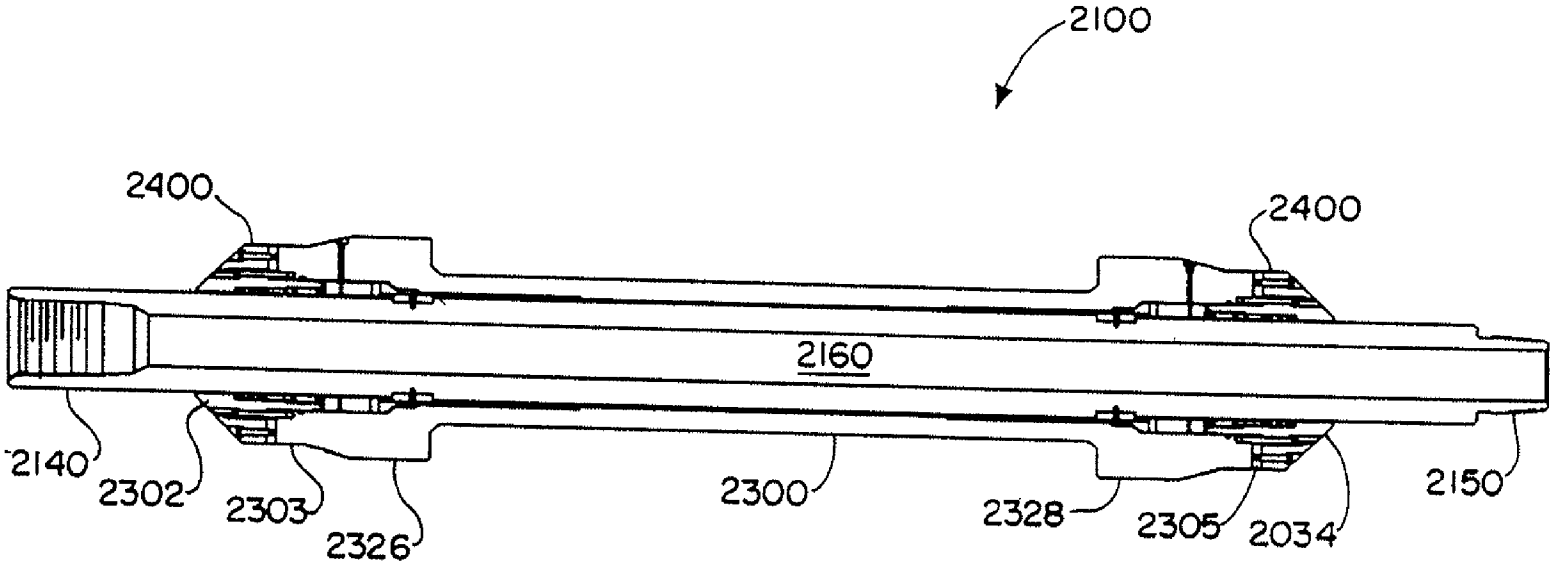
FIG. 48 is a sectional view of the swivel of FIG. 46.
Figure 49:
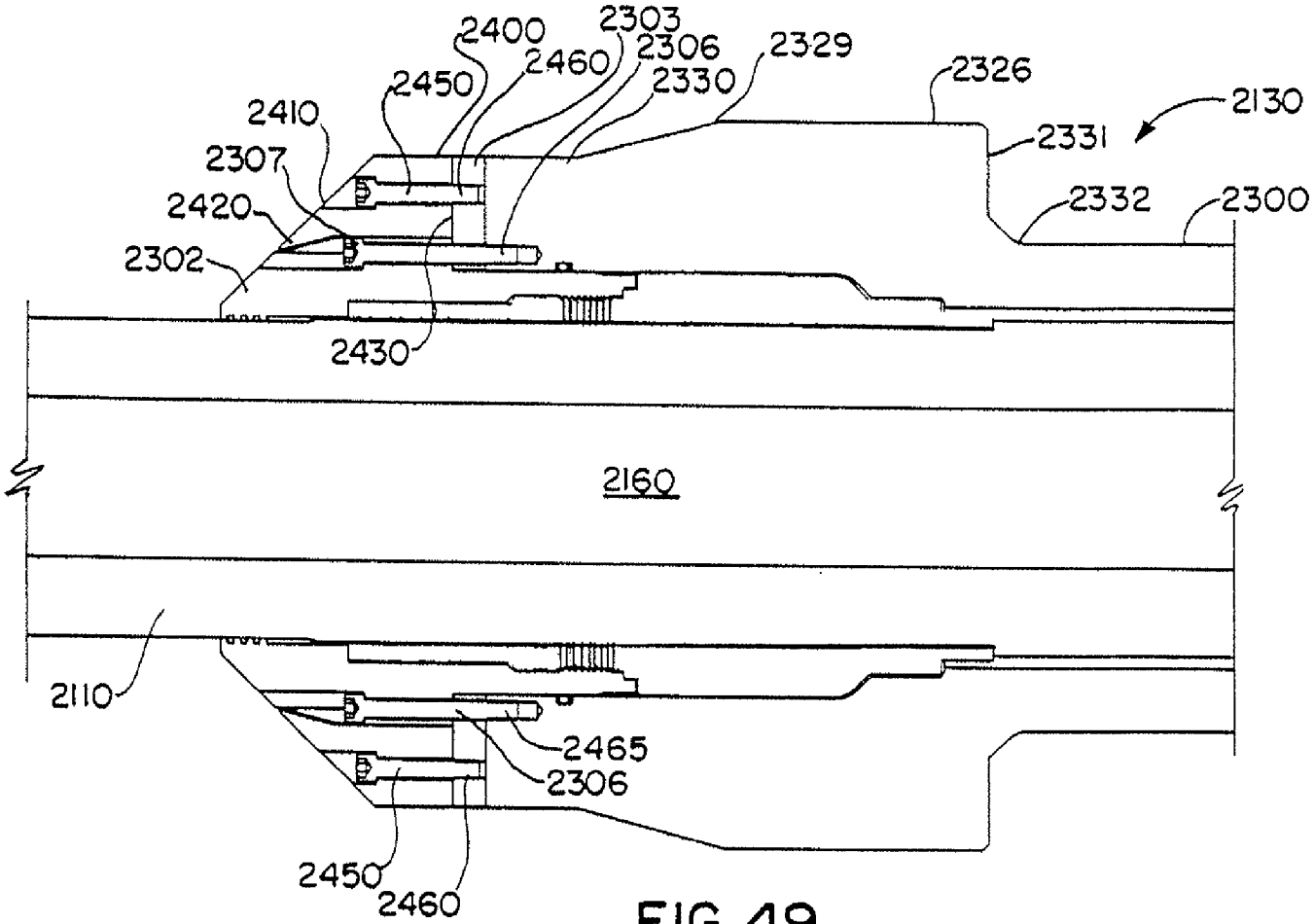
FIG. 49 is an enlarged view of the upper portion of the section view of FIG. 48.
Figure 50:
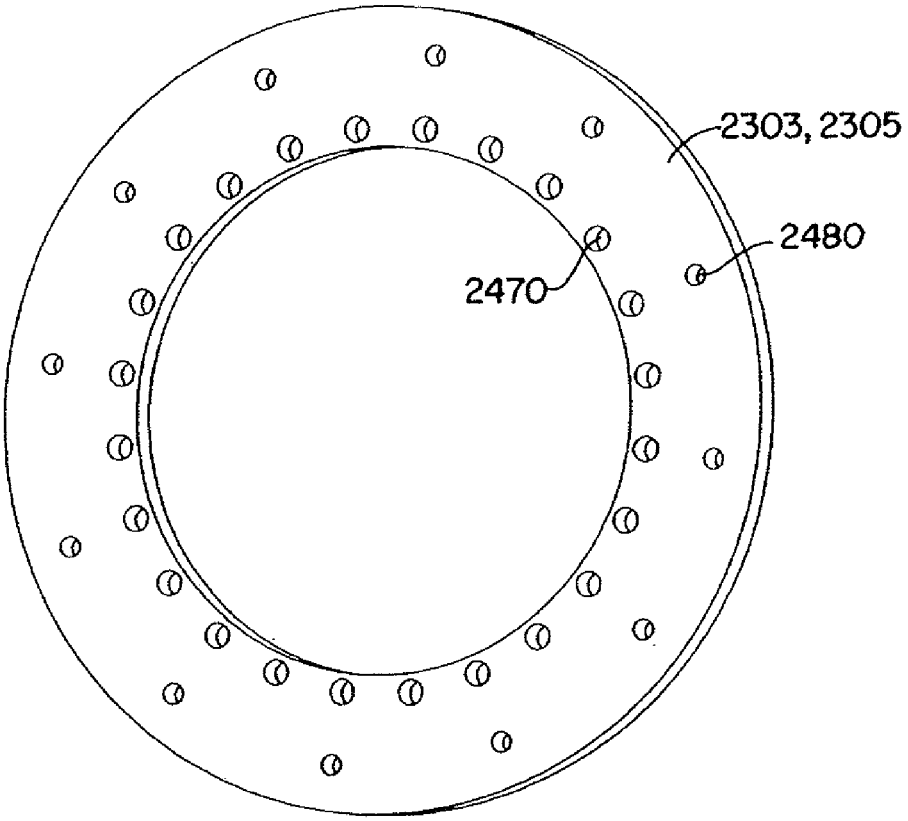
FIG. 50 is a top view of a spacer ring for the swivel of FIG. 46.
Figure 51:
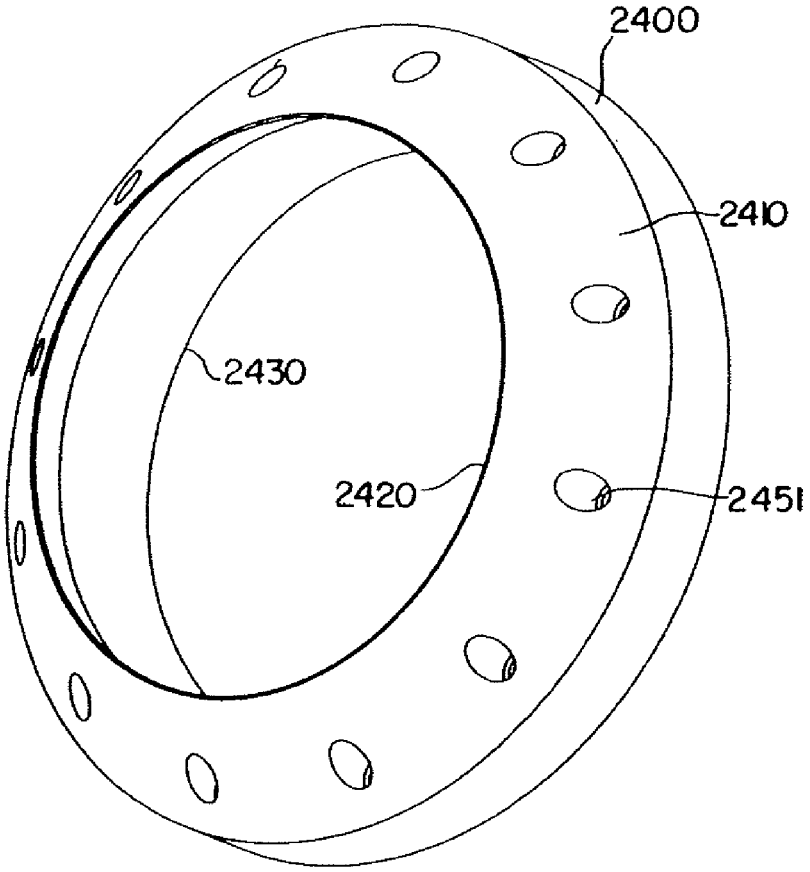
FIG. 51 is a top perspective view of a retainer cap.
Figure 52:
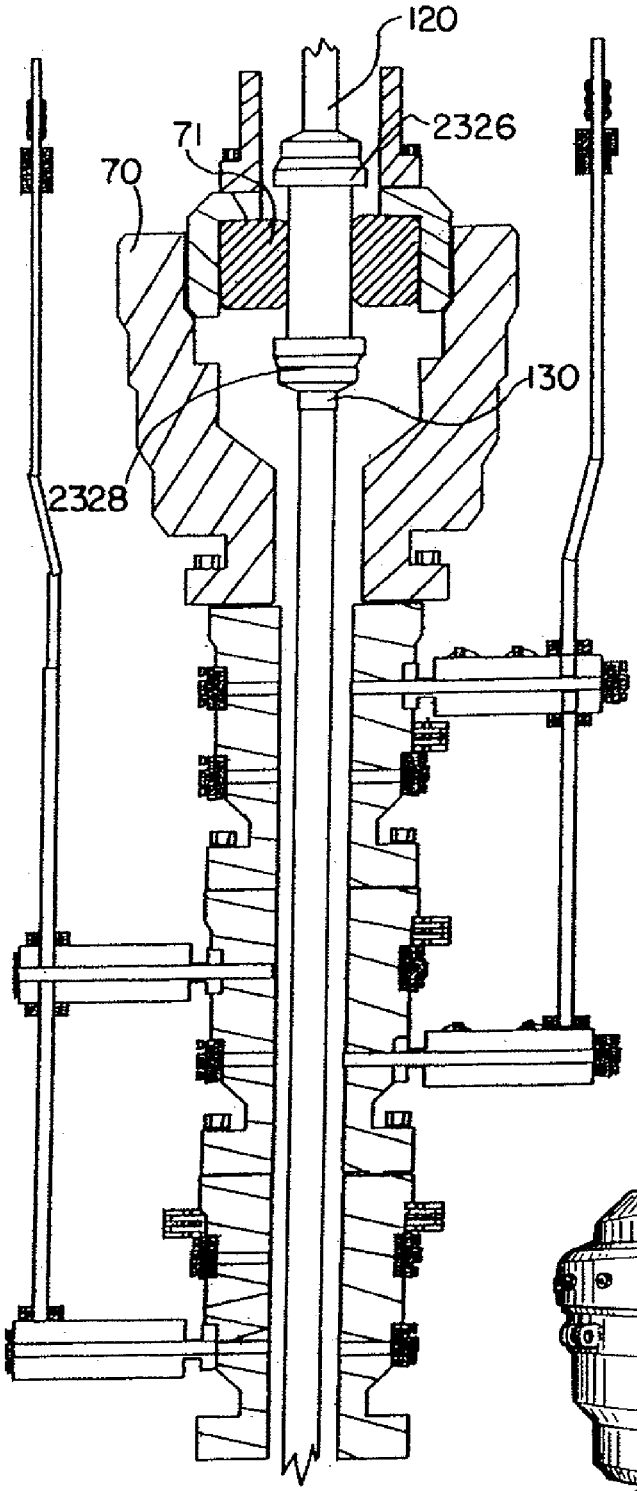
FIG. 52 shows the swivel of FIG. 46 inside a blowout preventer.
Figure 53:
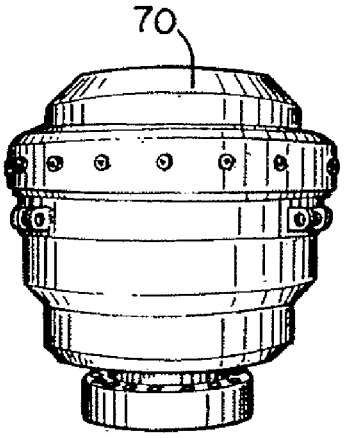
FIG. 53 is a perspective view of a blowout preventer.

FIGS. 47 through 53 illustrate another alternative embodiment for a swivel 2100 having upper and lower catches 2326,2328 on sleeve 2300. FIG. 48 is a sectional view of swivel 2100. FIG. 49 is an enlarged view of upper end 2120 of swivel 2100. FIG. 50 is a top view of a spacer ring 2303,2305 for swivel 2100. FIG. 51 is a top perspective view of a retainer cap 2400. FIG. 52 shows swivel 2100 inside a blowout preventer 70. FIG. 53 is a perspective outside view of a blowout preventer 70.

The construction of swivel 2100 can be substantially similar to the construction of swivel 100" shown in FIGS. 27 through 43 and accompanying text—excepting the modifications for upper and lower catches 2326,2328 along with retainer caps 2400 for end caps 2302,2304 and spacer rings 2303,2305.

In this embodiment the upper and lower catches 2326, 2328 can be shaped to act as centering devices for sleeve 2300 if for some reason sleeve 2300 is not centered longitudinally when passing through blow-out preventer 70. Upper and lower catches 2326,2328 can be constructed substantially similar to each other, but in mirror images.

Retainer caps 2400 (FIG. 51) for end caps 2302,2304 can be designed to prevent the plurality of bolts 2306 from falling out of end caps 2302,2304. Retainer cap 2400 for end cap 2302 can be of substantially similar construction to the retainer cap 2400 for end cap 2304. The design shown in this embodiment for retainer cap 2400 (see FIGS. 47,48, 49, and 51) uses tip 2420 which will restrict longitudinal movement of any of the plurality of bolts 2306 holding end cap 2302 into sleeve 2300. Retainer cap 2400 can be attached to end cap 2302 (and sleeve 2300) through a plurality of bolts 2450. End cap 2302 can be connected to sleeve 2300 through a plurality of bolts 2306. Plurality of bolts 2450 can connect retainer cap 2400 to upper spacer ring 2303 (such as through threaded area 2460). In turn upper spacer ring 2303 can be connected to end cap 2302 through plurality of bolts 2306. Using such configuration will allow retainer cap 2400, upper spacer ring 2303, and upper end cap 2302 to be a single unit. Accordingly, if the plurality of bolts 2306 connecting upper end cap 2302 to sleeve 2300 were to fail, all bolts of plurality of bolts 1306 would be contained by retainer cap 2400. In such a situation end cap 2302 and retainer cap 2400 could only slide on mandrel 2100 until blocked by a upset, such as by the next joint of pipe. Similarly, lower end cap 2304 would be a unit with retainer 2400 and spacer ring 2305. Accordingly, no bolts 2306 would fall down hole. Plurality of bolts 2450 are not expected to fail as they see no transient mechanical loads during operation (the transient mechanical loads are seen by plurality of bolts 2306 (connecting upper end cap 2302) and plurality of bolts 2307 (connecting lower end cap 2304).

Upper and lower catches 2326,2326 can restrict longitudinal movement of sleeve 2300 where high differential pressures exist above and/or below blow-out preventer 70 tending to force sleeve 2300 in a longitudinal direction. Upper and lower catches 2326,2328 can be integral with or attachable to sleeve 2300. In this embodiment upper and lower catches 2326,2328 can include edges which are angled or rounded to resist cutting/tearing of annular seal unit 71 if by chance annular seal unit 71 closes on either upper or lower catches 2326,2328.

Upper catch 2326 can include base 2331, first transition area 2329, and second transition area 2330. Second transition area 2330 can shaped to fit with retainer cap 2400. Retainer cap 2400 can itself include upper surface 2410 which acts as a transition area (See FIG. 49). Furthermore, upper surface 2410 can be shaped to match an angle of transition for upper end cap 2302. In such a way no sharp corners can be found and upper and lower catches 2326, 2328, and they can act as centering devices when being moved downhole and through blow out preventer 70.

Radiused area 2332 can be included to reduce or minimize and stress enhancers between catch 2328 and sleeve 2300. Other methods of stress reduction can be used.

Figure 54:
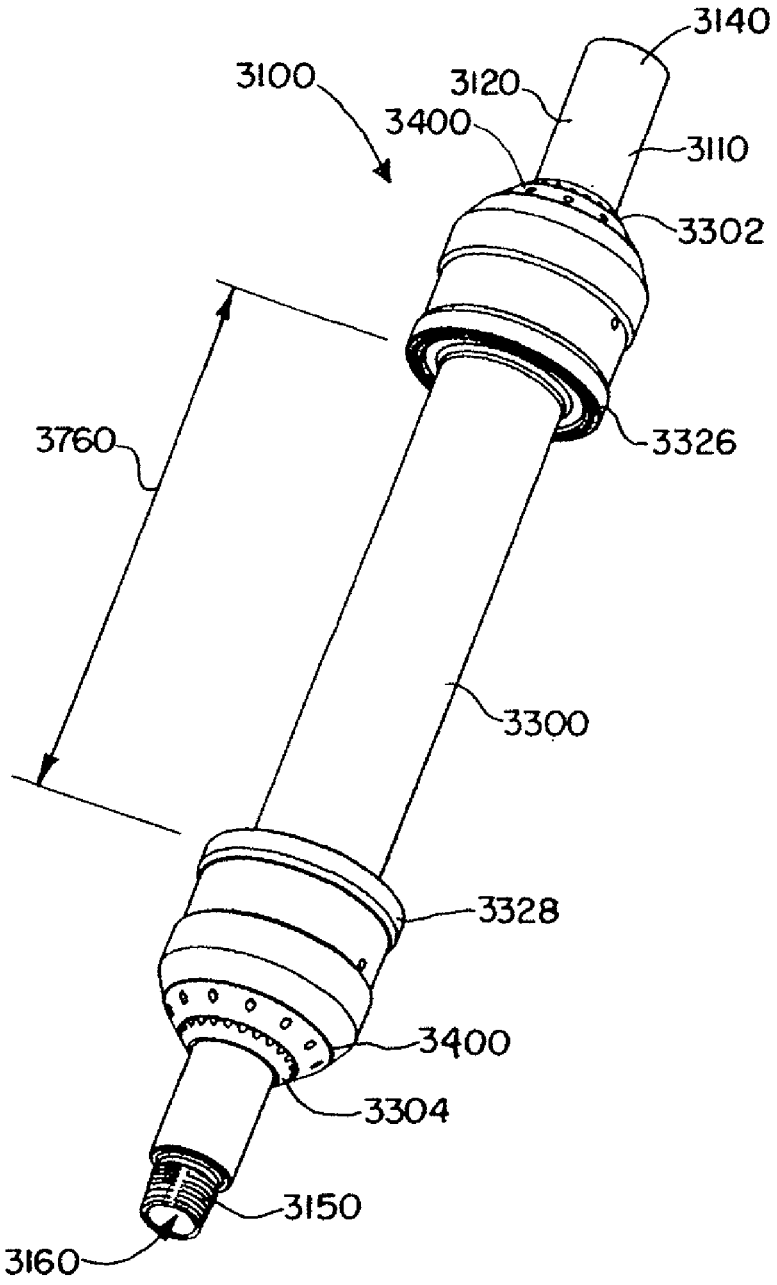
FIG. 54 is a perspective view of another alternative swivel having modified upper and lower catches.
Figure 55:
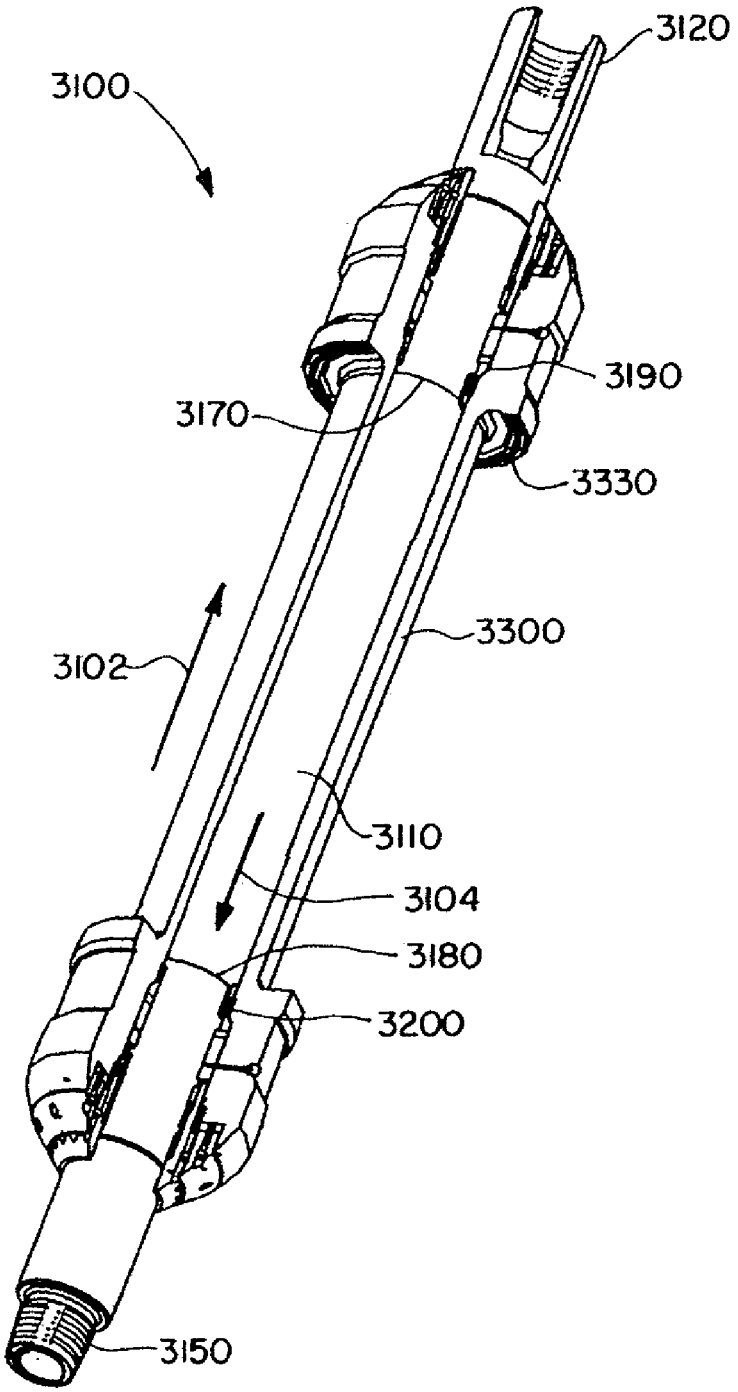
FIG. 55 is a sectional perspective view of the swivel of FIG. 54.
Figure 56:
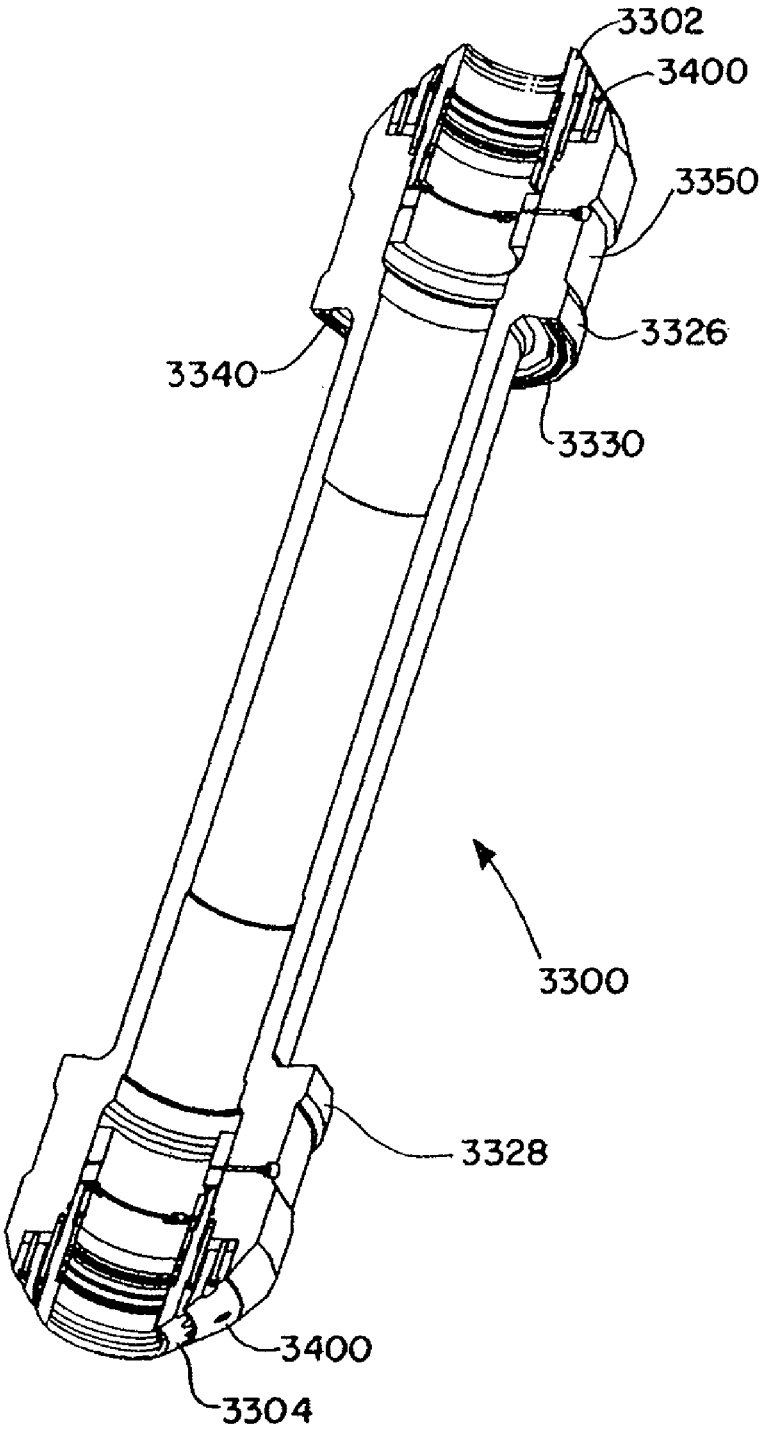
FIG. 56 is a sectional perspective view of the sleeve from the swivel of FIG. 54.
Figure 57:
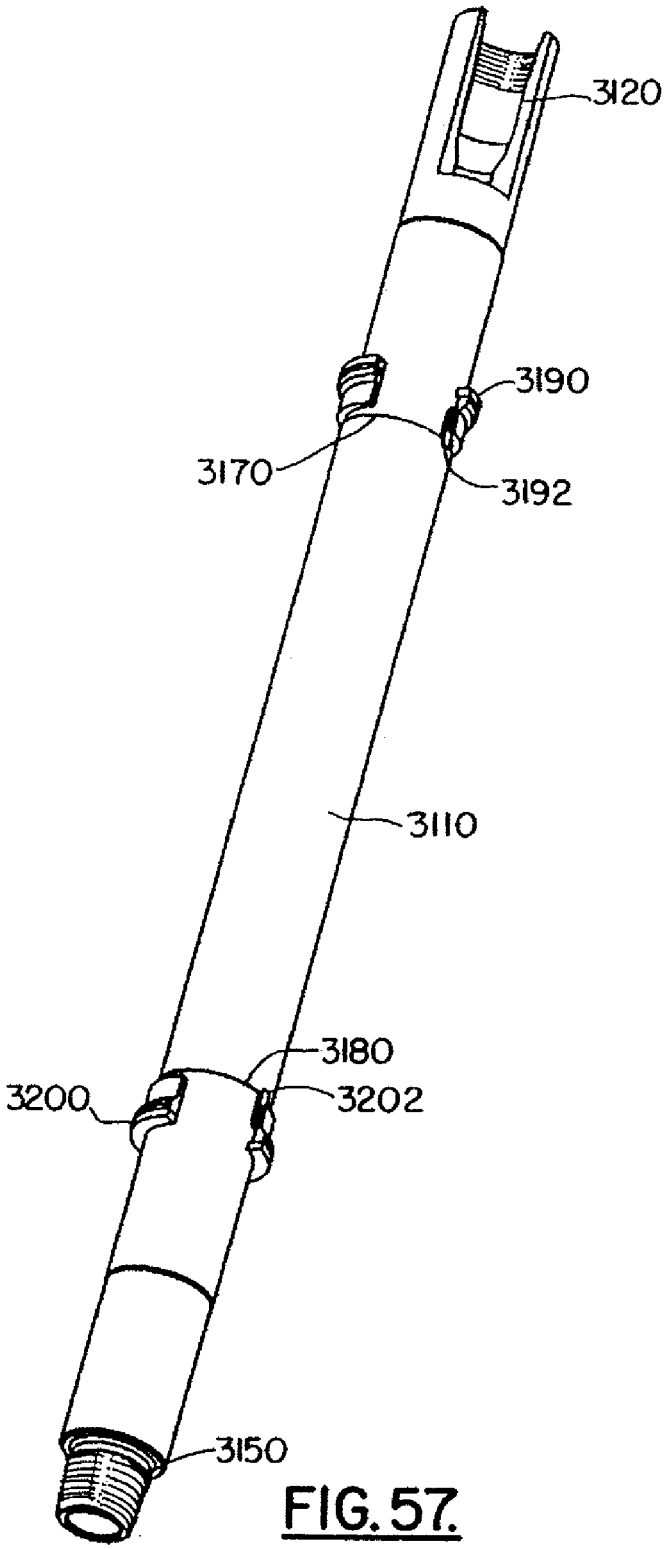
FIG. 57 is a perspective view of the mandrel from the swivel of FIG. 54.
Figure 58:
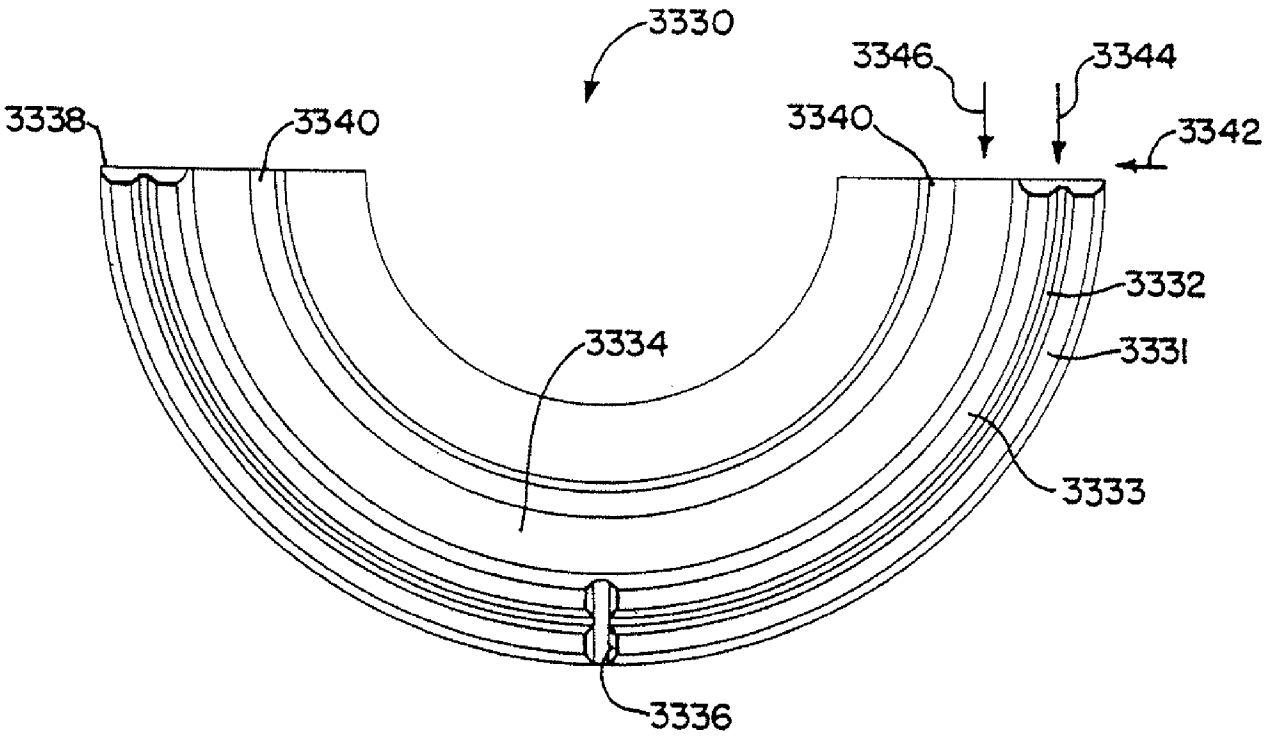
FIG. 58 is an end view of the part of the catch from the sleeve of FIG. 56.
Figure 59:
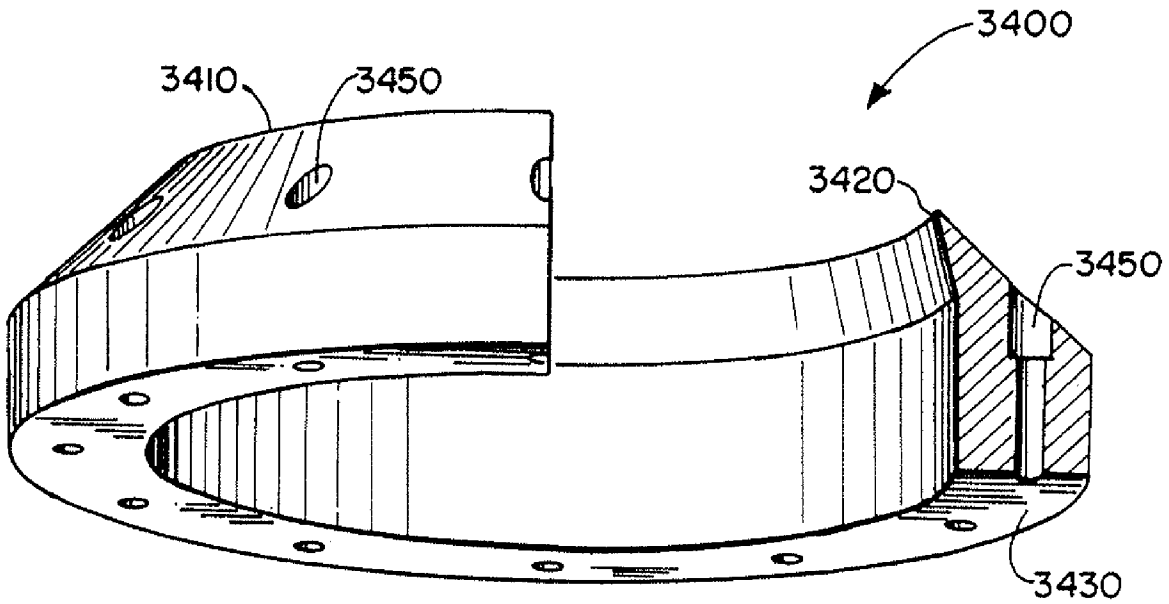
FIG. 59 is a sectional perspective view of a retainer cap.
Figure 60:
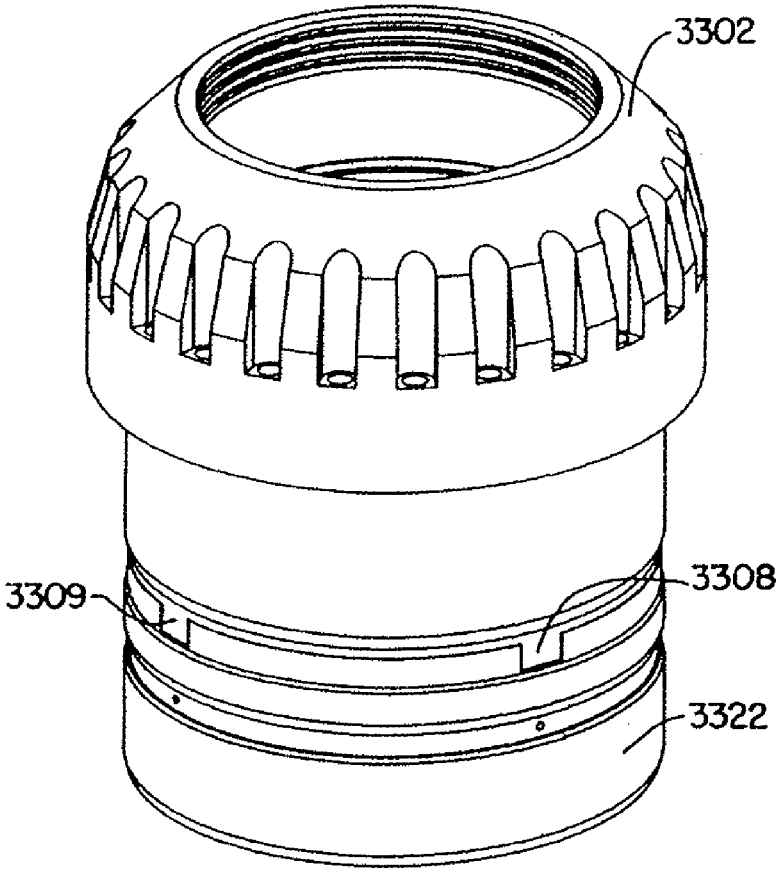
FIG. 60 is a perspective view of an end cap connected to a bearing.
Figure 61:
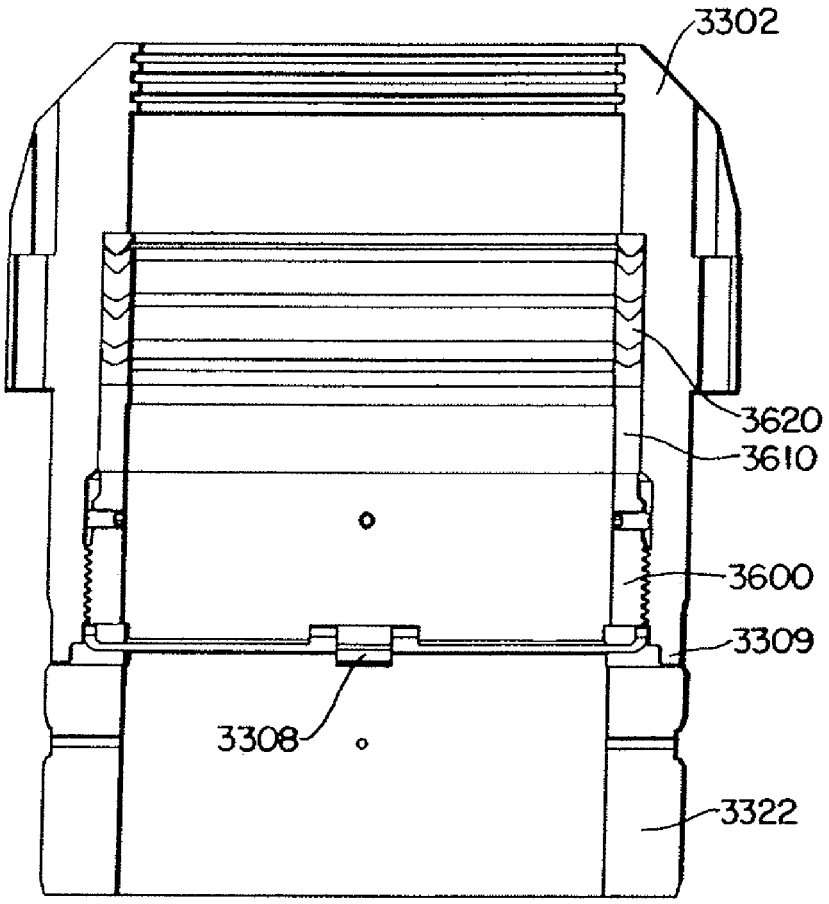
FIG. 61 is a sectional view of the end cap and bearing of FIG. 60.
Figure 62:
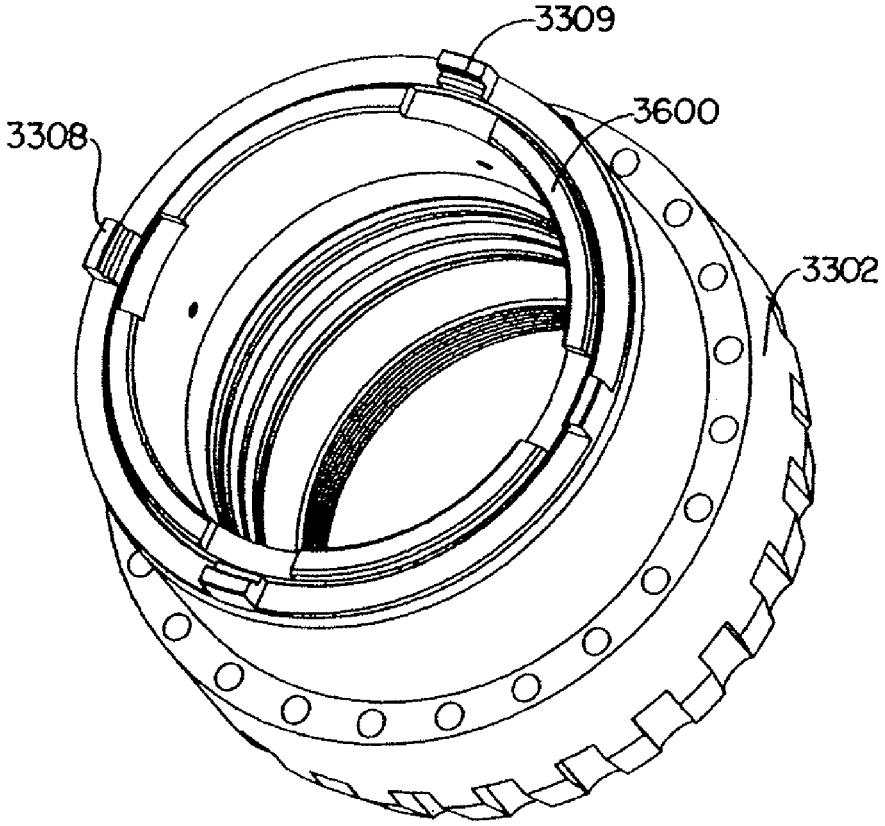
FIG. 62 is a rear perspective view of the end cap of FIG. 60.
Figure 64A:
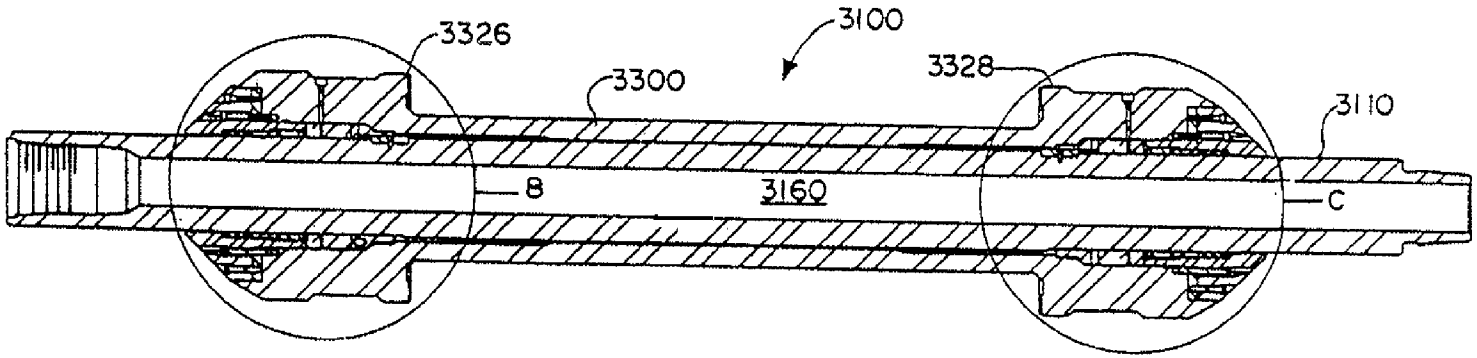
FIGS. 64A through 64C are views of the swivel of FIG. 54 where the sleeve is centered with respect to the mandrel.
Figure 64C:
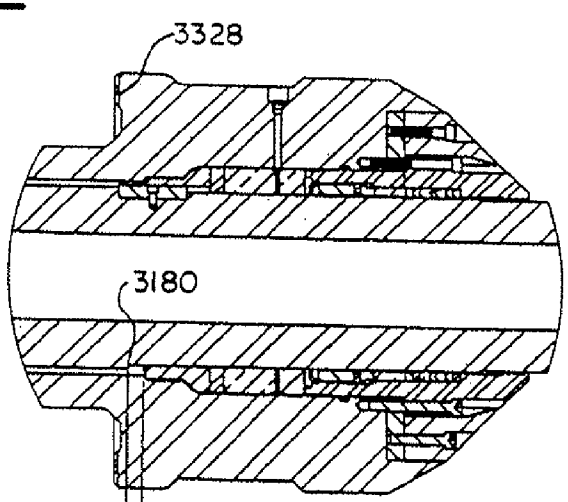
Figure 64B:
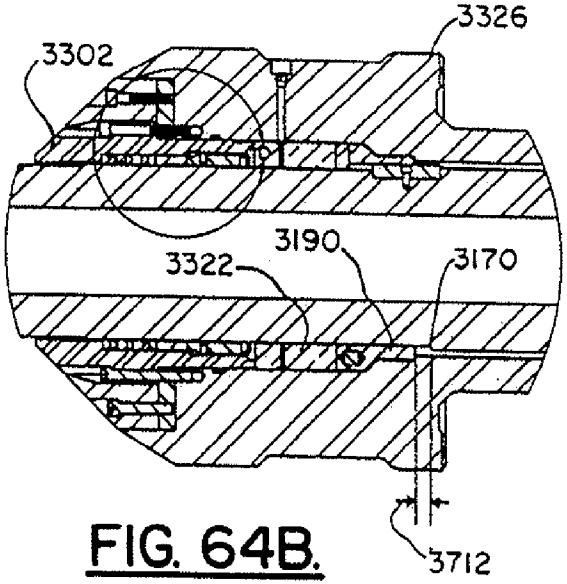

FIGS. 54 through 70 illustrate another alternative embodiment for a swivel 300 having upper and lower catches 3326,3328 on sleeve 3300. FIG. 54 is a perspective view of swivel 3100. FIG. 55 is a sectional perspective view of swivel 3100 exposing mandrel 3110 and showing upper and lower shoulders 3170,3180 along with upper and lower hubs 3190,3200. Upper and lower arrows 3102,3104 schematically indicate that mandrel 3110 and sleeve 3300 can have experience differential longitudinal movement with respect to each other. As will be described in more detail below this differential longitudinal movement is limited by upper and lower hubs 3190,3200 contacting upper and lower shoulders 3170,3180. In a preferred embodiment the differential longitudinal movement is about 1¼ inches. FIG. 56 is a sectional perspective view of sleeve 3300. FIG. 57 is a perspective view of mandrel 3110 and showing upper and lower shoulders 3170,3180 along with upper and lower hubs 3190,3200. FIG. 59 is a sectional perspective view of a retainer cap 3400. Retainer cap 3400 can comprise base 3430 and tip 3420. Plurality of openings 3450 for bolts can be provided. FIGS. 60 through 62 show upper end cap 3302, packing system 3620, and bearing 3322. End cap 3302 can interlock with bearing 3322 through a plurality of tips (e.g., 3308, 3309, etc.). Packing system 3620 can be used to seal mandrel 3110 to sleeve 3300. Packing system 3620 can be locked into place by packing retainer nut 3600 and spacer ring 3610. Lower end cap 3304 can be constructed substantially similar to upper end cap 3302.

The construction of swivel 3100 can be substantially similar to the construction of swivel 100" shown in FIGS. 27 through 43 and accompanying text—excepting the modifications for upper and lower catches 3326,3328 along with retainer caps 3400 for end caps 3302,3304.

In this embodiment the upper and lower catches 3326, 3328 can be shaped to act as centering devices for swivel 3100 if for some reason swivel 3100 is not centered longitudinally when passing through blow-out preventer 70. Upper and lower catches 3326,3328 can be constructed substantially similar to each other, but in mirror images.

Retainer caps 3400 (FIG. 59) for end caps 3302,3304 can be designed to prevent the plurality of bolts 3306 from falling out of end caps 3302,3304. Retainer cap 3400 for end cap 3302 can be of substantially similar construction to the retainer cap 400 for end cap 3304. The design shown in this embodiment for retainer cap 3400 (see FIGS. 54-56,59, 63-65, and 69) uses tip 3420 (FIG. 63B) which will restrict longitudinal movement of any of the plurality of bolts 3306 holding end cap 3302 into sleeve 3300, where one or more of the plurality of bolts comes loose. Retainer cap 3400 can be attached to end cap 3302 (and sleeve 3300) through a plurality of bolts 3452. End cap 3302 can be connected to sleeve 3300 through a plurality of bolts 3306. Plurality of bolts 3452 can connect retainer cap 3400 to upper spacer ring 3303 (such as through threaded area 3460). In turn upper spacer ring 3303 can be connected to end cap 3302 through plurality of bolts 3306. Using such configuration will allow retainer cap 3400, upper spacer ring 3303, and upper end cap 3302 to be a single unit. Accordingly, if the plurality of bolts 3306 connecting upper end cap 3302 to sleeve 3300 were to fail, all bolts of plurality of bolts 3306 would be contained by retainer cap 3400. In such a situation end cap 3302 and retainer cap 3400 could only slide on mandrel 3100 until blocked by a upset, such as by the next joint of pipe. Similarly, lower end cap 3304 would be a unit with retainer 3400 and spacer ring 3305. Accordingly, no bolts 3306 would fall down hole. Plurality of bolts 3452 are not expected to fail as they see no transient mechanical loads during operation (the transient mechanical loads are seen by plurality of bolts 3306 (connecting upper end cap 3302) and plurality of bolts 3307 (connecting lower end cap 3304).

Upper and lower catches 3326,3326 can restrict longitudinal movement of sleeve 3300 where high differential pressures exist above and/or below blow-out preventer 70 tending to force sleeve 3300 in a longitudinal direction. Upper and lower catches 3326,3328 can be integral with or attachable to sleeve 3300. In this embodiment upper and lower catches 3326,3328 can include edges which are angled or rounded to resist cutting/tearing of annular seal unit 71 if by chance annular seal unit 71 closes on either upper or lower catches 3326,3328.

Figure 65A:
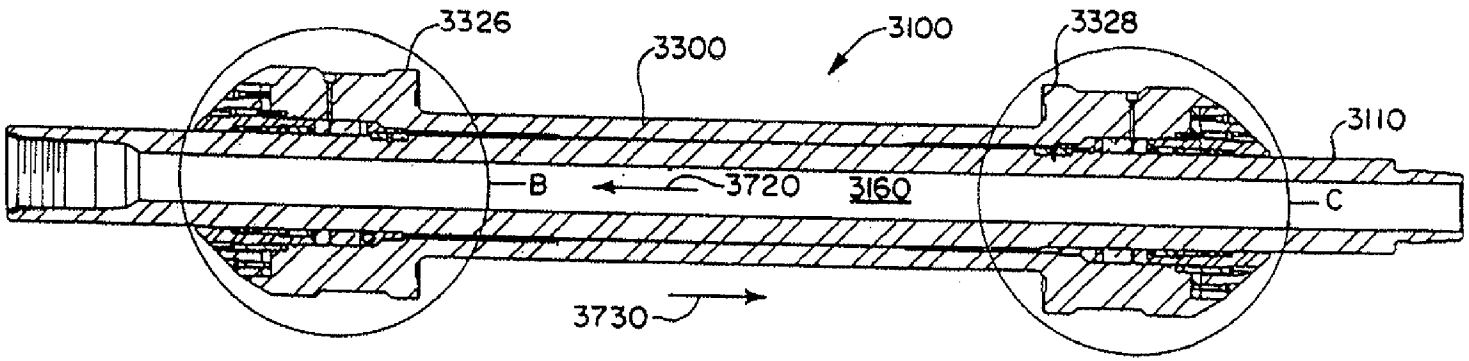
FIGS. 65A through 65C are views of the swivel of FIG. 54 where the sleeve is moved down with respect to the mandrel.
Figure 65C:
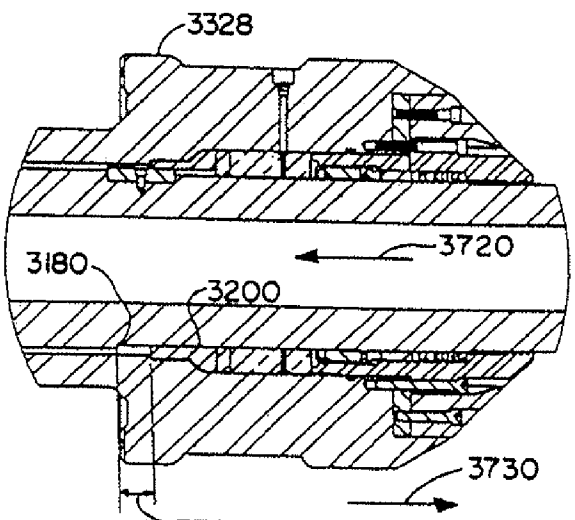
Figure 65B:
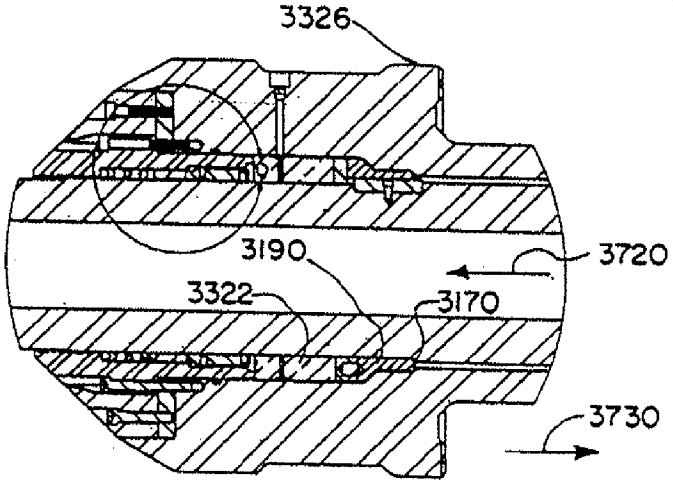

Differential longitudinal movement in swivel 3100 between mandrel 3110 and sleeve 3300 is schematically illustrated in FIGS. 63 through 65C. FIGS. 63 through 63C are sectional views of swivel 3100 where sleeve 3300 is moved longitudinally upward with respect to mandrel 3110. Arrows 3700,3710 indicate this differential longitudinal movement. FIG. 63B shows gap 3702 between upper hub 3190 and upper shoulder 3170. FIG. 63C shows lower hub 3200 being in contact with lower shoulder 3180. FIGS. 64A through 64C are sectional views of swivel 3100 where sleeve 3300 is longitudinally centered with respect to mandrel 3110. FIG. 64B shows gap 3712 between upper hub 3190 and upper shoulder 3170. FIG. 64C shows gap 3714 between lower hub 3200 and lower shoulder 3180. FIGS. 65A through 65C are views of swivel 3100 where sleeve 3300 is moved longitudinally downward with respect to mandrel 3300. Arrows 3720,3730 indicate this differential longitudinal movement. FIG. 65B shows upper hub 3190 being in contact with upper shoulder 3170. FIG. 65C shows gap 3722 between lower hub 3200 and lower shoulder 3180.

Figure 66:
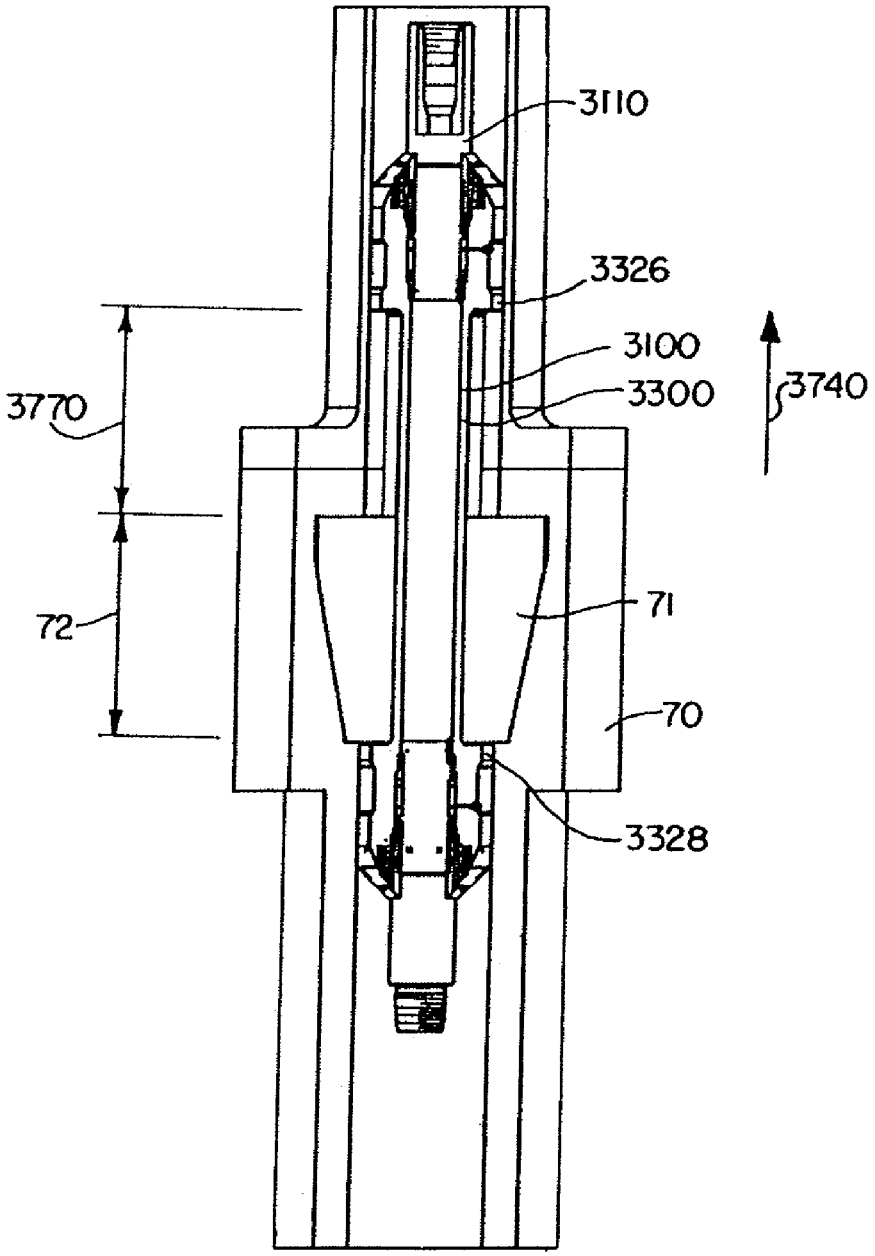
FIG. 66 is a perspective view of the swivel of FIG. 54 where the mandrel and sleeve are pulled up with respect to the annular blow out preventer.
Figure 67:
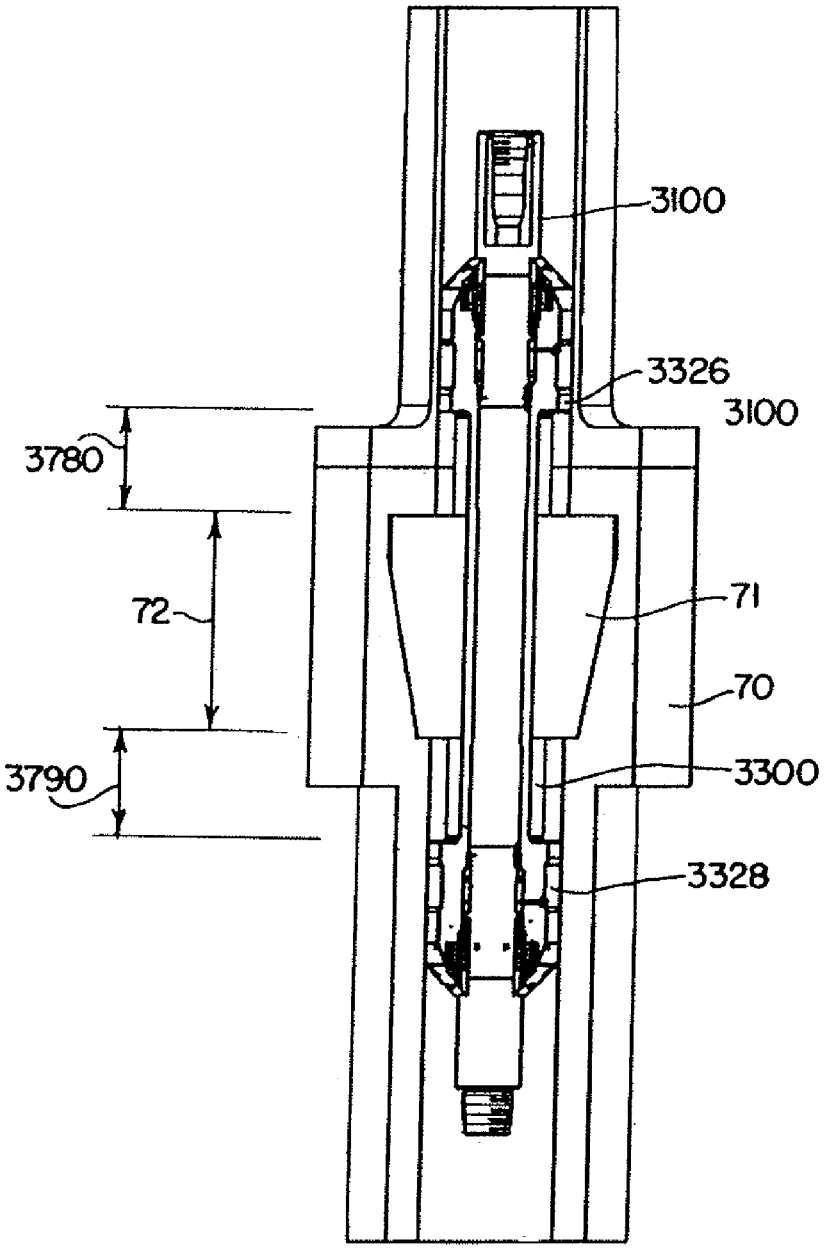
FIG. 67 is a perspective view of the swivel of FIG. 54 where the mandrel and sleeve are centered longitudinally with respect to the annular blow out preventer.
Figure 68:
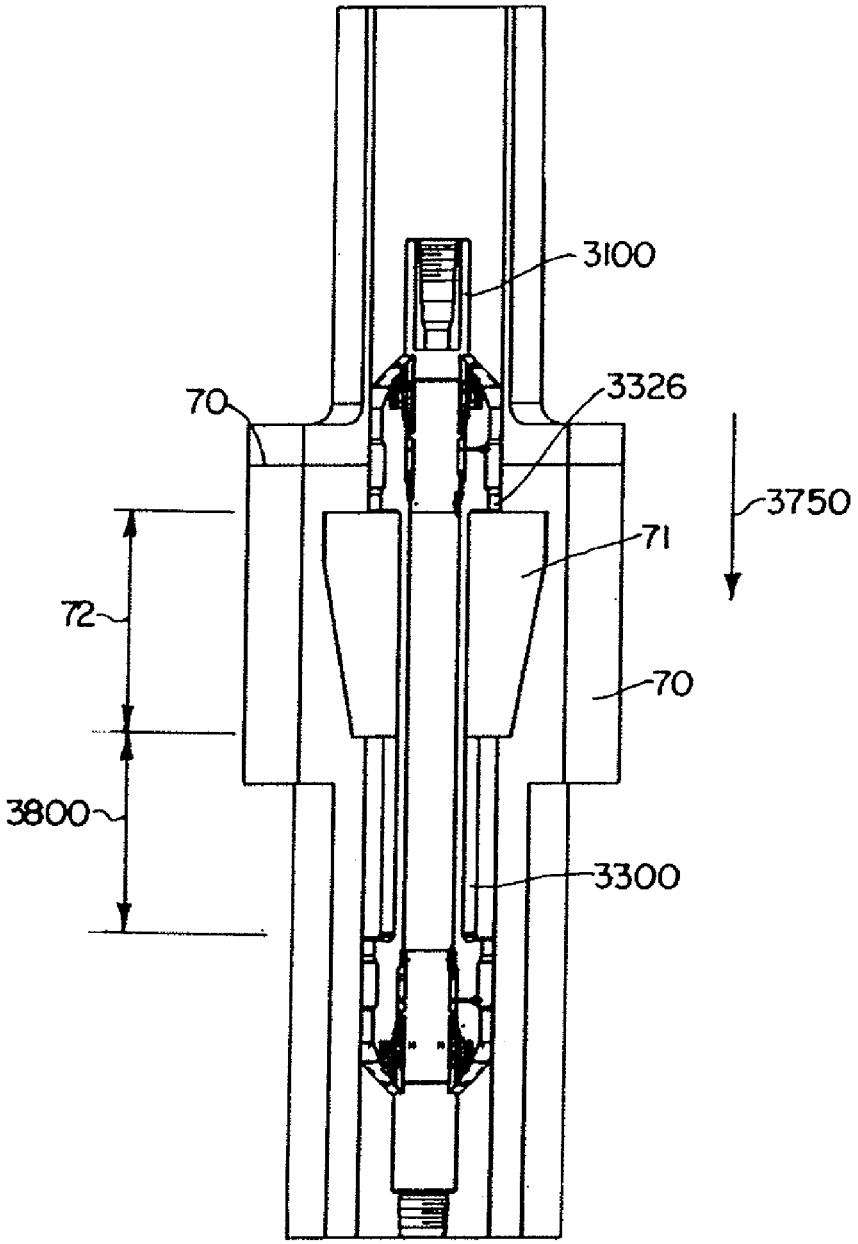
FIG. 68 is a perspective view of the swivel of FIG. 54 where the mandrel and sleeve are pushed down with respect to the annular blow out preventer.

FIGS. 66 through 68 schematically illustrate longitudinal movement of swivel 3100 relative to annular seal unit 71. FIG. 66 is a perspective view of swivel 3100 where mandrel 3110 and sleeve 3300 are pulled up with respect to seal unit 71. FIG. 67 is a perspective view of swivel 3100 where mandrel 3110 and sleeve 3300 are centered longitudinally with respect to seal unit 71. FIG. 68 is a perspective view of swivel 3100 where mandrel 3110 and sleeve 3300 are pushed down with respect to seal unit 71. The amount of differential longitudinal movement between sleeve 3300 and seal unit 71 is the difference between the distance 3760 between end catches (FIG. 54) and the height 72 of annular seal unit 71. In FIG. 66 distance 3770 shows this difference. In FIG. 67, distances 3780 plus 3790 show this difference. In FIG. 68 distance 3800 show this difference.

Figure 69A:
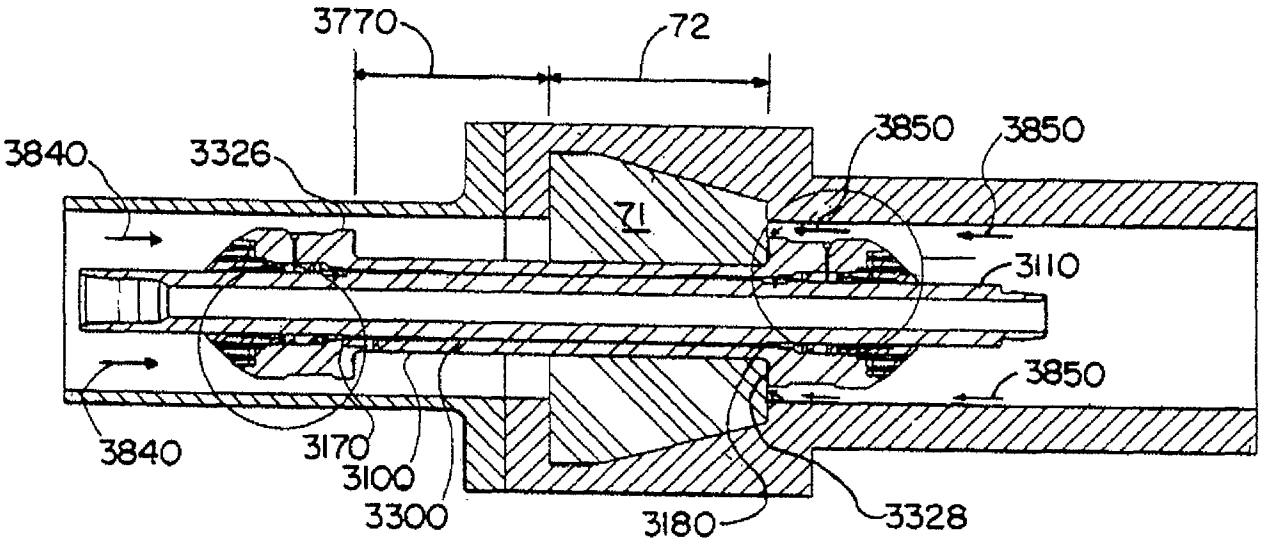
FIGS. 69 through 69 C are views of the swivel of FIG. 54 where the mandrel and sleeve are pulled up with respect to the annular blow out preventer.
Figure 69:
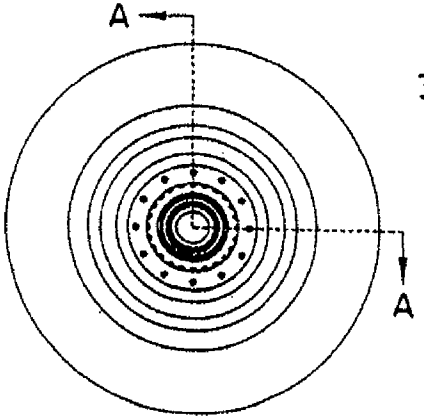
Figure 69C:
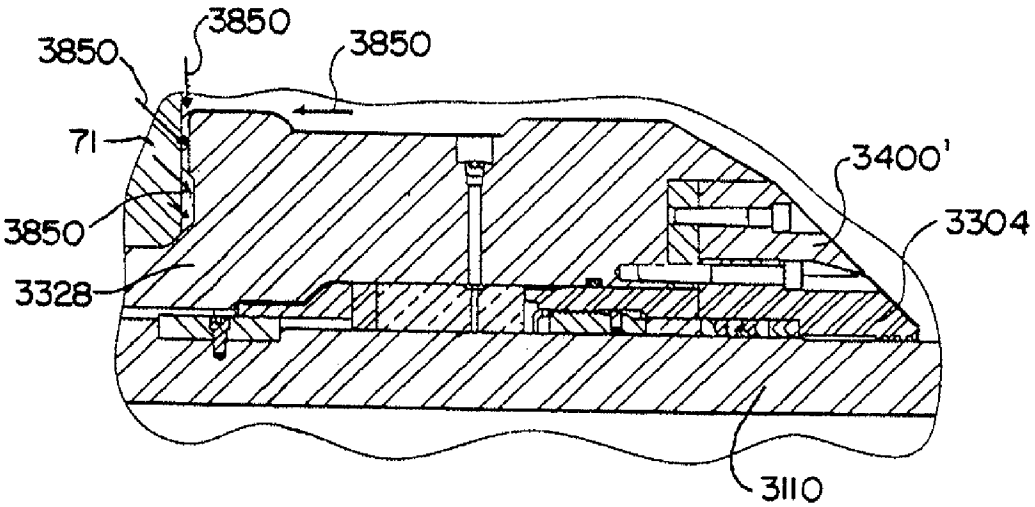
Figure 69B:
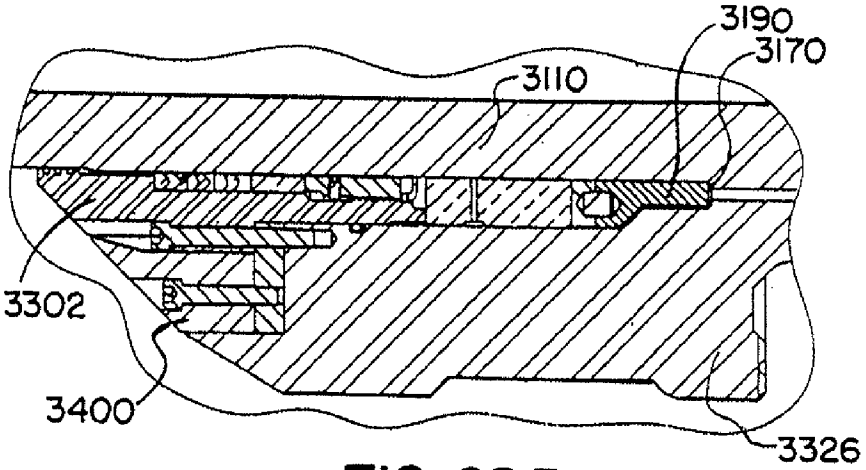

FIGS. 69 through 69 C are sectional views of swivel 3100 where sleeve 3300 is pulled up with respect to seal unit 71. In FIGS. 69A and 69C lower catch 3328 is in contact with seal unit 71 and upper catch 3326 is spaced apart from seal unit 71 by distance 3770. Plurality of arrows 3840 indicate fluid pressure above seal unit 71. Plurality of arrows 3850 indicate fluid pressure below seal unit 71. To reduce any a differential force on sleeve 3300 when contacting seal unit 71, lower catch 3328 can be prevented from sealing with respect to seal unit 71. One embodiment includes a groove and valley design for the bases of upper and lower catches 3326,3328, which design is shown in FIGS. 54-56, 58, and 63-69. Such groove design is best shown in FIGS. 58 and 69A.

Figure 70:
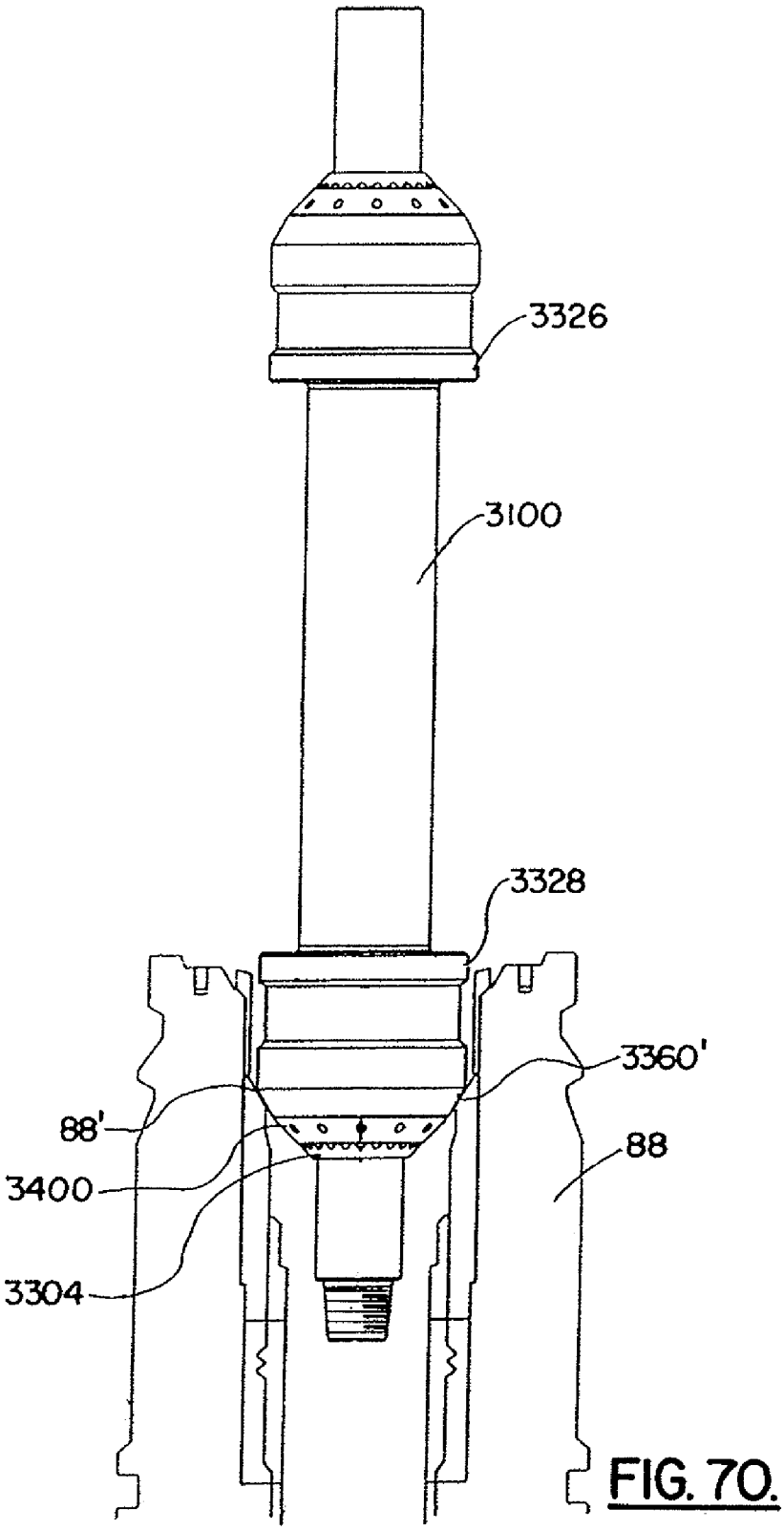
FIG. 70 is a schematic diagram illustrating the swivel of 54 seating on a well head.

Plurality of arrows 3850 in FIGS. 69A and 69C schematically illustrate fluid migrating between seal unit 71 and lower catch 3328. Fluid cannot migrate past seal unit 71 as it seals with sleeve 3300. FIG. 58 is a partial end view of the catches 3326,3328 showing a ridge and valley system. The upper half of the catch is not shown in FIG. 58. Shown are first and second ridges 3331,3333. Between these two ridges is first groove 3332. On the opposite side of second ridge 3333 as first groove 3332 is second groove 3334. A plurality of radial ports (e.g., 3336,3338, etc.) can be used to allow fluid to migrate to first and second grooves 3332,3334. Arrow 3342 schematically indicates a fluid migrating into a radial port. Arrows 3344,3346 schematically indicate the fluid continuing to migrate into first and second grooves 3332,3334. In this manner, where a seal is made between either catch 3326,3328 and seal unit 71, the amount of net increase in thrust load seen by sleeve 3300 is reduced by the areas of grooves 3332,3334. FIG. 70 is a schematic diagram illustrating swivel 3100 resting on well head 88. It is preferred that swivel 3100 be prevented from passing through wellhead 88. Here, this preference is accomplished by making the diameter of lower catch 3328 larger than the smallest opening in wellhead 88. Additionally, it is preferred that where swivel 3100 and wellhead 88 make contact any damage be reduced. Here, reduction of damage from contact is accomplished by making swivel conform to the shape of the smallest opening in wellhead 88. As shown the angle of first transitional area 3360 matches the angle 88' of the smallest opening in wellhead 88. In another embodiment, a contacting surface can be provided, such as hard rubber, polymer, etc.

The following is a list of reference numerals:

LIST FOR REFERENCE NUMERALS

| (Part No.) Reference Numeral | (Description) Description |
|---|---|
| 10 | rig |
| 20 | drilling fluid line |
| 22 | drilling fluid |
| 30 | rotary table |
| 40 | well bore |
| 50 | drill pipe |
| 60 | drill string or work string |
| 70 | annular blowout preventer |
| 71 | annular seal unit |
| 80 | riser |
| 85 | upper drill string |
| 86 | lower drill string |
| 87 | ground surface |
| 88 | well head |
| 90 | upper volumetric section |
| 92 | lower volumetric section |
| 94 | displacement fluid |
| 96 | completion fluid |
| 100 | swivel |
| 101 | upper section |
| 102 | lower section |
| 110 | swivel mandrel |
| 120 | upper end |
| 130 | lower end |
| 140 | box connection |
| 150 | pin connection |
| 160 | central longitudinal passage |
| 170 | shoulder |
| 171 | upper surface of shoulder |
| 172 | lower surface of shoulder |
| 180 | outer surface of shoulder |
| 190 | upper surface of shoulder |
| 200 | lower surface of shoulder |
| 210 | upper packing support area |
| 220 | lower packing support area |
| 230 | bearing |
| 240 | bearing |
| 250 | bearing |
| 260 | bearing |
| 300 | swivel sleeve |
| 302 | upper end cap |
| 303 | spacer ring |
| 303A | height |
| 304 | lower end cap |
| 305 | spacer ring |
| 306 | bolts |
| 307 | bolts |
| 308 | tip |
| 309 | tip |
| 310 | interior section |
| 311 | upper lubrication port |
| 312 | lower lubrication port |
| 320 | protruding section |
| 322 | check valve |
| 324 | check valve |
| 326 | upper catch |
| 328 | lower catch |
| 330 | packing unit |
| 332 | support area |
| 340 | packing retainer nut |
| 341 | mechanical seal |
| 345 | o-ring |
| 346 | o-ring |
| 347 | back-up ring |
| 348 | back-up ring |
| 350 | bore for set screw |
| 360 | set screw for packing retainer nut |
| 361 | bore |
| 370 | threaded area |
| 380 | set screw for receiving area |
| 390 | spacer ring |
| 392 | base |
| 394 | tip |

-continued

LIST FOR REFERENCE NUMERALS

| (Part No.) Reference Numeral | (Description) Description |
|---|---|
| 400 | female packing ring |
| 410 | male packing ring |
| 412 | tip |
| 420 | plurality of seals |
| 450 | packing unit |
| 452 | support area |
| 460 | packing retainer nut |
| 461 | mechanical seal |
| 470 | bore for set screw |
| 480 | set screw for packing retainer nut |
| 490 | threaded area |
| 500 | set screw for receiving area |
| 510 | spacer ring |
| 520 | female packing ring |
| 530 | male packing ring |
| 540 | plurality of seals |
| 600 | lock |
| 610 | set screw |
| 620 | lock |
| 630 | set screw |
| 700 | H or height of mandrel |
| 715 | W or outer diameter of mandrel |
| 710 | L or length of sleeve |
| 750 | joint of pipe |
| 760 | saver portion |
| 770 | joint of pipe |
| 780 | saver portion |
| 1000 | end cap |
| 1010 | tip |
| 1012 | second level |
| 1020 | base |
| 1030 | surface |
| 1040 | surface |
| 1050 | threads |
| 1060 | mechanical seal |
| 1070 | first outer diameter |
| 1100 | packing unit |
| 1110 | packing retainer nut |
| 1112 | tip |
| 1120 | threaded area |
| 1130 | set screw for packing retainer nut |
| 1140 | bore for set screw |
| 1150 | spacer ring |
| 1160 | base |
| 1170 | tip |
| 1180 | female packing ring |
| 1190 | male packing ring |
| 1200 | plurality of seals |
| 1210 | first seal |
| 1220 | second seal |
| 1230 | third seal |
| 1240 | fourth seal |
| 1250 | fifth seal |
| 1300 | bearing |
| 1310 | outer surface |
| 1320 | inner surface |
| 1330 | upper surface |
| 1332 | recessed area |
| 1340 | lower surface |
| 1350 | opening |
| 1360 | pathway |
| 1380 | recessed area |
| 1382 | inserts |
| 1390 | opening |
| 1392 | base |
| 1400 | hub |
| 1410 | upper surface |
| 1420 | lower surface |
| 1430 | groove |
| 1440 | inner diameter |
| 1450 | first outer diameter |
| 1460 | second outer diameter |
| 1470 | transition area |
| 1480 | dowel |

LIST FOR REFERENCE NUMERALS

| (Part No.) Reference Numeral | (Description) Description |
|---|---|
| 1482 | opening for dowel |
| 1490 | ring |
| 1492 | opening for dowel |
| 1500 | upper surface |
| 1510 | lower surface |
| 1520 | inner diameter |
| 1530 | outer diameter |
| 1550 | arrow |
| 1552 | arrow |
| 1554 | arrow |
| 1556 | arrow |
| 1600 | first surface of mandrel |
| 1610 | second surface of mandrel |
| 1612 | area for plurality of seals |
| 1614 | area for plurality of seals |
| 1620 | third surface of mandrel |
| 1630 | shoulder |
| 1640 | transition |
| 1650 | recess for key |
| 1660 | key |
| 1662 | curved end |
| 1665 | opening |
| 1670 | fastener for key |
| 1700 | first inner diameter of sleeve |
| 1710 | second inner diameter of sleeve |
| 1720 | third inner diameter of sleeve |
| 1730 | fourth inner diameter of sleeve |
| 1740 | transition |
| 1750 | shoulder |
| 1760 | outer diameter |
| 2100 | swivel |
| 2110 | swivel mandrel |
| 2120 | upper end |
| 2130 | lower end |
| 2140 | box connection |
| 2150 | pin connection |
| 2160 | central longitudinal passage |
| 2170 | shoulder |
| 2171 | upper surface of shoulder |
| 2172 | lower surface of shoulder |
| 2180 | outer surface of shoulder |
| 2190 | upper surface of shoulder |
| 2200 | lower surface of shoulder |
| 2210 | upper packing support area |
| 2220 | lower packing support area |
| 2300 | swivel sleeve |
| 2302 | upper end cap |
| 2303 | spacer ring |
| 2304 | lower end cap |
| 2305 | spacer ring |
| 2306 | bolts |
| 2307 | bolts |
| 2308 | tip |
| 2309 | tip |
| 2310 | interior section |
| 2311 | upper lubrication port |
| 2312 | lower lubrication port |
| 2320 | protruding section |
| 2322 | check valve |
| 2324 | check valve |
| 2326 | upper catch |
| 2328 | lower catch |
| 2329 | first transition section |
| 2330 | second transition section |
| 2331 | base |
| 2332 | radiused area |
| 2400 | retainer cap |
| 2410 | upper surface of retainer cap |
| 2420 | tip of retainer cap |
| 2430 | base of retainer cap |
| 2450 | bolts |
| 2451 | recessed area |
| 2460 | threaded area |
| 2465 | threaded area |

LIST FOR REFERENCE NUMERALS

| (Part No.) Reference Numeral | (Description) Description |
|---|---|
| 2470 | plurality of bolt holes |
| 2480 | plurality of bolt holes |
| 3100 | swivel |
| 3102 | arrow |
| 3104 | arrow |
| 3110 | swivel mandrel |
| 3120 | upper end |
| 3130 | lower end |
| 3140 | box connection |
| 3150 | pin connection |
| 3160 | central longitudinal passage |
| 3170 | upper shoulder of mandrel |
| 3180 | lower shoulder of mandrel |
| 3190 | upper hub |
| 3192 | key |
| 3194 | ring |
| 3200 | lower hub |
| 3202 | key |
| 3204 | ring |
| 3300 | swivel sleeve |
| 3302 | upper end cap |
| 3303 | spacer ring |
| 3304 | lower end cap |
| 3305 | spacer ring |
| 3306 | bolts |
| 3307 | bolts |
| 3308 | tip |
| 3309 | tip |
| 3310 | interior section |
| 3311 | upper lubrication port |
| 3312 | lower lubrication port |
| 3320 | protruding section |
| 3322 | upper bearing |
| 3324 | lower bearing |
| 3326 | upper catch |
| 3328 | lower catch |
| 3330 | base |
| 3331 | first ridge |
| 3332 | first groove |
| 3333 | second ridge |
| 3334 | second groove |
| 3336 | first radial port |
| 3338 | second radial port |
| 3340 | radiused area |
| 3350 | peripheral valley |
| 3360 | first transitional area |
| 3370 | angle of first transitional area |
| 3340 | radiused area |
| 3400 | retainer cap |
| 3410 | upper surface of retainer cap |
| 3420 | tip of retainer cap |
| 3430 | base of retainer cap |
| 3450 | plurality of openings for bolts |
| 3451 | recessed area |
| 3452 | plurality of bolts |
| 3460 | threaded area |
| 3465 | threaded area |
| 3470 | plurality of bolt holes |
| 3480 | plurality of bolt holes |
| 3600 | packing retainer nut |
| 3610 | spacer ring |
| 3620 | packing system |
| 3700 | arrow |
| 3702 | gap |
| 3710 | arrow |
| 3712 | gap |
| 3714 | gap |
| 3720 | arrow |
| 3722 | gap |
| 3730 | arrow |
| 3740 | arrow |
| 3750 | arrow |
| 3760 | distance between catches |
| 3770 | difference between catches |

-continued

| LIST FOR REFERENCE NUMERALS | |
|---|---|
| (Part No.) Reference Numeral | (Description) Description |
| | and height of seal unit |
| 3780 | upper gap |
| 3790 | lower gap |
| 3840 | fluid pressure arrow |
| 3850 | fluid pressure arrow |
| BJ | ball joint |
| BL | booster line |
| CM | choke manifold |
| CL | diverter line |
| CM | choke manifold |
| D | diverter |
| DL | diverter line |
| F | rig floor |
| IB | inner barrel |
| KL | kill line |
| MP | mud pit |
| MB | mud gas buster or separator |
| OB | outer barrel |
| R | riser |
| RF | flow line |
| S | floating structure or rig |
| SJ | slip or telescoping joint |
| SS | shale shaker |
| W | wellhead |

All measurements disclosed herein are at standard temperature and pressure, at sea level on Earth, unless indicated otherwise. All materials used or intended to be used in a human being are biocompatible, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A swivel insertable into a drill or work string comprising:

(a) a mandrel having upper and lower end sections rotatable with upper and lower drill or work string sections, the mandrel including a longitudinal passage forming a continuation of a passage in the drill or work string sections;

(b) a sleeve being rotatably and reciprocably with respect to the mandrel;

(c) a plurality of packing units between upper and lower end portions of the mandrel and the sleeve, the plurality of packing units preventing leakage of fluid between the mandrel and the sleeve, at least one of the packing units in the plurality of packing units comprising a rope seal.

2. The swivel of claim 1, wherein the sleeve is reciprocable between the upper and lower end sections of the mandrel.

3. The swivel of claim 1, wherein at least one of the packing units includes a non-rope seal, and the non-rope seal comprises metal filled teflon.

4. The swivel of claim 1, wherein at least one of the packing units includes a non-rope seal, and the non-rope seal comprises bronze filled teflon.

5. A method of performing operations in a wellbore, the method comprising the following steps:

(a) attaching a swivel to a drill string, the swivel including a mandrel having a longitudinal axis and a sleeve, the sleeve being rotatably connected to the mandrel, and a plurality of packing units between upper and lower end portions of the mandrel and the sleeve, the plurality of packing units preventing leakage of fluid between the mandrel and the sleeve, at least one of the packing units in the plurality of packing units comprising a rope seal, with the sleeve including at least one catch that restricts the extent of longitudinal movement of the sleeve relative to a blow-out preventer by contact with a closed seal of the blow-out preventer, the blowout preventer being fluidly connected to a wellbore and a riser;

(b) detachably connecting the blowout preventer to the sleeve by closing the blowout preventer on the sleeve which detachable connection fluidly separating the riser from the wellbore;

(c) during a time period while the blowout preventer is detachably connected to the sleeve and the at least one catch is in contact with the blow-out preventer, and where high differential pressure exists above and below the blow-out preventer, and which high differential force attempts to push the sleeve vertically out of the closed seal, performing operations in the wellbore, wherein the at least one catch in combination with the closed blow out preventer prevents the sleeve from being pushed vertically out of the closed blow out preventer.

6. The method of claim 5, wherein during step "c" a fluid is displaced from the wellbore.

7. The method of claim 6, wherein the fluid is drilling fluid.

8. The method of claim 5, wherein in step "c" the drill string is rotated continuously for a set period of time and the drilling fluid is displaced through a choke line.

9. The method of claim 5, wherein in step "c" the drill string is reciprocated in a longitudinal direction and also rotated around a longitudinal axis of the drill string.

10. The method of claim 5, wherein between steps "b" and "c" the blowout preventer is disconnected from the sleeve.

11. The method of claim 5, wherein the sleeve includes two catches which are spaced apart and which both restrict longitudinal movement relative to the blow out preventer.

* * * * *